US010895077B2

(12) United States Patent
Smith et al.

(10) Patent No.: US 10,895,077 B2
(45) Date of Patent: Jan. 19, 2021

(54) FRAME FOR A WALL PANEL, WALL PANEL, AND METHOD OF MANUFACTURE

(71) Applicant: CertainTeed LLC, Malvern, PA (US)

(72) Inventors: James M. Smith, Jackson, MI (US); Christopher Michael Colyn, Jackson, MI (US); David J. Stucky, Grass Lake, MI (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 16/368,161

(22) Filed: Mar. 28, 2019

(65) Prior Publication Data

US 2019/0301170 A1 Oct. 3, 2019

Related U.S. Application Data

(60) Provisional application No. 62/650,383, filed on Mar. 30, 2018.

(51) Int. Cl.
*E04F 13/08* (2006.01)

(52) U.S. Cl.
CPC ..... *E04F 13/0816* (2013.01); *E04F 13/0835* (2013.01)

(58) Field of Classification Search
CPC ..... E04F 13/0816; E04F 13/0835; E04F 13/0873
See application file for complete search history.

(56) References Cited

U.S. PATENT DOCUMENTS

| | | | | |
|---|---|---|---|---|
| 3,336,709 | A | 8/1967 | Berney et al. | |
| 3,968,610 | A | 7/1976 | Medow | |
| 4,531,338 | A * | 7/1985 | Donatt | E04F 13/0816 29/460 |
| 4,607,471 | A | 8/1986 | Olsen | |
| D309,027 | S | 7/1990 | Noone et al. | |
| 5,112,393 | A | 5/1992 | Engel | |
| 5,314,530 | A | 5/1994 | Wierer | |
| 5,642,597 | A | 7/1997 | Hendrickson | |
| 5,715,637 | A | 2/1998 | Hesterman | |
| 6,044,609 | A | 4/2000 | Kim | |
| 6,178,703 | B1 | 1/2001 | Noone et al. | |
| 6,240,691 | B1 | 6/2001 | Holzkaemper | |
| 6,287,046 | B1 | 9/2001 | Neuhofer, Jr. | |
| 6,713,548 | B1 | 3/2004 | Zhang | |
| 6,868,643 | B1 | 3/2005 | Williams | |
| 6,883,277 | B2 | 4/2005 | Wiechecki | |

(Continued)

*Primary Examiner* — Patrick J Maestri
(74) *Attorney, Agent, or Firm* — McDonnell Boehnen Hulbert & Berghoff LLP

(57) ABSTRACT

The present disclosure relates generally to siding, for example, suitable for covering a wall surface. The present disclosure relates more particularly to a frame for a wall panel. The frame includes a support strip extending in a lateral direction across the width of the wall panel and has first and second ends. The frame also includes a row of columns extending in a first direction from the support strip. Each column includes a proximal end attached to the support strip and a free distal end. The row of columns includes a first column disposed at a first end of the row of columns and laterally offset from the first end of the support strip, and a second column disposed at a second end of the row of columns and laterally offset from the second end of the support strip.

20 Claims, 67 Drawing Sheets

(56) References Cited

U.S. PATENT DOCUMENTS

| | | | |
|---|---|---|---|
| RE39,091 | E | 5/2006 | Kuelker |
| 7,491,426 | B1 | 2/2009 | Rooshenas |
| 7,615,254 | B2 | 11/2009 | Smith |
| 7,662,221 | B2 | 2/2010 | Fay |
| 7,670,415 | B1 | 3/2010 | Rosenberg et al. |
| 7,735,429 | B2 | 6/2010 | Meissen |
| 7,793,474 | B2 | 9/2010 | Tyler et al. |
| 7,825,171 | B2 | 11/2010 | Copeland |
| 7,841,147 | B2 | 11/2010 | Moran |
| D643,133 | S | 8/2011 | Steffes et al. |
| 7,997,039 | B2 | 8/2011 | Wolf et al. |
| 7,998,530 | B2 | 8/2011 | Baldorf |
| 8,042,309 | B2 | 10/2011 | Wolf et al. |
| 8,065,850 | B1 | 11/2011 | Moran |
| 8,112,966 | B2 | 2/2012 | Bowe et al. |
| 8,202,919 | B2 | 6/2012 | Copeland |
| D665,512 | S | 8/2012 | Yoder |
| D670,009 | S | 10/2012 | Buoni |
| D574,508 | S | 1/2013 | Yoder |
| D674,920 | S | 1/2013 | Buoni |
| 8,387,323 | B2 | 3/2013 | Mickelson |
| 8,513,328 | B2 | 8/2013 | Dorman |
| 8,524,822 | B2 | 9/2013 | Wiercinski |
| 8,557,909 | B2 | 10/2013 | Stuart et al. |
| 8,580,866 | B2 | 11/2013 | Nones et al. |
| 8,707,649 | B2 | 4/2014 | Wilkie |
| 8,748,528 | B2 | 6/2014 | Cao et al. |
| 8,782,988 | B2 | 7/2014 | Wolf |
| 8,806,826 | B2 | 8/2014 | Mann |
| D713,552 | S | 9/2014 | Steffes et al. |
| D713,974 | S | 9/2014 | Steffes et al. |
| 8,997,423 | B2 | 4/2015 | Mann |
| 9,027,302 | B2 | 5/2015 | Buoni et al. |
| D742,034 | S | 10/2015 | Steffes et al. |
| 9,169,652 | B2 * | 10/2015 | Steffes ..... E04F 13/0851 |
| 9,260,871 | B2 | 2/2016 | Shaw |
| 9,869,098 | B2 | 1/2018 | Steffes et al. |
| D809,671 | S | 2/2018 | Steffes et al. |
| 2004/0050003 | A1 | 3/2004 | Passeno |
| 2004/0065035 | A1 | 4/2004 | De Vlam |
| 2005/0102946 | A1 | 5/2005 | Stucky et al. |
| 2005/0247021 | A1 | 11/2005 | Schauffele |
| 2006/0075712 | A1 | 4/2006 | Gilbet et al. |
| 2007/0137127 | A1 | 7/2007 | Lincoln et al. |
| 2007/0294976 | A1 | 12/2007 | Fay |
| 2008/0083186 | A1 | 4/2008 | Gaudreau |
| 2008/0155921 | A1 | 7/2008 | Wolf et al. |
| 2008/0155922 | A1 | 7/2008 | Wolf et al. |
| 2009/0084058 | A1 | 4/2009 | Cahill et al. |
| 2009/0193742 | A1 | 8/2009 | Wolf et al. |
| 2009/0235596 | A1 | 9/2009 | Tyler et al. |
| 2009/0239413 | A1 | 9/2009 | Milette |
| 2009/0247007 | A1 | 10/2009 | Milette |
| 2009/0249718 | A1 | 10/2009 | Tyler et al. |
| 2011/0130062 | A1 | 6/2011 | Squires |
| 2011/0175255 | A1 | 7/2011 | Wernette et al. |
| 2011/0175256 | A1 | 7/2011 | Wernette et al. |
| 2011/0203218 | A1 | 8/2011 | Solov et al. |
| 2011/0239578 | A1 | 10/2011 | Wolf |
| 2012/0039977 | A1 | 2/2012 | Dracopoulos et al. |
| 2012/0186170 | A1 | 7/2012 | MacDonald et al. |
| 2012/0272598 | A1 | 11/2012 | Wilkie et al. |
| 2012/0328823 | A1 | 12/2012 | Monteer |
| 2013/0196070 | A1 | 8/2013 | LeFevre et al. |
| 2014/0041331 | A1 | 2/2014 | Buoni et al. |
| 2014/0109504 | A1 | 4/2014 | Steffes |
| 2014/0182225 | A1 | 7/2014 | Wilkie et al. |
| 2014/0196396 | A1 | 7/2014 | Watts et al. |
| 2014/0272404 | A1 | 9/2014 | Shake et al. |
| 2015/0021822 | A1 | 1/2015 | Wolf et al. |
| 2015/0191911 | A1 | 7/2015 | Mann |
| 2015/0218829 | A1 | 8/2015 | Curtis |
| 2016/0010342 | A1 | 1/2016 | Steffes et al. |
| 2016/0040437 | A1 | 2/2016 | Wolf et al. |

* cited by examiner

FRAME FOR A WALL PANEL, WALL PANEL, AND METHOD OF MANUFACTURE

CROSS-REFERENCE TO RELATED APPLICATIONS

This application claims the benefit of priority of U.S. Provisional Patent Application No. 62/650,383, filed Mar. 30, 2018, which is hereby incorporated by reference herein in its entirety.

BACKGROUND OF THE DISCLOSURE

1. Field of the Disclosure

The present disclosure relates generally to siding, for example, suitable for covering a wall surface. The present disclosure relates more particularly to a support frame for a wall panel.

2. Technical Background

There are many ways to cover the exterior façade or interior walls of building structures, such as houses. While wall coverings of natural products were often traditionally used, many modern structures are covered using a manufactured product that is polymer or ceramic based. These manufactured siding products can be made to replicate natural products (or other manufactured products, such as brick), while offering advantages over their natural counterparts. In particular, manufactured siding products can provide advantages in performance and cost in comparison with other methods of covering exterior walls. Further, manufactured siding products can be designed for ease of installation.

A wide variety of different manufactured siding products are available for covering walls. Often these products include an exterior face intended to be viewable and an attachment structure for securing the product to a wall substrate. In some cases, the siding products are made in a single piece where the same material forms both the visible exterior face and the attachment structure. In other cases, the structure that forms the visible face is of a different material than the attachment structure. For example, some products include a frame that extends about the perimeter of the structure forming the visible face and holds the visible face against the substrate wall.

The present inventors have recognized that the frames used in such siding products are often manufactured using an excess of material. In particular, the inventors have unexpectedly determined that portions of the frame that greatly add to the material needed for manufacturing are unnecessary or add little to the function of the frame.

SUMMARY OF THE DISCLOSURE

In one aspect, the present disclosure provides a frame for a wall panel, the frame comprising:

- a support strip extending in a lateral direction, the support strip including a first end and a second end; and
- a row of columns extending in a first direction from the support strip, each column including a proximal end attached to the support strip and a free distal end, the row of columns including:
  - a first column disposed at a first end of the row of columns and laterally offset from the first end of the support strip, and
  - a second column disposed at a second end of the row of columns and laterally offset from the second end of the support strip.

In another aspect, the disclosure provides a wall panel comprising:

- a panel body; and
- a frame partially embedded in the panel body, the frame comprising:
  - a support strip extending in a lateral direction, the support strip including a first end and a second end; and
  - a row of columns extending in a first direction from the support strip, each column including a proximal end attached to the support strip and a free distal end, the row of columns including:
    - a first column disposed at a first end of the row of columns and laterally offset from the first end of the support strip, and
    - a second column disposed at a second end of the row of columns and laterally offset from the second end of the support strip.

In another aspect, the disclosure provides a method of manufacturing a frame for a wall panel, the method comprising:

- positioning a first section of a metal sheet in a stamping press;
- conducting a first stamping operation using the stamping press to form a first frame segment in the first section of the metal sheet, the first frame segment including a portion of a support strip and a column extending from the support strip;
- pitching the metal sheet forward so as to position a second section of the metal sheet in the stamping press;
- conducting a second stamping operation using the stamping press to form a second frame segment in the second section of the metal sheet, the second frame segment including another portion of the support strip and another column extending from the support strip, wherein the second frame segment is adjacent to the first frame segment so as to form a line of columns extending from the support strip; and
- cutting the frame segments from the metal sheet so as to form a frame according to the disclosure.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have recognized that frames used in certain siding products use are manufactured using an excess of material. Therefore, the present inventors have developed a frame that is produced from significantly less material without sacrificing performance.

Accordingly, one aspect of the disclosure is a frame for a wall panel. The frame comprises: a support strip extending in a lateral direction, the support strip including a first end and a second end; and a row of columns extending in a first direction from the support strip, each column including a proximal end attached to the support strip and a free distal end, the row of columns including: a first column disposed at a first end of the row of columns and laterally offset from the first end of the support strip, and a second column disposed at a second end of the row of columns and laterally offset from the second end of the support strip.

Figure 1:
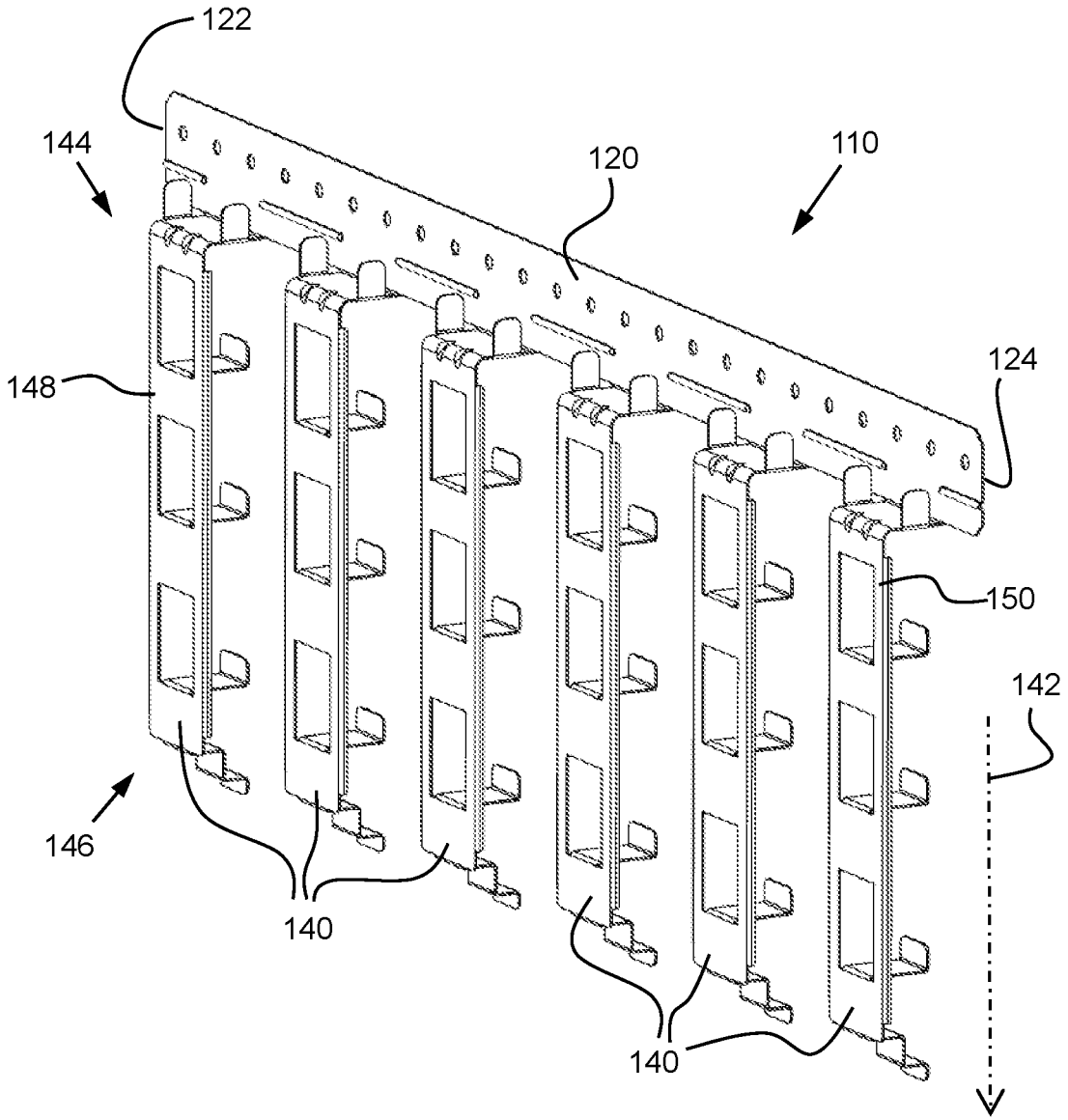
FIG. 1 is a schematic perspective view of a frame in accordance with an embodiment of the disclosure.

Such a frame is shown in perspective view in FIG. 1. Frame 110 includes a support strip 120 and a plurality of columns 140 extending in a first direction 142 from support strip 120. Frame 110 is configured for use with a wall panel where support strip 120 is positioned to extend horizontally and columns 140 extend vertically. In other embodiments, the directions of extension of the support strip and columns differ. In some embodiments, the support strips and columns are not perpendicular. For example, in one embodiment the support strip is configured to be attached to a wall substrate at an angle to horizontal in order to match the top of a gable adjacent to the roof. Vertical columns extending from such a support strip are at a non-perpendicular angle to the support strip.

Each of columns 140 is attached to the support strip at an upper end 144 that is proximal to support strip 120. In contrast, the distal lower end 146 of each column is free. Thus, each of the columns has a cantilevered attachment to the support strip, where the free end is left unsupported. The term free, as used herein, refers to the lack of any connection or cross support of the lower half of each column. Thus, frame 110 does not include a lower horizontally extending support structure providing structural support to any of the columns 140. It should be understood that reference to the lower end of the columns being free is relative only to the frame itself, and that the columns may be secured with respect to one another by another structure, for example by virtue of being attached to a substrate or partially embedded in a panel body.

Support strip 120 provides a structural connection for columns 140 and is also configured for attaching the frame to a substrate, as explained in more detail below. Columns 140 are provided in a row that extends across a portion of support strip 120 with the ends of the support strip 120 extending further laterally than the respective column at the end of the row. Thus, column 148 at one end of the row of columns is inwardly laterally offset from the first end 122 of support strip 120, and column 150 at the other end of the row is inwardly laterally offset from the second end 124 of support strip 120.

Embodiments of the frame include a variety of different sizes. The size can vary depending upon the application, as will be understood by those of ordinary skill in the art. In certain embodiments as otherwise described herein, the width of the frame is in a range of 6 to 55 inches, e.g., 8 to 48 inches, e.g., about 10 inches, e.g., about 13 inches, e.g., about 23 inches, e.g., about 46 inches. The width of the frame is dependent upon the width of the columns, the space between the columns, and the number of columns. Thus, in certain systems of wall panels, frames having the same column width and column spacing have different sizes based on the number of columns used in the frame. In certain embodiments as otherwise described herein, a height of each column is in a range from 4 to 14 inches, e.g., from 5 to 12 inches, e.g., from 6 to 9 inches.

In certain embodiments as otherwise described herein, the frame is formed of a cut and shaped metal sheet. Thus, as explained in more detail below, embodiments of the frame can be produced by metal stamping, where a metal stamping press shapes the frame from a metal sheet and cuts the metal sheet to form the edges of the frame. The term metal sheet, as used herein, is not limited to any particular thickness and may include materials conventionally referred to as metal foil, sheet metal, metal plate or metal strips.

Figure 2:
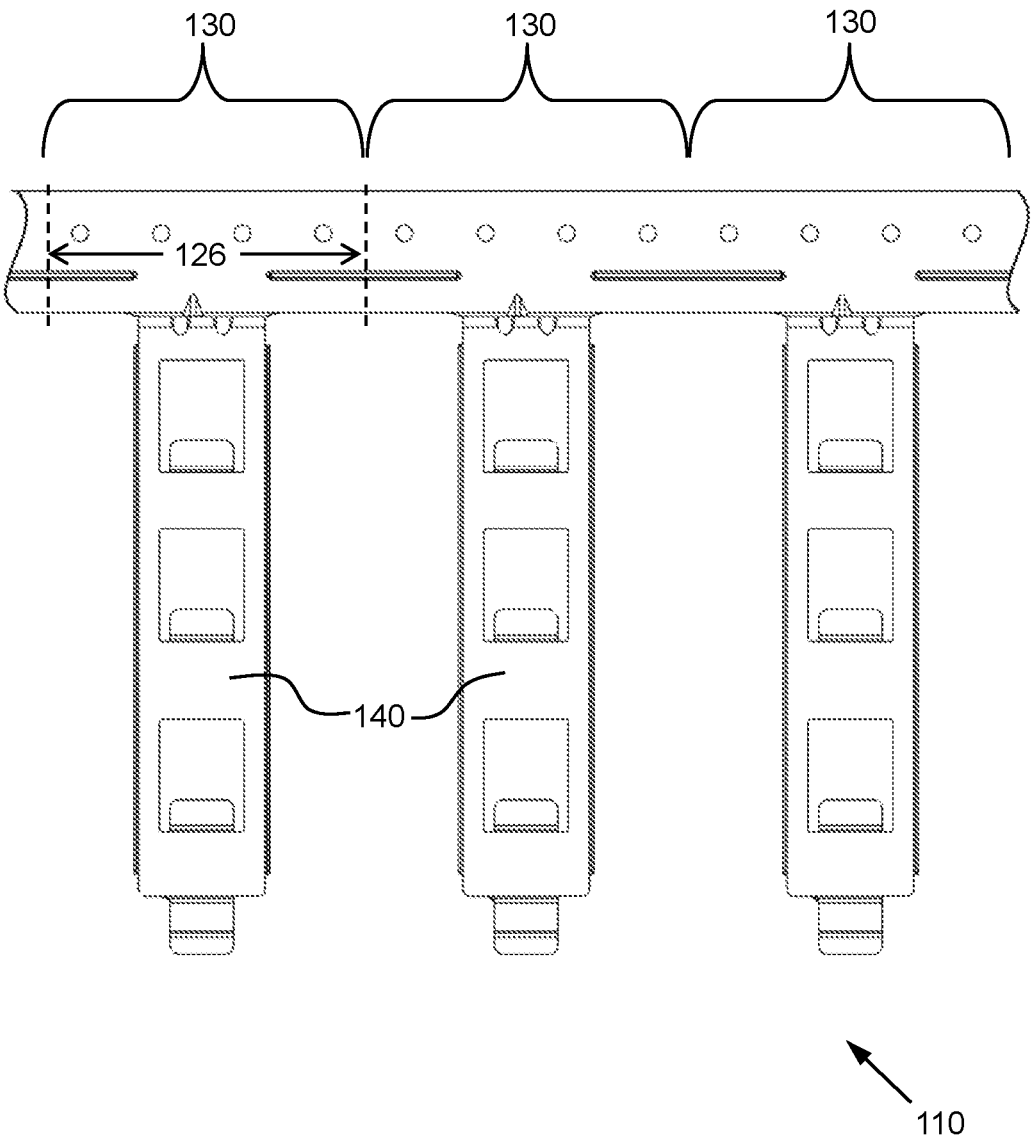
FIG. 2 is a schematic back view of a section of the frame of FIG. 1.

In certain embodiments as otherwise described herein, the frame consists of a plurality of identical segments in a line, each of the segments including one of the columns and a portion of the support strip. For example, frame 110 includes six identical segments 130 without any additional perimeter structure or variation from one segment to the next. This repeating pattern allows for efficient manufacture of the frame using a small machine, as explained in more detail below. A detailed view of three of the segments of frame 110 is shown in FIG. 2.

In certain embodiments as otherwise described herein, each of the segments includes a single column. Further, in some embodiments, each column is disposed at the lateral center of the respective segment. For example, segments 130 of frame 110 each include a single column 140 and a section 126 of support strip 120. Each column 140 is centered on the corresponding segment 130, such that a portion of support strip 120 extends past the column 140 within segment 130. This extension beyond the column defines the spacing of the columns within frame 110 and also produces the corresponding offset at end columns 148 and 150 (FIG. 1). With this configuration, the segments are in the form of a T-shape. In other embodiments, each segment has more than one column.

In certain embodiments as otherwise described herein, the width of each segment is in a range from 3 to 6 inches, e.g., from 3.5 to 5 inches. The width of the segment can, of course, depend on the number of columns in the particular segment. Thus, in some embodiments a segment with two columns of a particular size may be larger than a segment with only one column of the same size. For example, in some embodiments, each segment has two columns and a width in a range of 6 to 12 inches, e.g., 7 to 10 inches.

Figure 3:
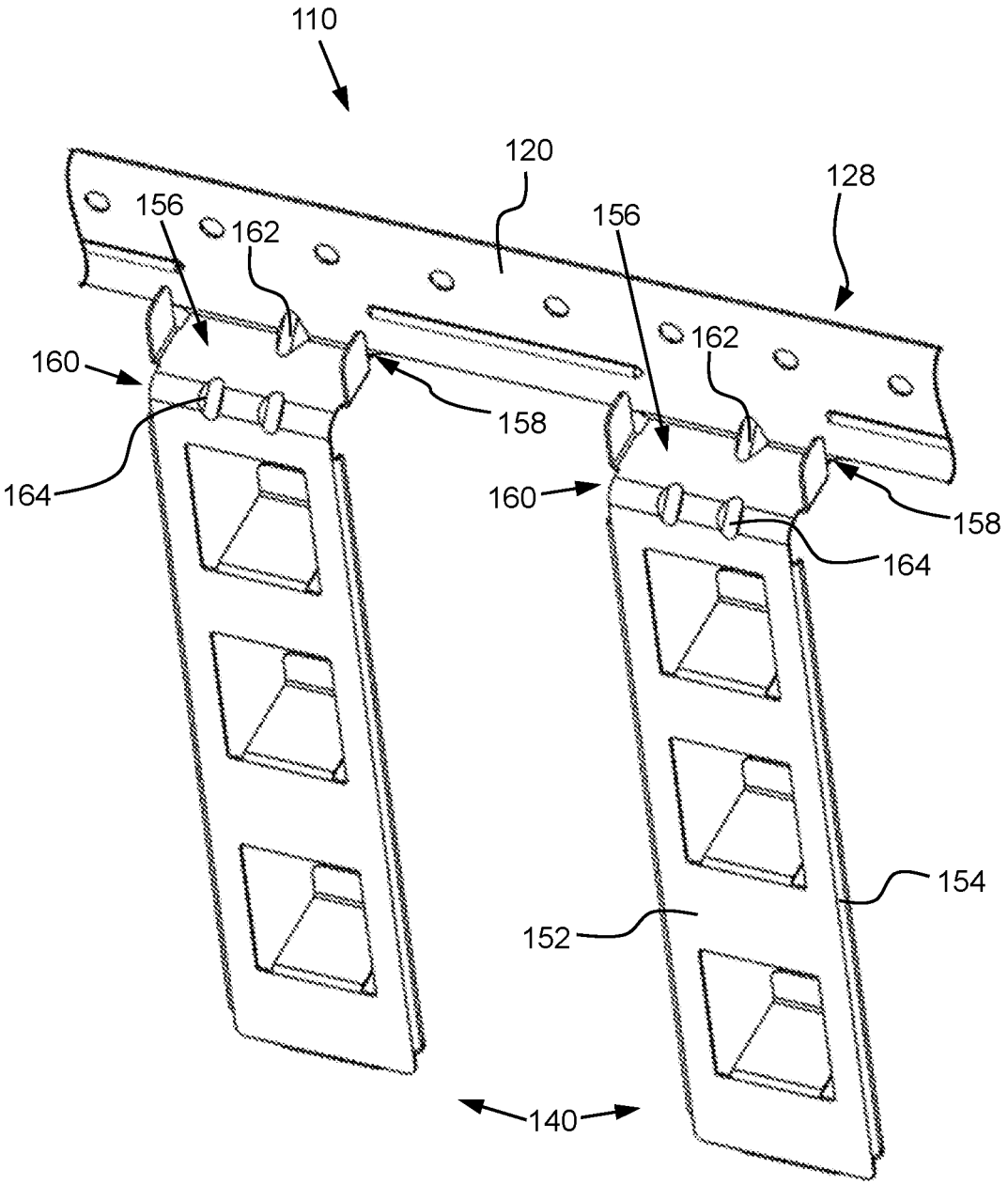
FIG. 3 is a schematic top perspective view of a section of the frame of FIG. 1.

In certain embodiments as otherwise described herein, the support strip includes a contact surface that defines a first plane. For example, as illustrated in the detailed top perspective view of FIG. 3, the rear surface 128 of support strip 120 forms a contact surface for mounting the frame against a substrate wall. Contact surface 128 is substantially flat in order to match the contour of a wall, and thus surface 128 defines a plane that might coextend with the outer surface of a corresponding wall.

In certain embodiments as otherwise described herein, each column includes a column body extending away from the support strip. Further, in some embodiments, each column body lies in a second plane that is parallel to the first plane. For example, columns 140 each include a generally flat column body 152 extending downward and away from support strip 120. The flat surface of column bodies 152 lie in a plane that is parallel to but offset from the plane defined by contact surface 128. Indeed, because the column bodies are flat, they define the plane that is parallel and offset from the plane of the contact surface.

Embodiments of the frame include various features to improve the structural integrity of the components of the frame. As will be understood by a person of ordinary skill in the art, a variety of combinations of these features can be used to improve the stiffness of the parts of the frame. In certain embodiments as otherwise described herein, the lateral sides of each column body include stiffening side bends. For example, column bodies 152 include stiffening side bends 154 that run along the length of the body 152. The stiffening side bends 154 are included on each side of column bodies 152. In other embodiments, a side bend is included on only one side of the column body. The side bends can be effective in adding stiffness to the column bodies with only a limited depth. In some embodiments, the side bends extend no more than % inch from the plane defined by the column body.

In certain embodiments as otherwise described herein, each column includes a connecting flange that couples the column body to the support strip, and the connecting flange extends in a direction that is at an angle to the first plane. For example, each of columns 140 includes connecting flange 156 that connects column body 152 to the support strip 120. In frame 110, connecting flange 156 is disposed perpendicular to the plane defined by contact surface 128. Likewise, connecting flange 156 is also perpendicular to the plane of column bodies 156. In other embodiments, the connecting flange is disposed at an angle that is shallower than perpendicular to the support strip.

Embodiments of the connecting flange are configured to rigidly hold the column body to the support strip without an excess amount of material. In certain embodiments as otherwise described herein, the connecting flange includes a proximal bend adjacent to the support strip, and a stiffening gusset is disposed in the proximal bend. Likewise, in certain embodiments, the connecting flange includes a distal bend adjacent to the respective column body, and a stiffening gusset is disposed in the distal bend. For example, connecting flange 156 of column 140 of frame 100 is coupled to support strip 120 by a bend 158 at the proximal end of the connecting flange. Likewise, connecting flange 156 is coupled to column body 152 by a bend 160 at the distal end of the connecting flange. The bends at the proximal and distal ends of connecting flange provide a simple connection between support strip 120, connecting flange 156, and column body 152 and allow the component to be fabricated from a single metal sheet. However, in some embodiments, as in frame 110, the bends do not rigidly hold the column body to the support strip. Accordingly, proximal bend 158 includes a gusset 162 between connecting flange 156 and support strip 120, and distal bend 160 includes two gussets 164 between column body 152 and connecting flange 156. In other embodiments, the number and position of the gussets in each of the bends may differ, as will be appreciated by those of ordinary skill in the art.

Figure 4:
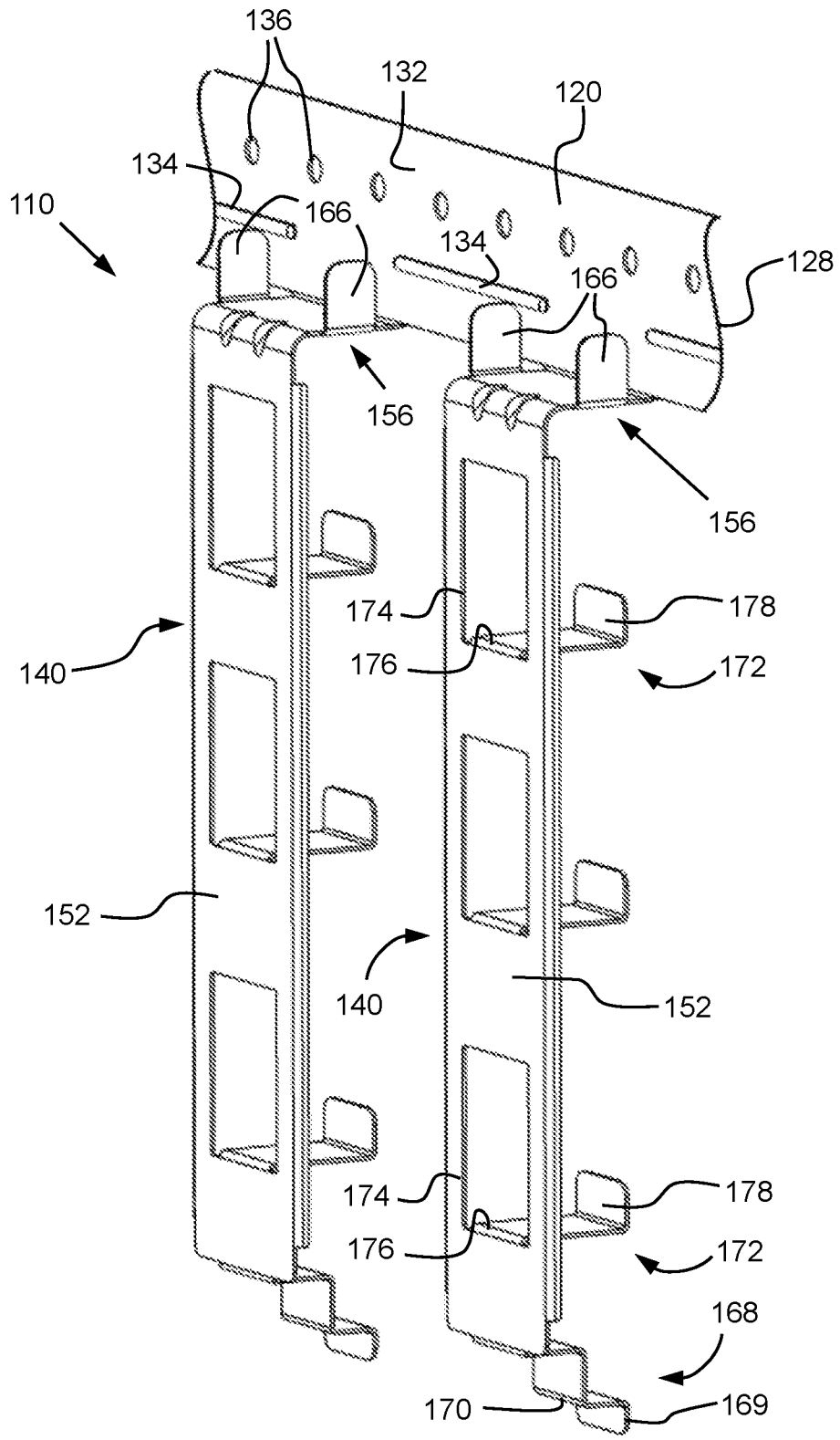
FIG. 4 is a schematic side perspective view of a section of the frame of FIG. 1.

In certain embodiments as otherwise described herein, the connecting flange includes at least one locating tab that extends toward the support strip. Such a locating tab may be configured to position the frame into a mold when a panel body is molded onto the frame. For example, the detailed perspective view of a portion of frame 110 in FIG. 4 shows locating tabs 166 extending upward from each side of connecting flange 156. Locating tabs 166 extend in a direction opposite to the direction of extension of the columns 140, which places the column bodies 152 further toward the vertical center of a corresponding panel body when it is molded onto the frame. Further, the locating tabs 166 provide consistency in the placement of frame 110 within the mold so that each frame is. Accordingly, locating tabs 166 add stability to the panel as a whole and also provide consistency of the dimensions of two panels made with the same frame and in the same mold.

In certain embodiments as otherwise described herein, the locating tab is attached to a side of the connecting flange by a bend. For example, locating tabs 166 are formed from the same metal sheet as the rest of frame 110 and are bent upward from the adjacent connecting flange. As a result, locating tabs 166 lie in a plane that is perpendicular to both column body 152 and connecting flange 156.

While frame 110 shows column bodies 152 being attached to the support strip by connecting flange 156, in some embodiments the frame does not include a connecting flange. For example, in some embodiments, the column bodies are attached to the support strip directly. In certain embodiments as otherwise described herein, the support strip has a section that bends away from the contact surface and the columns are attached to this bent section. Accordingly, the columns can be offset from the support strip and lie in the second plane without the columns including a connecting flange. For example, in certain embodiments the support strip includes a cross bar disposed in a second plane, and each column is connected to the cross bar.

Figure 5:
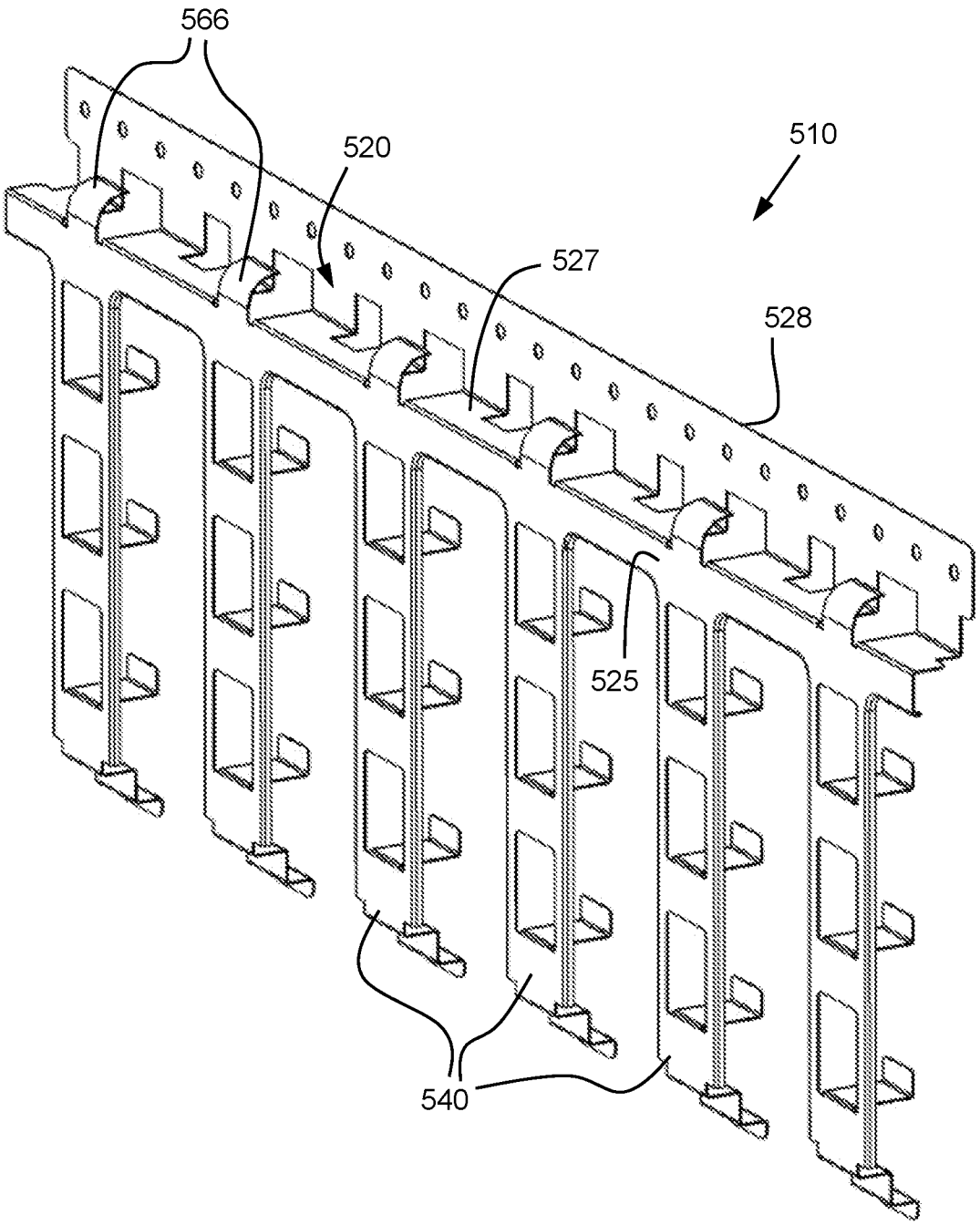
FIG. 5 is a schematic perspective view of a frame in accordance with another embodiment of the disclosure.

An example of such a frame is shown in FIG. 5. Frame 510 includes a support strip 520 that has a contact surface 528 defining a first plane and a cross bar 525 defining a second plane that is offset from the first plane. The cross bar 525 is connected to the contact surface 528 by a lateral section 527 of support strip 520. Columns 540 extend down from cross bar 525 of support strip 520 at regular intervals. Locating tabs 566 extend up from cross bar 525. In certain embodiments, the locating tabs extending from the cross bar are used to position the frame within a mold at the upper end of the mold. Accordingly, the locating tabs define the position of the upper edge of the panel body in such embodiments when the panel body is formed in a mold.

In certain embodiments as otherwise described herein, each column includes a positioning brace disposed at a distal end thereof. The positioning brace is configured to support the frame against a substrate wall and thereby allow portions of the frame to project away from the substrate wall. For example, each of the columns 140 in frame 110, shown in FIGS. 1-4 includes a positioning brace 168 disposed at the lower distal end of the column 140. Positioning brace 168 provides support for frame 110, so that sections of the frame, such as column bodies 152 can be offset from the substrate wall.

In certain embodiments as otherwise described herein, the support strip includes a contact surface that defines a first plane, and each positioning brace includes a foot that lies on the first plane. For example, the rear surface of support strip 120 includes contact surface 128, as described in further detail above, which is configured to support the frame against the substrate wall when the frame is attached thereto. The contact surface 128 is configured to lie against the substrate wall and thereby defines a first plane where such a wall lies. Similarly, positioning brace 168 includes foot 169, which lies on the first plane in order to also support the frame against the substrate wall. Specifically, foot 169 includes a flat contact surface that lies on the first plane.

In certain embodiments as otherwise described herein, each column includes a column body that lies in a second plane that is parallel to the first plane, and each positioning brace extends from a corresponding column body to the first plane. For example, as explained above, column bodies 152 are flat and lie in a second plane that is parallel to the first plane and offset therefrom. As a result, the column bodies 152 form a planar surface that is projected out from the first plane and any substrate wall on which the frame is supported. To provide the supporting characteristic of positioning brace 168, it extends from the respective column body 152 back toward the first plane where foot 169 is located.

In certain embodiments as otherwise described herein, the positioning brace includes a locating shelf. The locating shelf is configured to orient the frame in a proper location when the frame is set in a mold for molding a panel body thereon. Thus, the locating shelf serves a similar function to the above-described locating tabs. In certain embodiments, the locating shelf is disposed between the foot of the positioning brace and the column body. For example, positioning brace 168 of each column includes locating shelf 170 disposed between foot 169 and column body 152 of the respective column. Accordingly, locating shelf 170 lies between the first and second planes and provides positioning of the frame toward the top of the corresponding mold when the panel body is molded to the frame, as described in more detail below. Like the other components of frame 110, positioning brace is formed of bent metal sheet and is connected to column body 152 by a bend.

In certain embodiments as otherwise described herein, each column includes at least one stand-off leg disposed between the proximal and distal end thereof. Similar to the positioning brace, the standoff leg is configured to support the frame against a substrate wall allowing portions of the frame to project away from the substrate wall. For example, each column 140 of frame 110 includes three standoff legs 172. In some embodiments, the frame includes up to four standoff legs, or more. As explained in more detail below, the combination of connecting flange 156, positioning brace 168, and standoff legs 172 provide a rain screen for the assembled siding panel. While in frame 110 the columns all include the same number of standoff legs 172, in other embodiments different columns within the frame include different numbers of standoff legs. For example, in some embodiments, the end columns at the end of the row include three standoff legs, while the columns in the middle of the row include two.

In certain embodiments as otherwise described herein, each column includes an aperture corresponding to each respective stand-off leg. The aperture in the column body provides a strong connection between the frame and any panel body attached thereto. For example, a mold material of the panel body may pass through the aperture thereby locking the column in place once the material hardens. The aperture in the column also provides material for the standoff leg. Specifically, the standoff leg can be formed from material bent from the column, rather than adding a component to the column. For example, each of standoff legs 172 corresponds to an associated aperture 174. Three sides of the aperture are cut from the column body 152 and the standoff legs are bent backward from the aperture. In other embodiments, the standoff legs are separate components that are attached to the respective columns.

In certain embodiments, one or more of the columns include an aperture that is not associated with a standoff leg. For example, in some embodiments, each column includes one to four apertures, a portion of which are associated with a corresponding standoff leg. In certain embodiments, the column includes fingers similar to the standoff legs that extend outward from the column body to a lesser extent than the standoff legs. In some embodiments, the fingers are configured to be entirely embedded within the panel body. The fingers may enhance the connection between the frame and the panel body.

In certain embodiments as otherwise described herein, each stand-off leg extends from a lower or upper edge of the corresponding aperture. Such a configuration allows the standoff leg to be bent from the column without the depth of the standoff leg and the width of the column being dependent upon one another. In contrast, in embodiments where the standoff legs are bent from a side edge of the apertures, the width of the columns is closely associated with the depth of the standoff legs, such that a wider column is needed for a longer standoff leg. With the standoff legs extending from the upper or lower edges of the aperture, the columns may be thinner allowing for adequate room between two columns for manufacturing a corresponding part, as explained in more detail below. For example, standoff legs 172 are bent from the lower edge 176 of aperture 174. Accordingly, standoff legs 172 are of sufficient depth to reach the plane of the contact surface 128 of support strip 120, and the distance between the columns 140 is wider than the width of each column.

In certain embodiments as otherwise described herein, the support strip includes a contact surface that defines a first plane, and each stand-off leg includes a foot that lies in the first plane. For example, the rear surface of support strip 120 includes contact surface 128 that supports the frame against a substrate wall, as described above. The contact surface defines a first plane and standoff legs 172 each include a foot 178 that lies on the first plane in order to also support the frame against the substrate wall. Specifically, foot 178 includes a flat contact surface that lies on the first plane.

In certain embodiments as otherwise described herein, each column includes a column body that lies in a second plane that is parallel to the first plane, and each stand-off leg extends from a corresponding column body to the first plane. For example, like positioning brace 168, standoff legs 172 extend from the column body 152 at the second plane back toward the first plane where foot 178 lies.

In certain embodiments as otherwise described herein, the support strip includes a fastening band configured to attach the frame to a substrate. The fastening band, which may be configured as a nailing strip or fastening hem, as will be appreciated by those of ordinary skill in the art, is configured to attach the frame to the substrate wall. In some embodiments, the fastening band includes openings for receiving a mechanical fastening element, such as a screw or nail. For example, support strip 120 includes fastening strip 132 at the upper end of frame 110. The fastening strip 132 includes a row of openings 136 for receiving mechanical fasteners. In some embodiments the fastening strip is integrally formed with the rest of the frame. For example, in some embodiments the fastening strip is part of a metal sheet that forms other components of the frame. In other embodiments, the fastening strip is attached at the upper end of the support strip. In such embodiments the fastening strip can be made of a different material than the other parts of the frame.

In certain embodiments as otherwise described herein, the support strip includes at least one stiffening rib. For example, support strip 120 includes a series of stiffening ribs 134 running across the width of the strip. In other embodiments, the support strip includes a single stiffening rib that runs across the width of the frame.

In certain embodiments as otherwise described herein, the frame includes indicia configured to assist in positioning the frame. For example, in some embodiments the support strip includes indicia to assist with installation or lateral spacing between frames in adjacent rows. In some embodiments, the indicia are correlated to the fastener openings. In some embodiments, the indicia are in the form of a ruler. For example, the indicia may be in the form of a ruler along a top edge of the support strip.

In certain embodiments as otherwise described herein, the frame includes at least two columns, e.g., at least 3 columns, e.g., 6 columns. For example, frame 110 includes 6 columns. Other arrangements are also possible.

Figure 6:
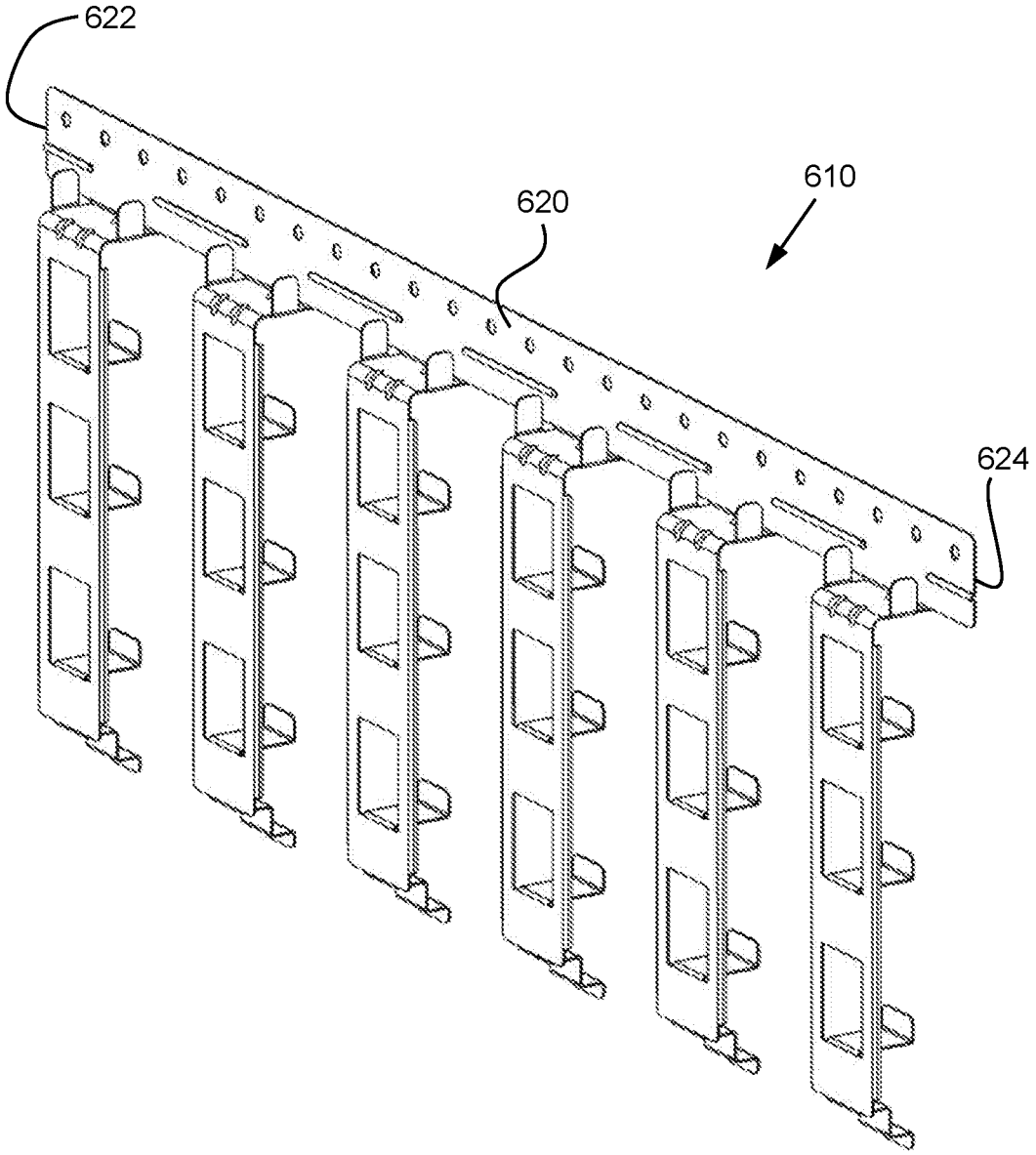
FIG. 6 is a schematic perspective view of a frame in accordance with another embodiment of the disclosure.
Figure 7:
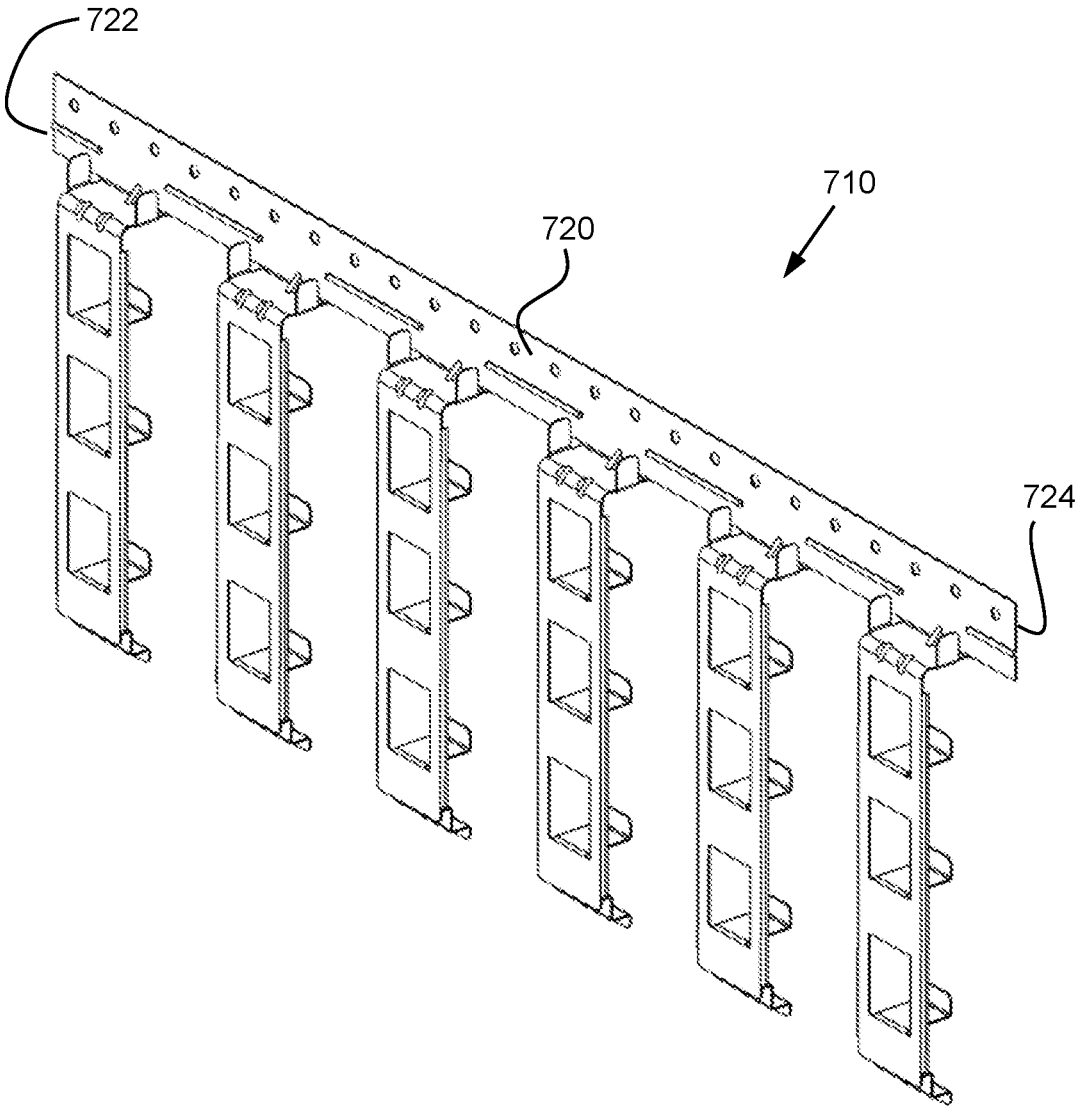
FIG. 7 is a schematic perspective view of a frame in accordance with another embodiment of the disclosure.

In certain embodiments the ends of the support strip include chamfered corners. For example, the ends 122, 124 of support strip 120 of frame 110 include upper and lower chamfered corners. In other embodiments, the ends of the support strip of the frame include other configurations. For example, in some embodiments, the ends have rounded corners. Such an embodiment is shown in FIG. 6. In particular, frame 610 includes a support strip 620 that includes ends 622, 624 with rounded corners. In other embodiments, the ends of the support strip are cut straight. For example, frame 710, shown in FIG. 7 includes a support strip 720 with ends 722, 724 that are cut straight and have sharp corners. Still, in other embodiments the shape of the support strip may have other configurations.

Figure 8:
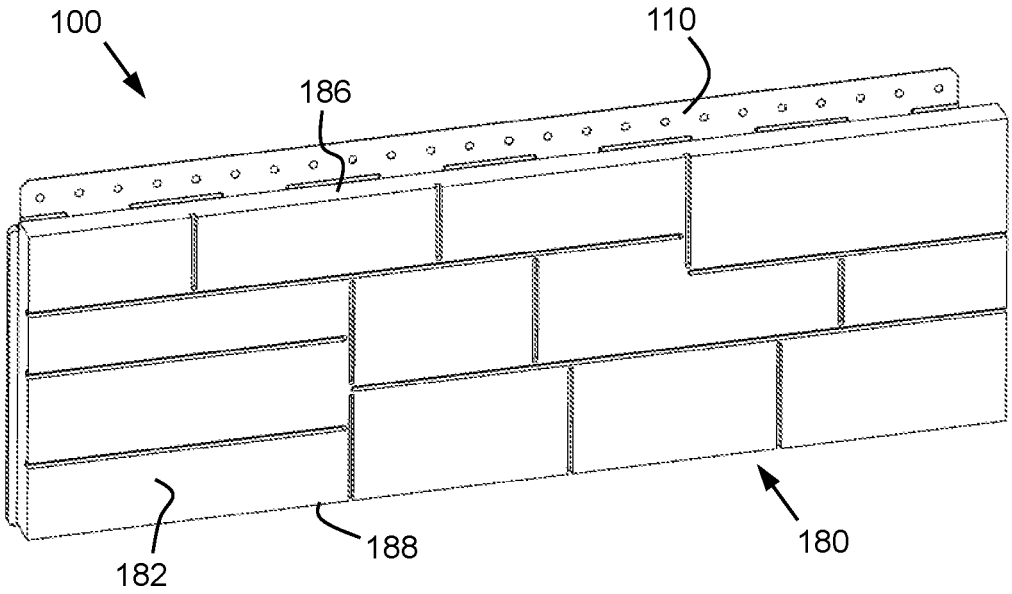
FIG. 8 is a schematic perspective view of a wall panel in accordance with an embodiment of the disclosure.
Figure 9:
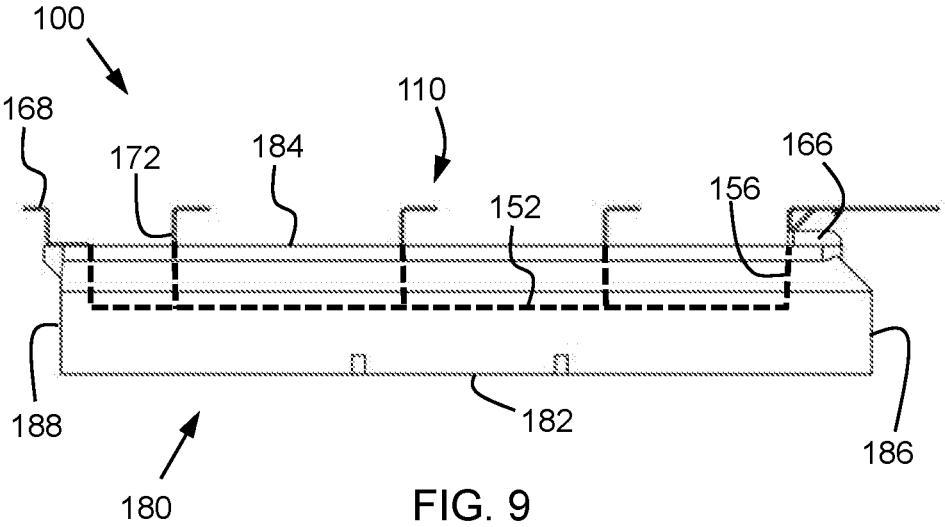
FIG. 9 is a schematic side view of the wall panel of FIG. 8 rotated onto its front face.
Figure 10:
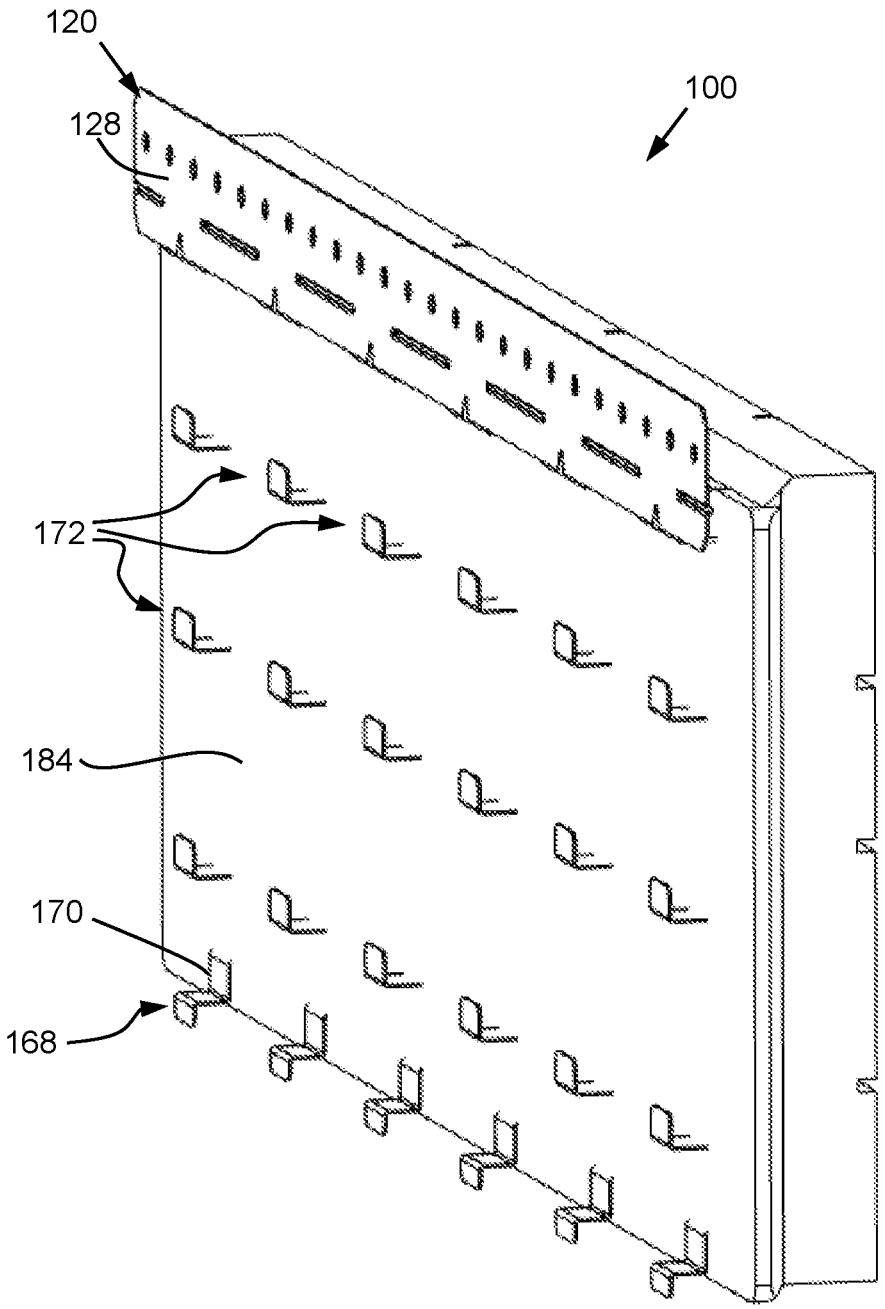
FIG. 10 is a schematic perspective rear view of the wall panel of FIG. 8.

Another aspect of the disclosure provides a wall panel comprising: a panel body; and a frame partially embedded in the panel body. The frame comprises a support strip extending in a lateral direction and a row of columns extending in a first direction from the support strip. The support strip includes a first end and a second end. Each column includes a proximal end attached to the support strip and a free distal end. The row of columns includes a first column disposed at a first end of the row of columns and laterally offset from the first end of the support strip and a second column disposed at a second end of the row of columns and laterally offset from the second end of the support strip. Such a wall panel is shown in FIGS. 8 to 10. Wall panel 100 includes a panel body 180 and frame 110 partially embedded in the panel body 180. The panel body 180 includes a front face 182, a rear face 184 (see FIGS. 9 and 10), a top surface 186 and a bottom surface 188.

In certain embodiments as otherwise described herein, portions of the frame protrude from a rear face of the panel body, and a front face of the panel body has a textured surface. In some embodiments, the textured surface replicates a masonry wall. For example, panel body 180 includes a front face 182 with a textured surface that replicates a stone wall. In other embodiments, the textured surface of the front face replicates other masonry walls, such as a brick wall. Still in other embodiments the front face replicates other natural siding products, such as wood.

In certain embodiments as otherwise described herein, each column includes an embedded portion disposed in the panel body. In certain embodiments as otherwise described herein, each column includes a column body extending away from the support strip and embedded in the panel body. For example, column bodies 152 of frame 110 are embedded in panel body 180 of wall panel 100. The embedded column bodies 152 are schematically depicted in FIG. 9.

As set forth above, only a portion of the frame of the wall panel is embedded in the panel body. In embodiments of the wall panel various portions of the frame are external to the wall panel body. In certain embodiments as otherwise described herein, each column includes a connecting flange that couples the column body to the support strip, wherein the connecting flange protrudes out of the panel body. For example, support strip 120 of frame 110 is coupled to the column bodies 152 by connecting flange 156. While column bodies 152 are embedded within panel body 180, the connecting flange 156 is partially embedded in body 180 but also protrudes outward from rear face 184.

In certain embodiments as otherwise described herein, the connecting flange includes at least one locating tab that defines an upper edge of the panel body. For example, connecting flange 156 includes locating tabs 166 disposed at the upper end of frame 110. In certain embodiments, the locating tabs on the connecting flange are used to position the frame within a mold at the upper end of the mold. Accordingly, the locating tabs define the position of the upper edge of the panel body in such embodiments when the panel body is formed in a mold.

In certain embodiments as otherwise described herein, each column includes a positioning brace disposed at a distal end thereof, and wherein each positioning brace protrudes from the panel body. In certain embodiments as otherwise described herein, each positioning brace includes a locating shelf that defines a lower edge of the panel body. For example, wall panel 100 includes positioning brace 168 that protrudes out from the panel body 180 in order to engage a substrate wall. Positioning brace 168 has a locating shelf 170 between the column body 152 and the foot 169 of brace 168. In certain embodiments, the locating shelf is used to position the frame within a mold at the lower end of the mold. Accordingly, the locating shelf defines the position of the lower edge of the panel body in such embodiments when the panel body is formed in a mold.

In certain embodiments as otherwise described herein, each column includes at least one stand-off leg disposed between the proximal and distal end thereof, and wherein each stand-off leg protrudes from the panel body. For example, each column of wall panel 100 includes three standoff legs 172 that extend rearward form the column body and protrude from rear face 184 of body 180.

In certain embodiments as otherwise described herein, protruding components of the frame, such as the support strip, standoff legs, and positioning brace; extend back from the rear face of the panel body. As a result, these components can hold the wall panel at a distance from the substrate wall. This configuration provides a rain screen, which allows any water that migrates behind the wall panel to flow downward on the outside of the substrate wall, preventing damage to the substrate wall and the wall panels.

In certain embodiments as otherwise described herein, the support strip is external to the panel body. The external support strip is configured to support the wall panel directly against a substrate wall. For example, support strip 120 is external to panel body 180 and is configured for direct attachment to a substrate wall. In some embodiments, a portion of the panel body may extend around the support strip. For example, in some embodiments a thin coating of the panel body covers the support strip.

Figure 11:
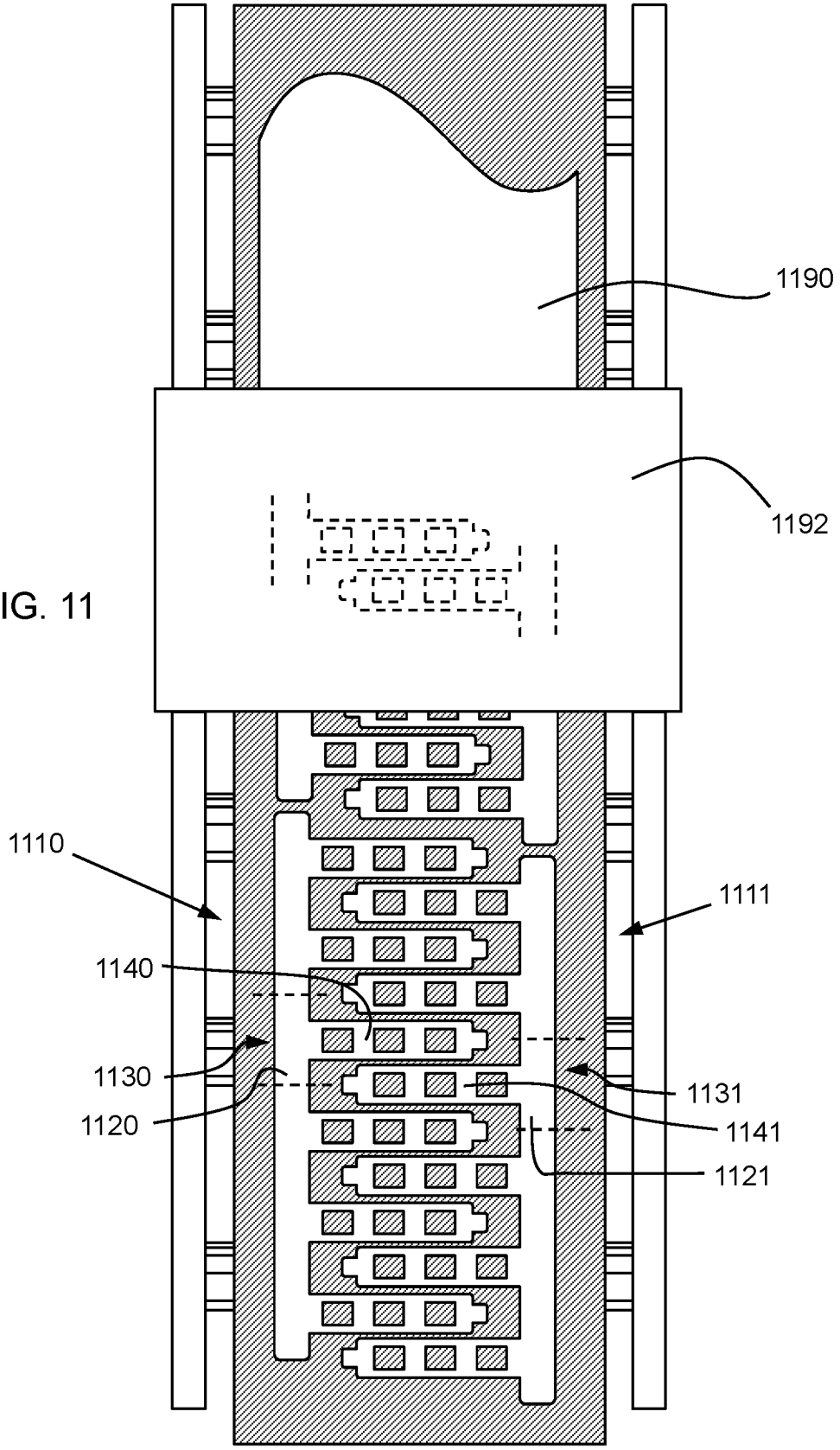
FIG. 11 is a schematic top view of a fabrication method according to an embodiment of the disclosure.

Another aspect of the disclosure provides a method of manufacturing a frame for a wall panel, the method comprising: positioning a first section of a metal sheet in a stamping press; conducting a first stamping operation using the stamping press to form a first frame segment in the first section of the metal sheet, the first frame segment including a portion of a support strip and a column extending from the support strip; pitching the metal sheet forward so as to position a second section of the metal sheet in the stamping press; conducting a second stamping operation using the stamping press to form a second frame segment in the second section of the metal sheet, the second frame segment including another portion of the support strip and another column extending from the support strip, wherein the second frame segment is adjacent to the first frame segment so as to form a line of columns extending from the support strip; and cutting the frame segments from the metal sheet so as to form a frame according to the disclosure. Such a method is depicted in FIG. 11. A metal sheet 1190 is fed into a stamping press 1192 so that a first section of the metal sheet is positioned inside the stamping press. Press 1192 then performs a first stamping operation to form a single frame segment in the first section of the metal sheet. Stamping press 1192 produces a frame segment with a portion of a support strip 1120 and a single column 1140. A second section of metal sheet 1190 is fed into stamping press 1192 and a second frame segment is formed in the metal sheet.

After six adjacent segments have been formed in the metal sheet, the segments are cut from the sheet to form frame 1110. In other embodiments, the frame is cut from the metal sheet after only two or three frame segments have been formed, or after twelve segments have been formed. Still, in other embodiments, the frame is cut after another number of frame segments have been formed.

As explained above, the term metal sheet is not limited to any particular thickness or gauge. Further, the term stamping, as used herein, includes a variety of sheet-metal forming manufacturing processes, such as punching using a machine press or stamping press, blanking, embossing, bending, flanging, and coining.

In certain embodiments as otherwise described herein, the stamped first frame segment is identical to the stamped second frame segment. For example, stamping press 1192 uses the same operation to form each segment 1130 of the frame such that all of the frame segments within frame 1110 are identical. In other embodiments, the first and second frame segments are not identical.

In certain embodiments as otherwise described herein, the method includes conducting at least one additional stamping operation to form another frame segment in the metal sheet before cutting the frame segments from the metal sheet. For example, as set forth above, stamping press 1192 includes four additional stamping operations before frame 1110 is cut from metal sheet 1190, such that frame 1110 includes a total of six frame segments.

In certain embodiments as otherwise described herein, conducting the first stamping operation includes forming an opposing first frame segment in the first section of the metal sheet and conducting the second stamping operation includes forming an opposing second frame segment in the second section of the metal sheet. Further, the opposing frame segments include opposing columns extending from an opposing support strip. For example, stamping press 1192 includes stamping machinery to form a pair of frame segments simultaneously, as schematically depicted by dashed lines in FIG. 11. The opposing frame segment 1131 is identical to frame segment 1130 and includes an opposing column 1141 and portion of opposing support strip 1121. In some embodiments, the frame and opposing frame are identical. For example, frame 1110 is identical to opposing frame 1111.

In certain embodiments as otherwise described herein, at least one of the opposing columns is interposed between a pair of the columns in the line of columns. For example, opposing column 1141 is interposed between two columns of frame 1110. In certain embodiments where the frames include several columns, the columns are interleaved as they are produced by the stamping press. The construction of each column having a free lower end and the frame not including a perimeter structure allows the columns to be interposed to one another as they are manufactured by the stamping press. This construction allows the frames to be manufactured using substantially less material.

In certain embodiments as otherwise described herein, the method includes cutting the opposing frame segments from the metal sheet so as to form an opposing frame according to the frame of the disclosure. For example, the method depicted in FIG. 11 shows opposing frame 1111 also being cut from the metal sheet 1190.

In certain embodiments as otherwise described herein, the method includes conducting at least one additional stamping operation between cutting the frame segments and cutting the opposing frame segments, such that the frame and the opposing frame include a different number of columns. For example, in some embodiments, the method includes cutting the stamped frame segments from the metal sheet every 6 cycles, and cutting the opposing frame segments from the metal sheet every 2 cycles. This method produces frames that have 6 columns and opposing frames that have 2 columns. It also results in fewer frames being produced than opposing frames.

In certain embodiments as otherwise described herein, each of the frame segments includes a single column. For example, stamping press 1192 produces frame segments with one column 1140, 1141 for each of the frames. However, in other embodiments, the stamping press produces two or more columns in each frame segment.

In certain embodiments as otherwise described herein, the first stamping operation occurs at a single station of the stamping press. In other embodiments, the first stamping operation includes a first stage performed at first station and a second stage performed at a second station. For example, in some embodiments, the bending and cutting required to make each frame segment occurs through a single cycle of the press at a single station. In other embodiments, certain bending processes occur at a different station than the cutting processes.

In certain embodiments as otherwise described herein, the pitching the metal sheet forward is carried out between the first stage and the second stage of the first stamping operation. For example, in some embodiments where the stamping operation is carried out in two stages, the metal sheet is pitched forward after the first stage has been performed on the first section of metal. Pitching the metal sheet forward moves the partially formed frame segments into the second station and the second section of metal sheet is moved into the first station.

Figure 12:
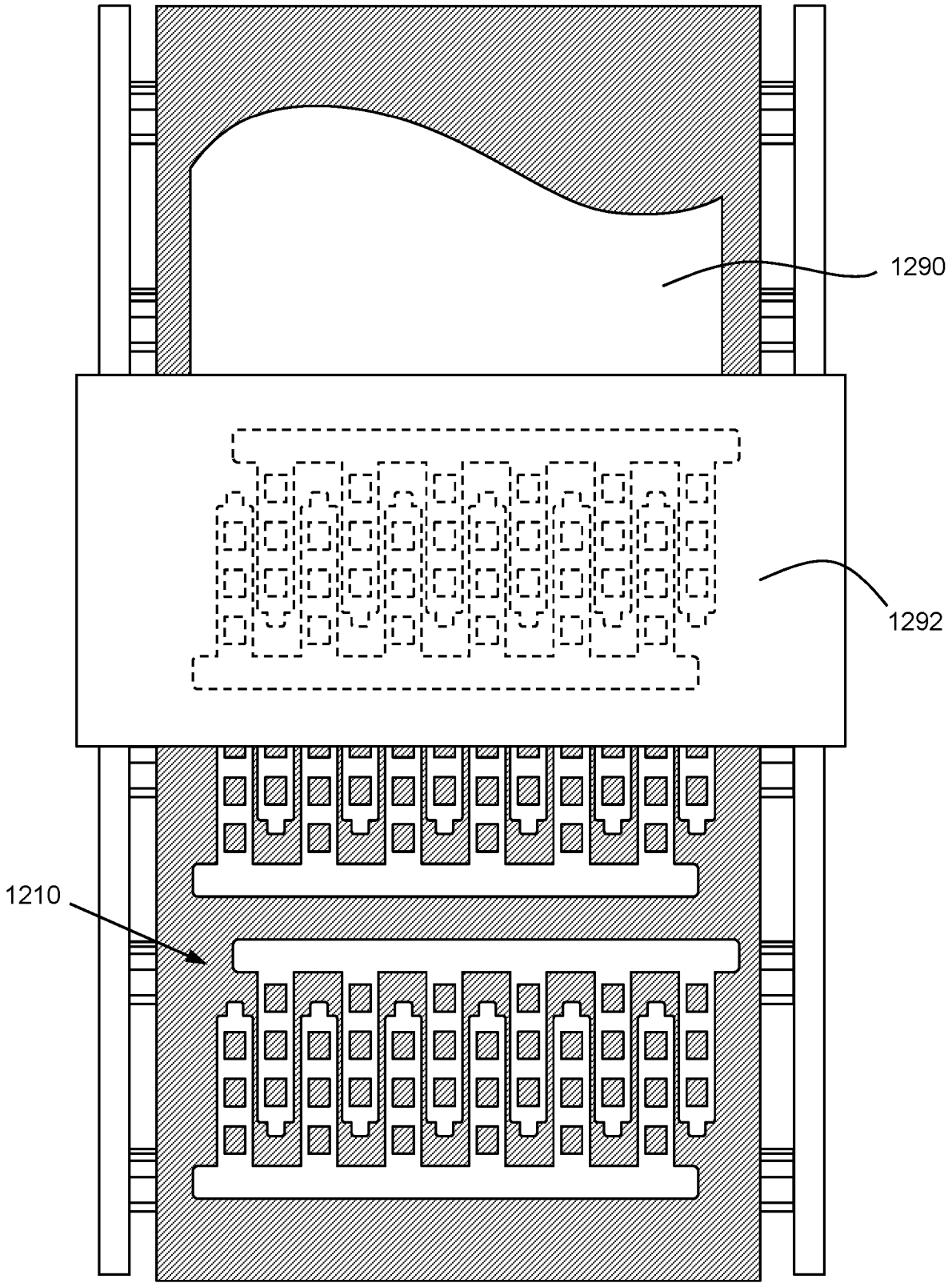
FIG. 12 is a schematic top view of a fabrication method according to another embodiment of the disclosure.
Figure 13:
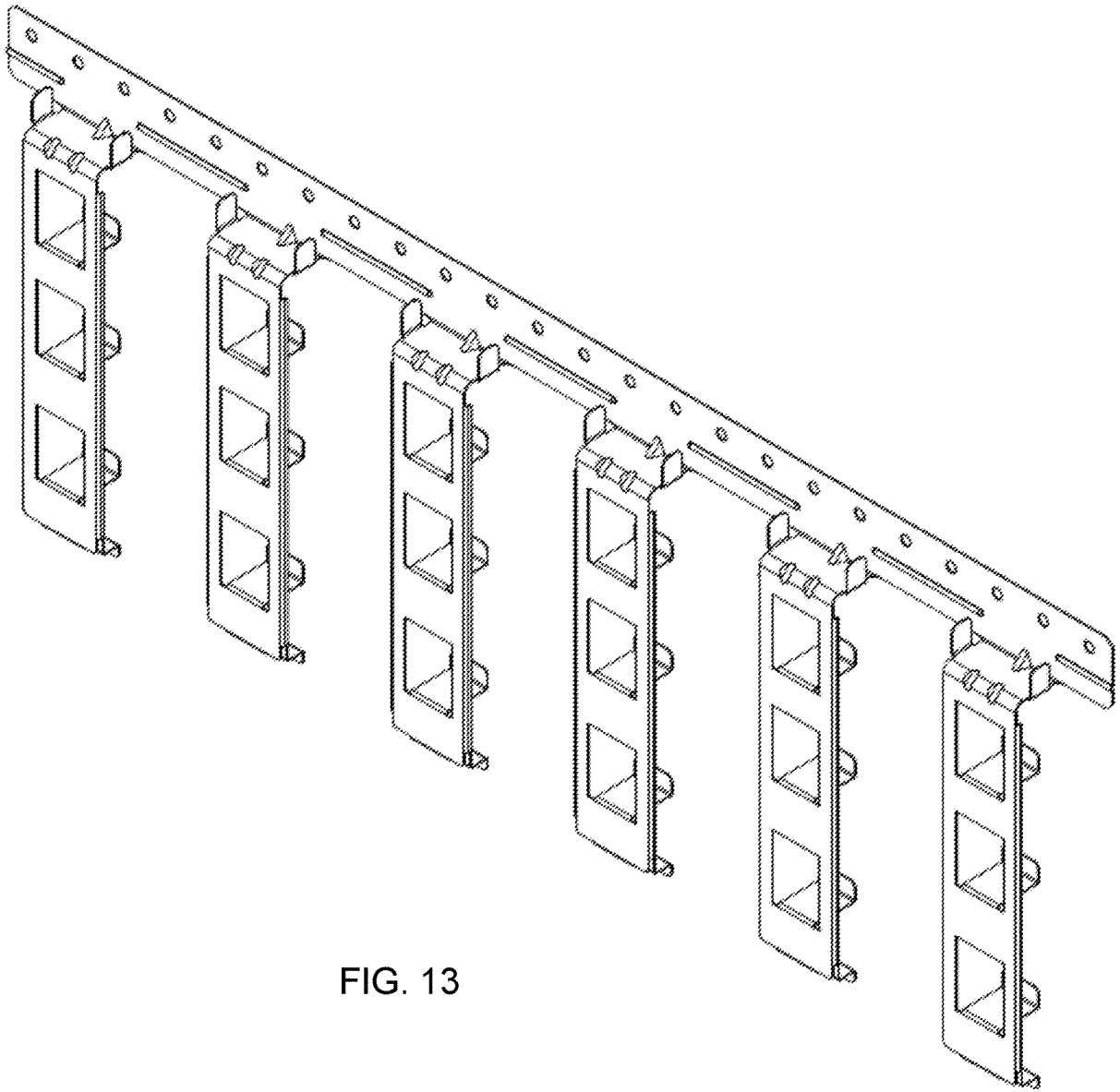
FIG. 13 is a perspective view of a frame according to an embodiment of the disclosure.
Figure 14:
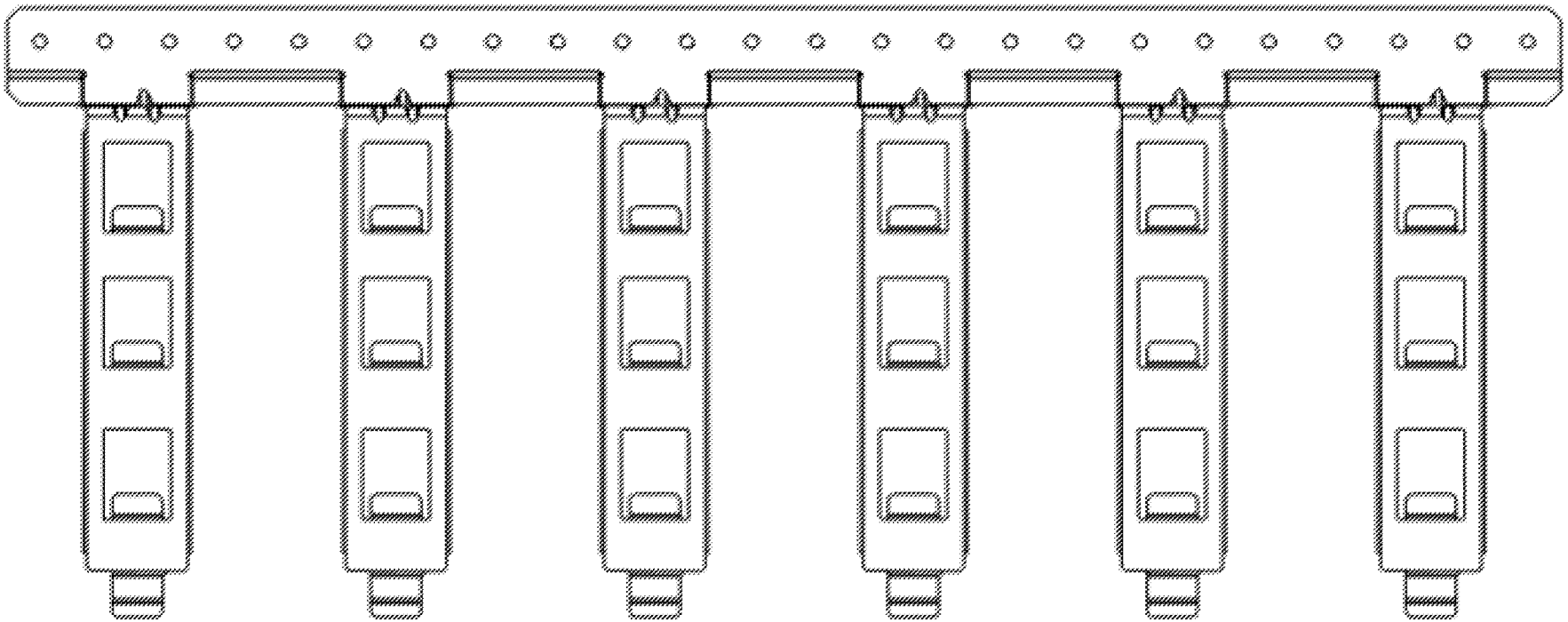
FIG. 14 is a front view of the frame of FIG. 13.
Figure 15:
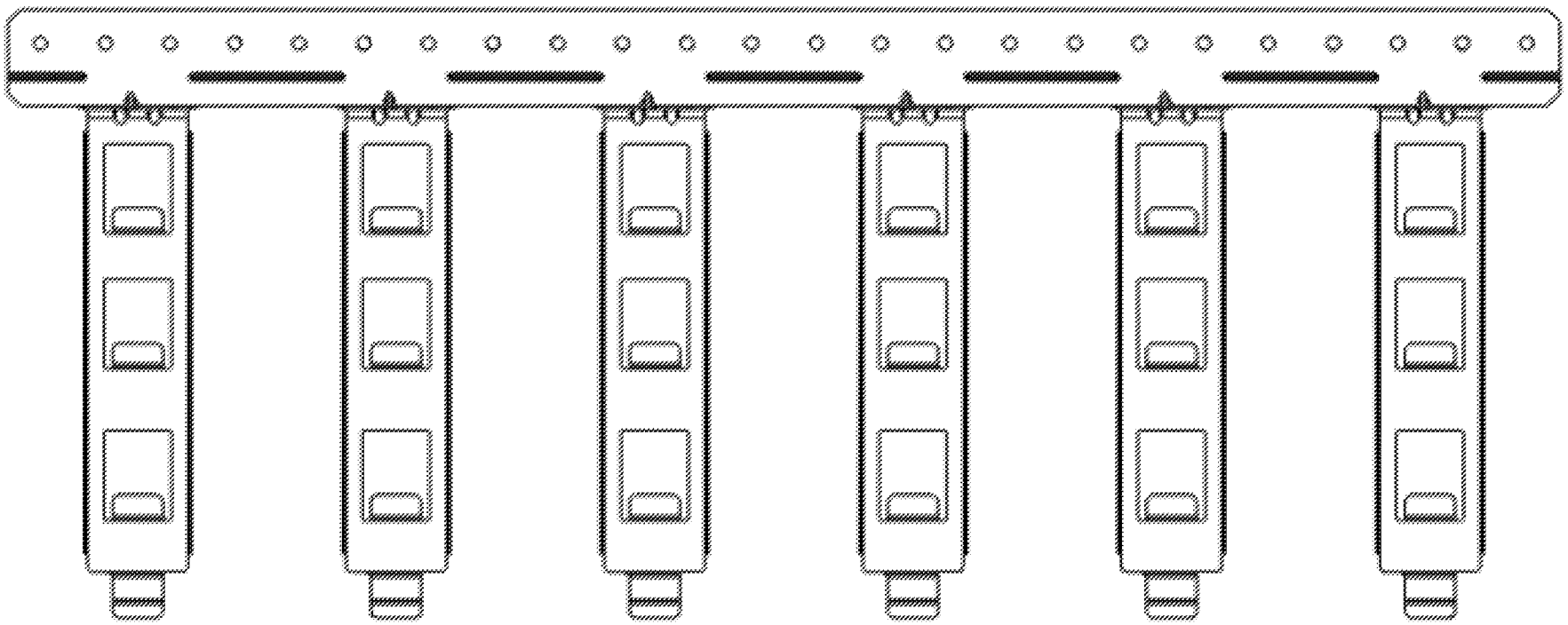
FIG. 15 is a back view of the frame of FIG. 13.
Figure 16:
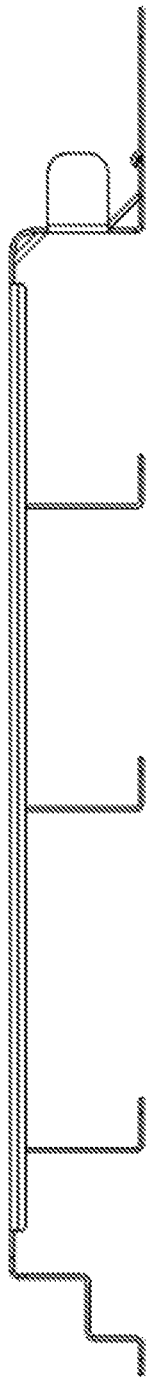
FIG. 16 is a right side view of the frame of FIG. 13.
Figure 17:
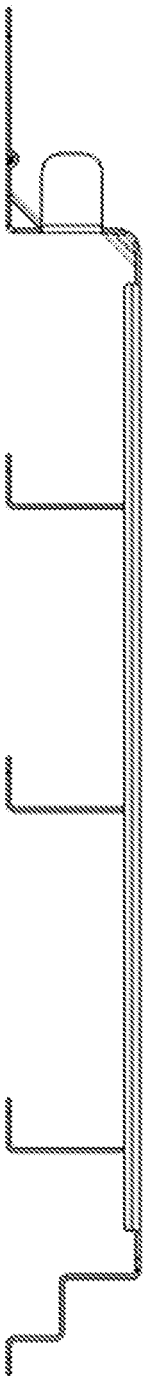
FIG. 17 is a left side view of the frame of FIG. 13.
Figure 18:
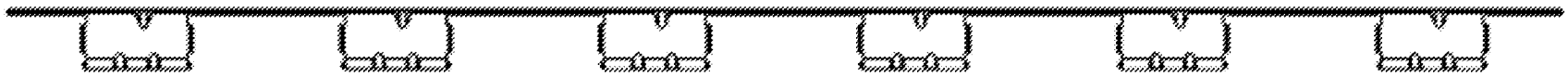
FIG. 18 is a top view of the frame of FIG. 13.
Figure 19:
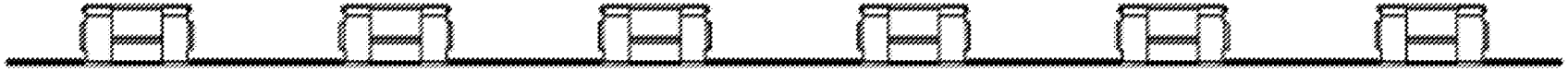
FIG. 19 is a bottom view of the frame of FIG. 13.
Figure 20:
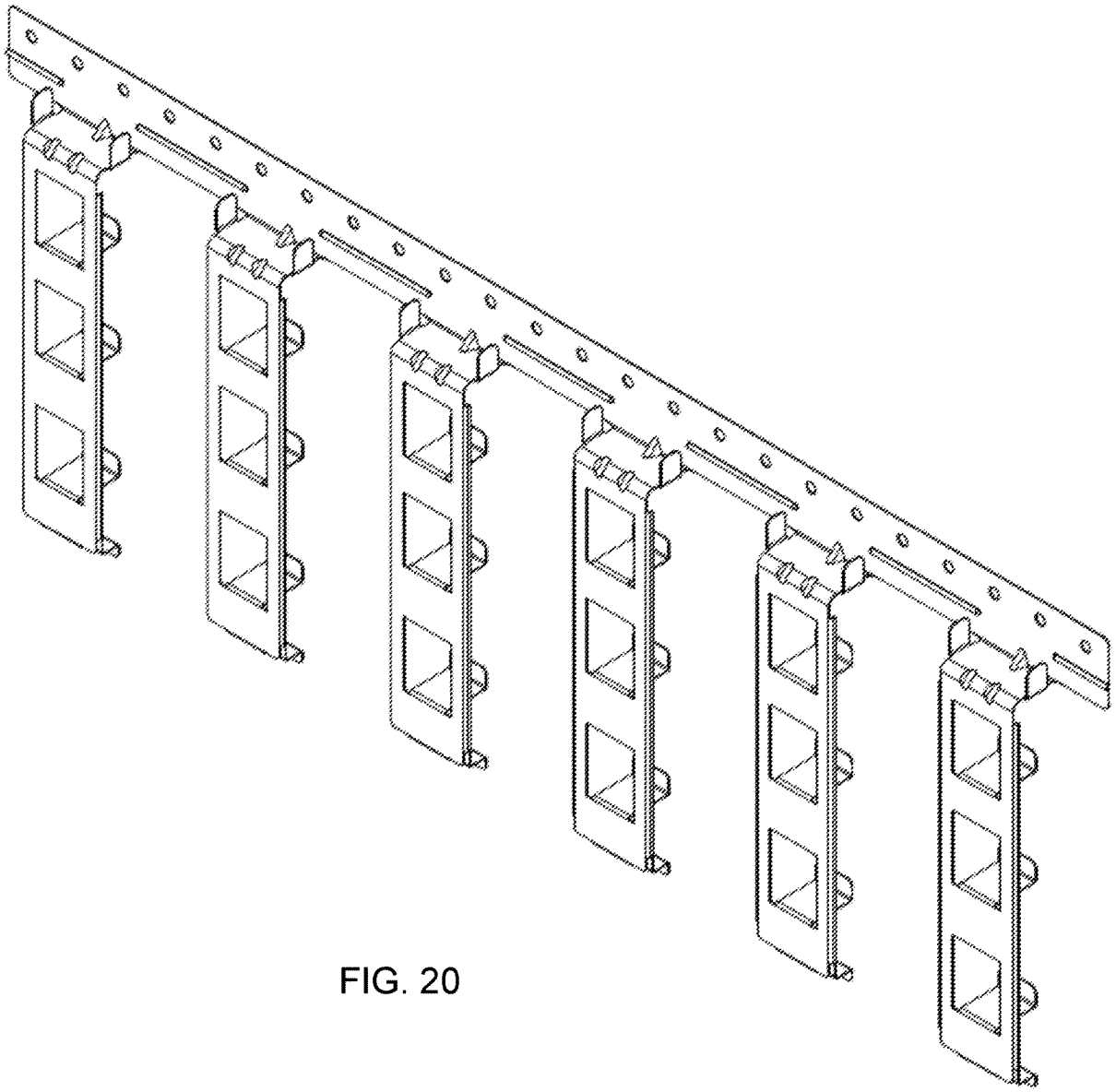
FIG. 20 is a perspective view of a frame according to another embodiment of the disclosure.
Figure 21:
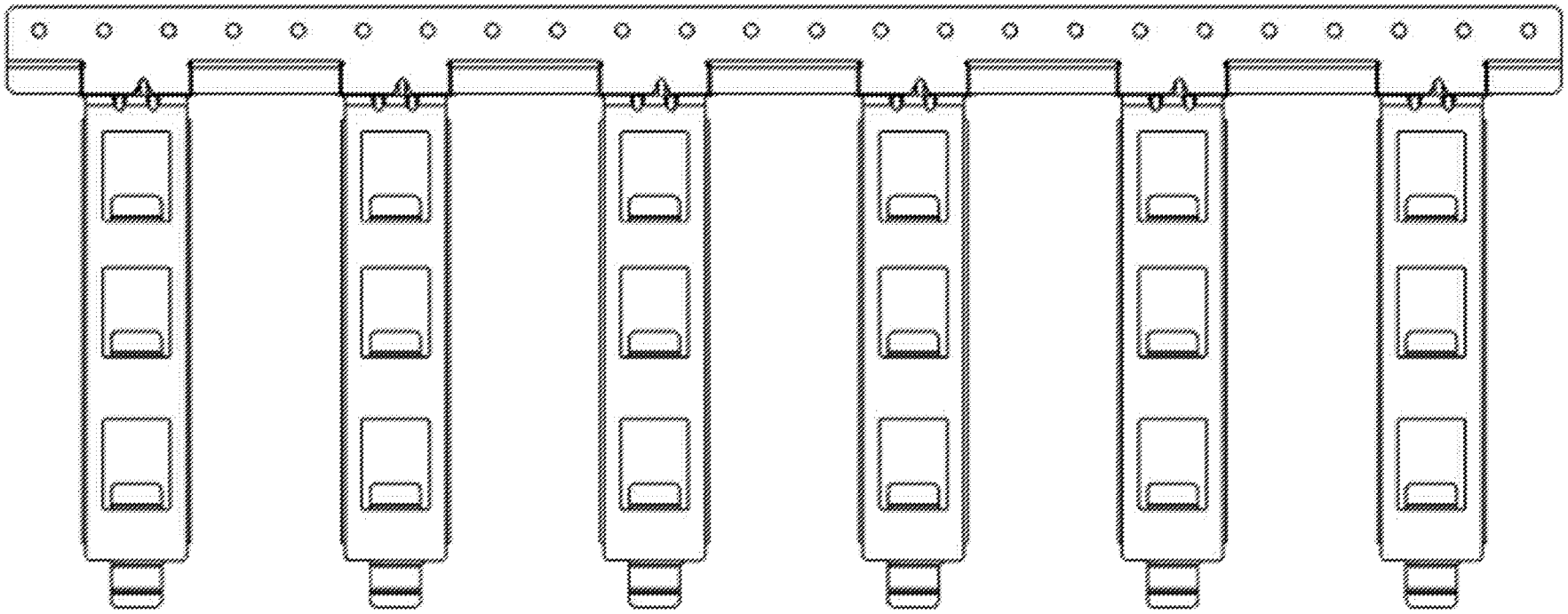
FIG. 21 is a front view of the frame of FIG. 20.
Figure 22:
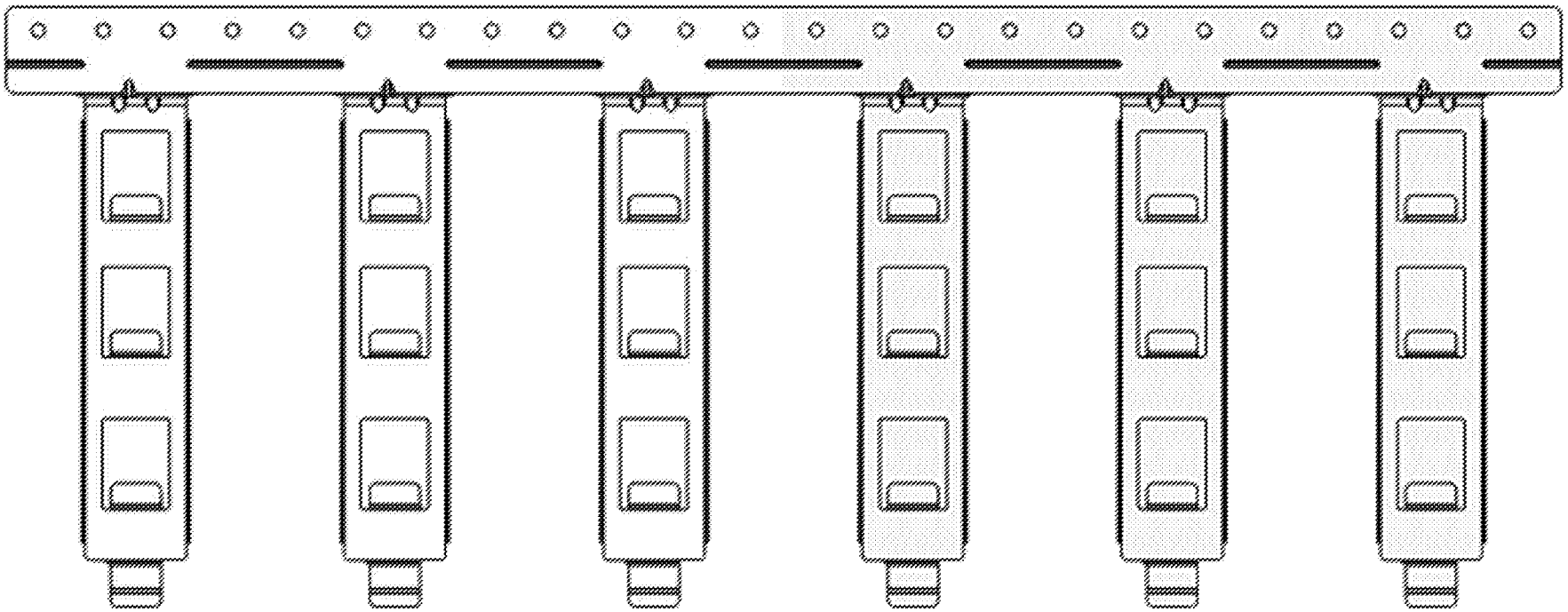
FIG. 22 is a back view of the frame of FIG. 20.
Figure 23:
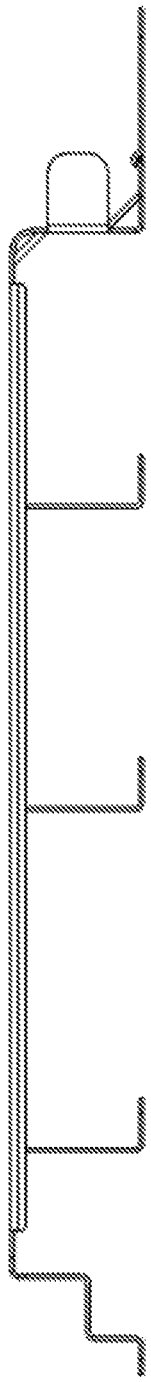
FIG. 23 is a right side view of the frame of FIG. 20.
Figure 24:
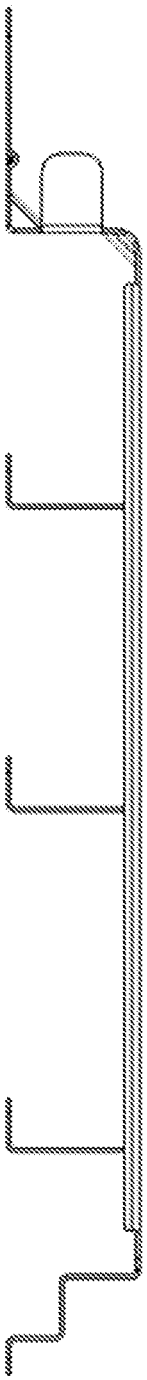
FIG. 24 is a left side view of the frame of FIG. 20.
Figure 25:
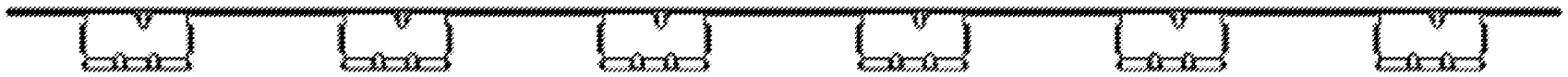
FIG. 25 is a top view of the frame of FIG. 20.
Figure 26:
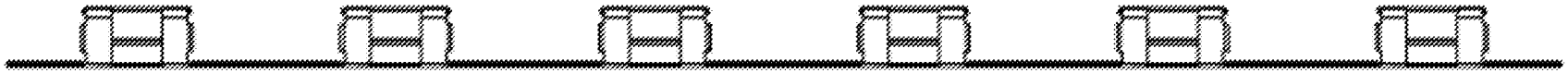
FIG. 26 is a bottom view of the frame of FIG. 20.
Figure 27:
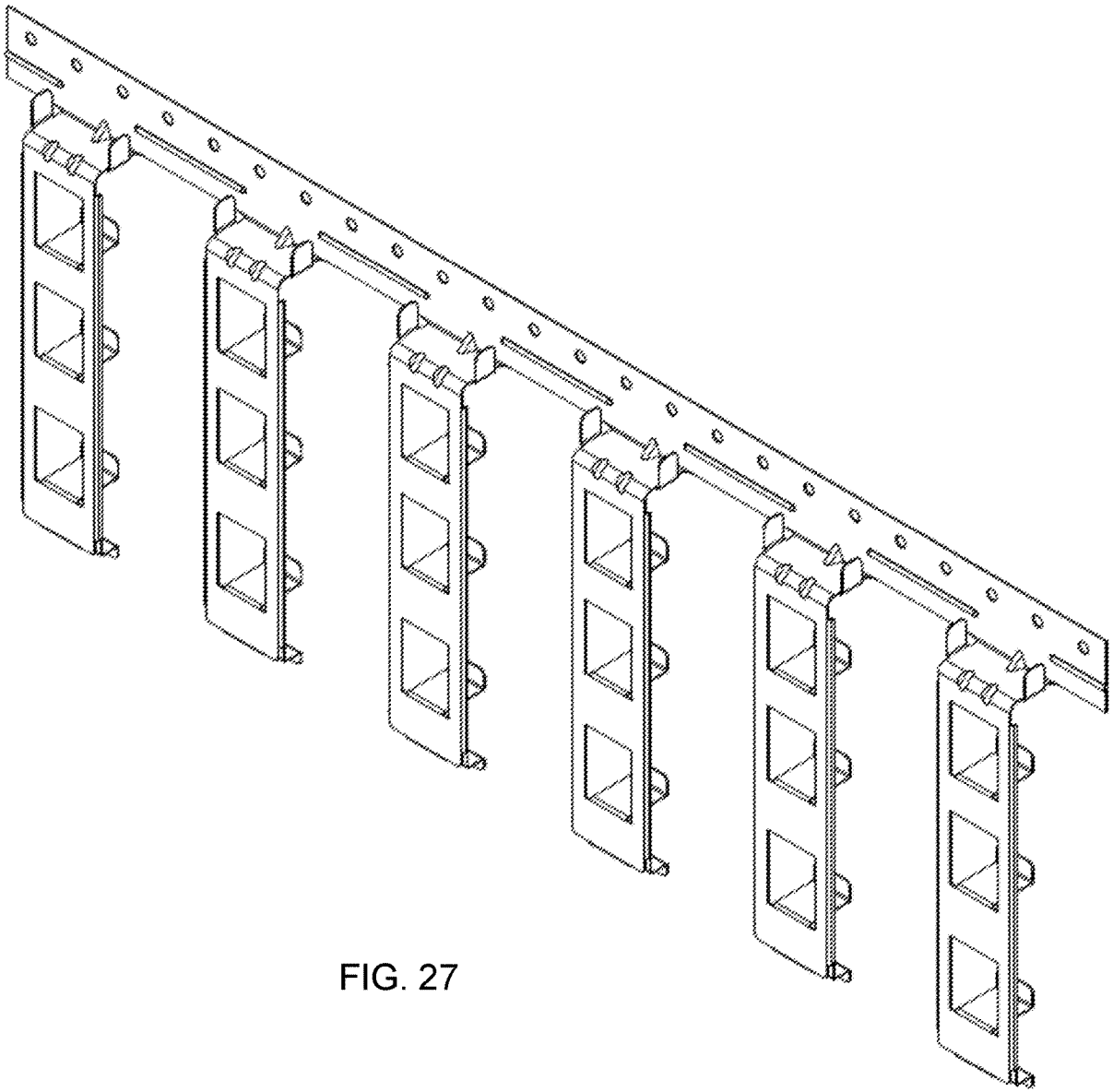
FIG. 27 is a perspective view of a frame according to another embodiment of the disclosure.
Figure 28:
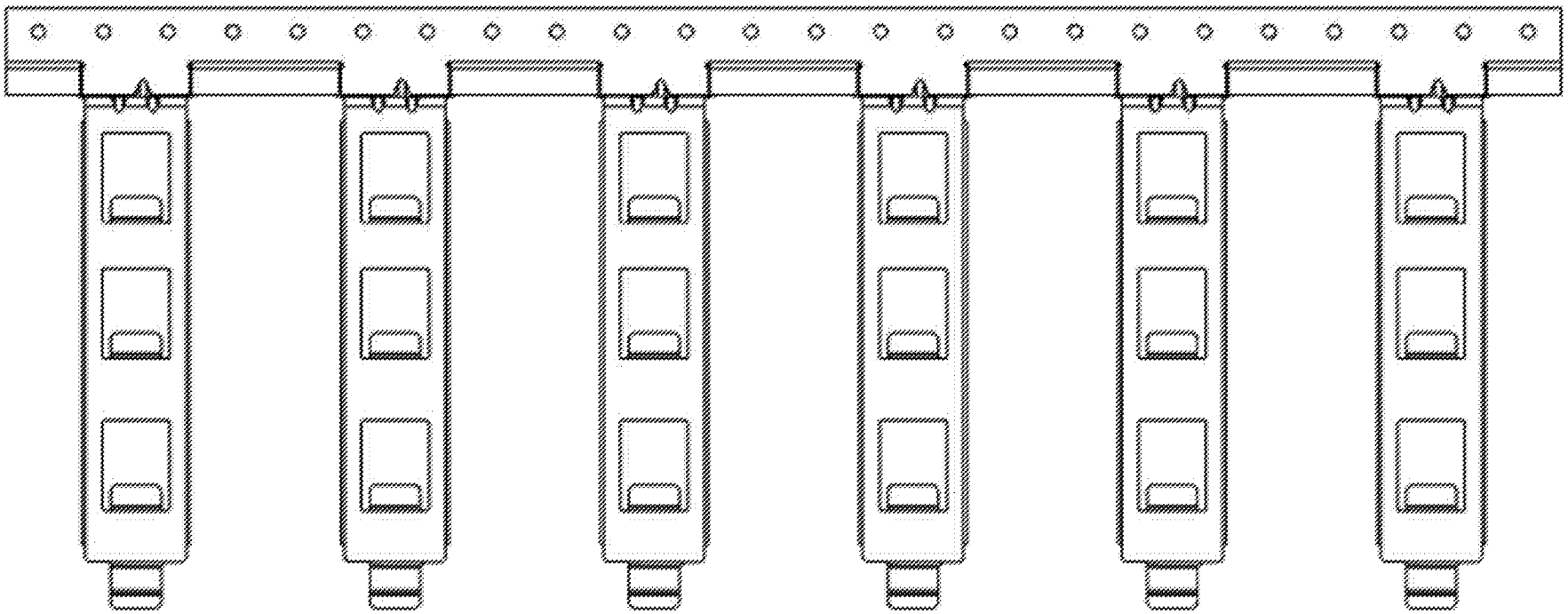
FIG. 28 is a front view of the frame of FIG. 27.
Figure 29:
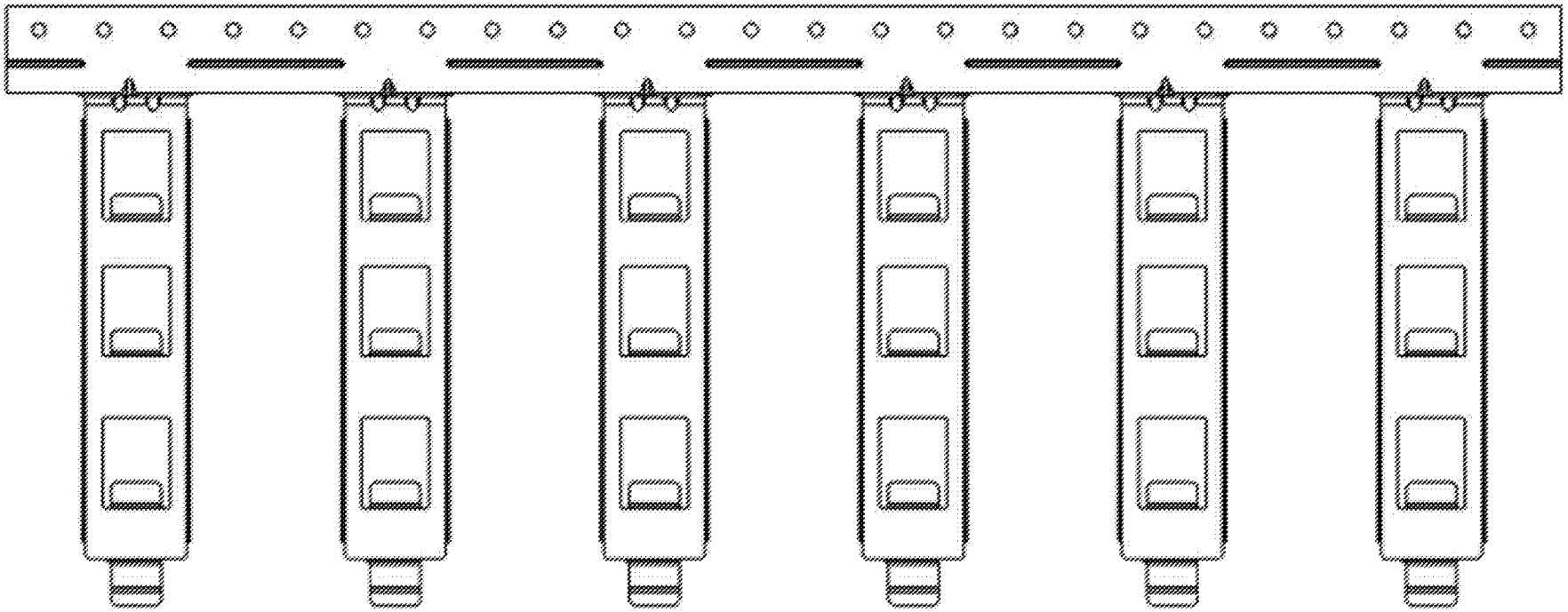
FIG. 29 is a back view of the frame of FIG. 27.
Figure 30:
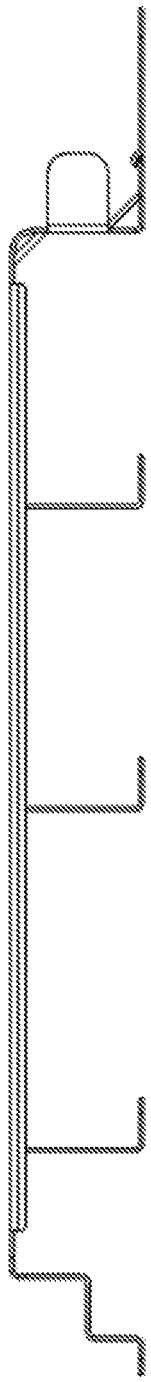
FIG. 30 is a right side view of the frame of FIG. 27.
Figure 31:
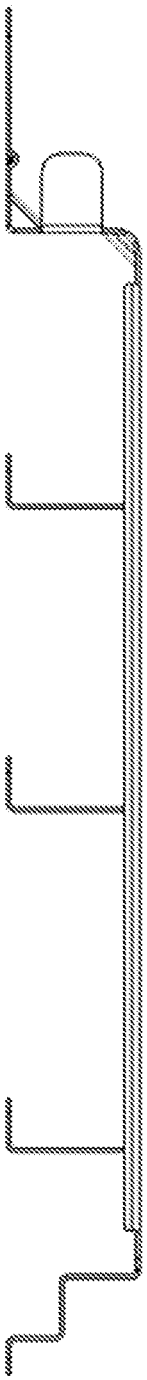
FIG. 31 is a left side view of the frame of FIG. 27.
Figure 32:
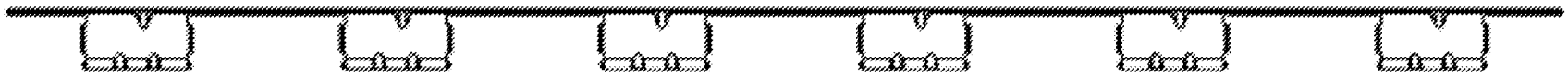
FIG. 32 is a top view of the frame of FIG. 27.
Figure 33:
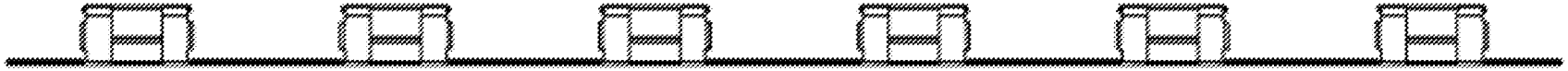
FIG. 33 is a bottom view of the frame of FIG. 27.
Figure 34:
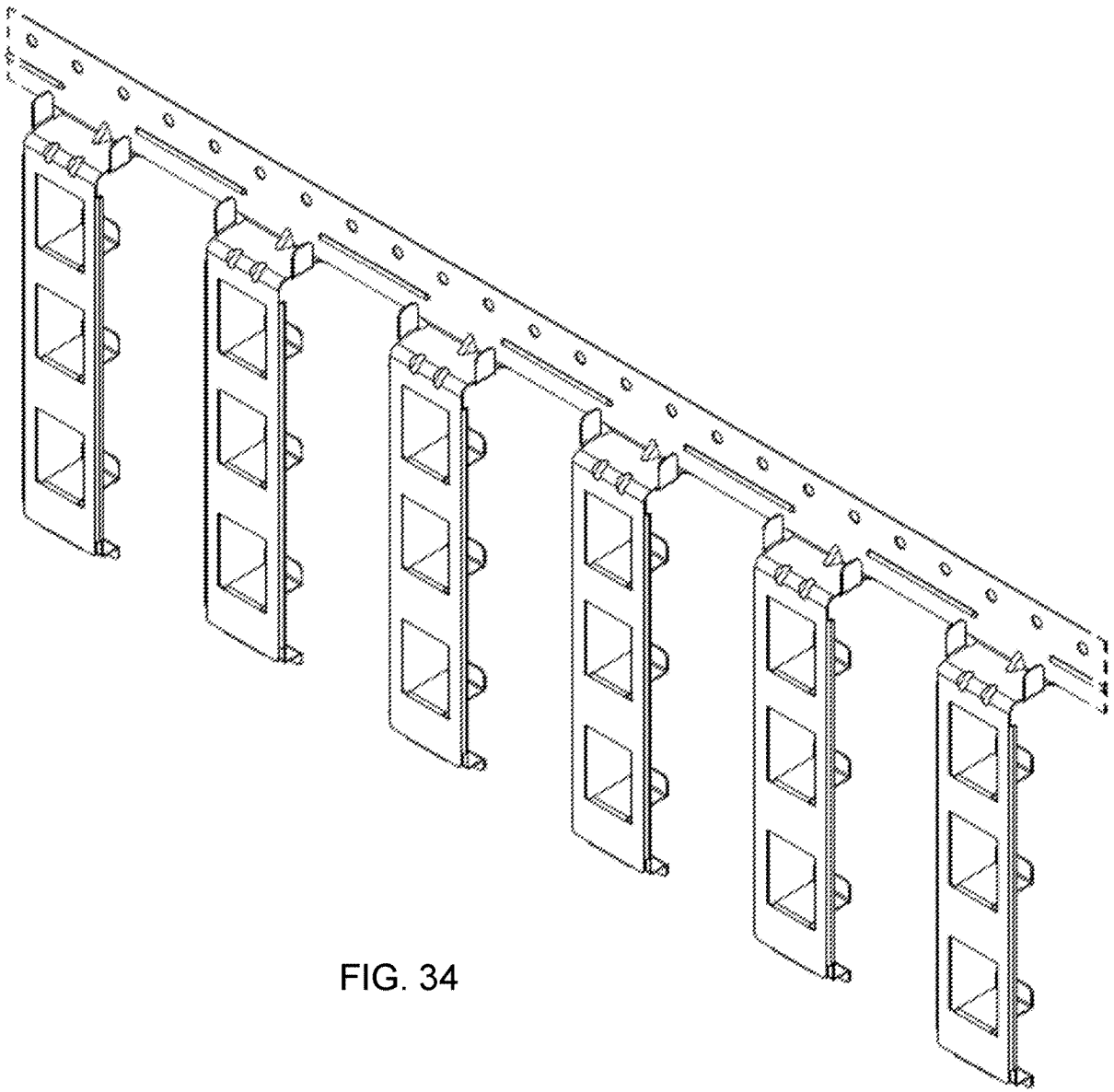
FIG. 34 is a perspective view of a frame according to another embodiment of the disclosure.
Figure 35:
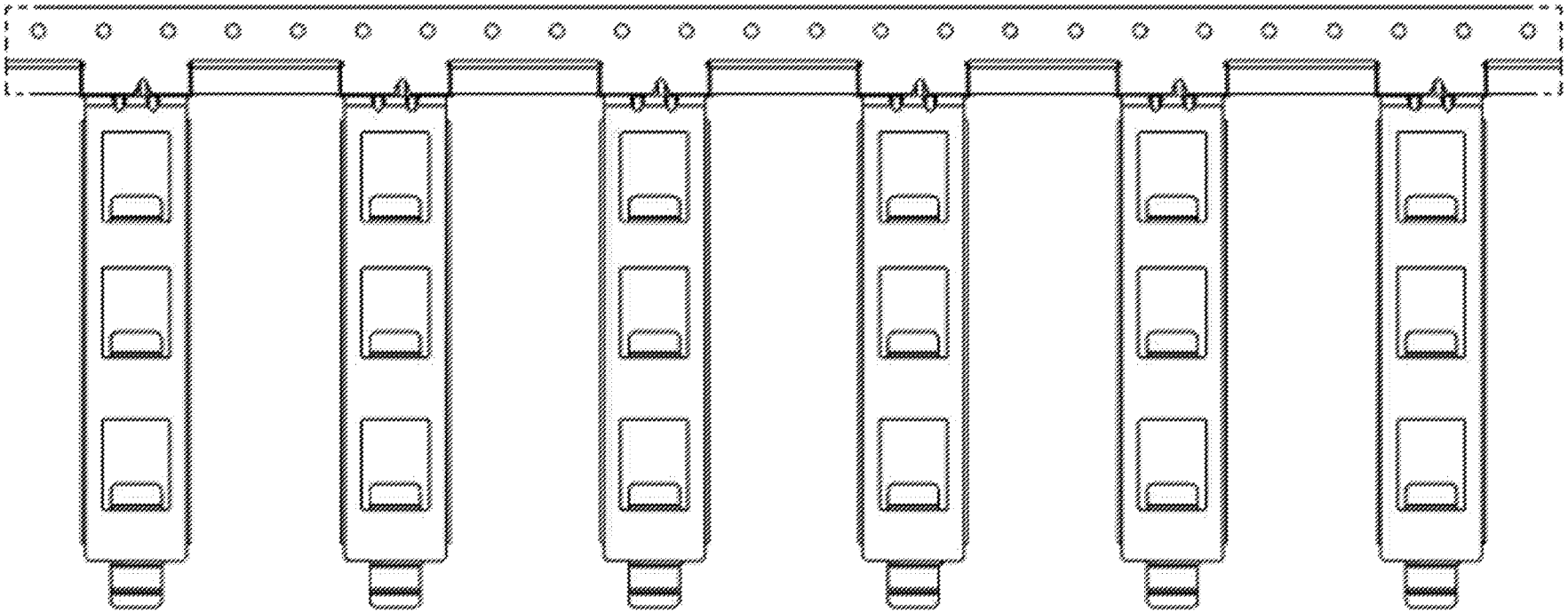
FIG. 35 is a front view of the frame of FIG. 34.
Figure 36:
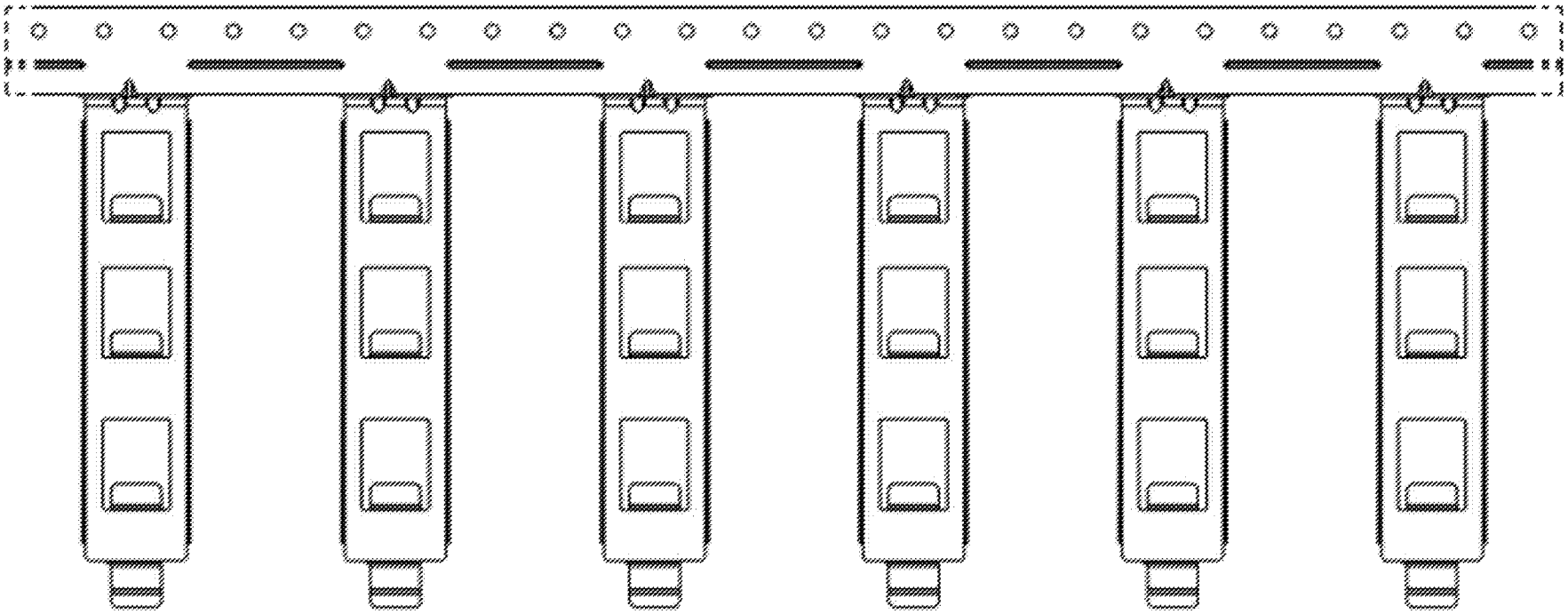
FIG. 36 is a back view of the frame of FIG. 34.
Figure 37:
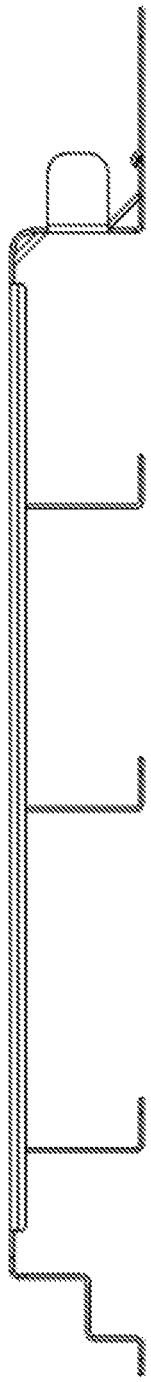
FIG. 37 is a right side view of the frame of FIG. 34.
Figure 38:
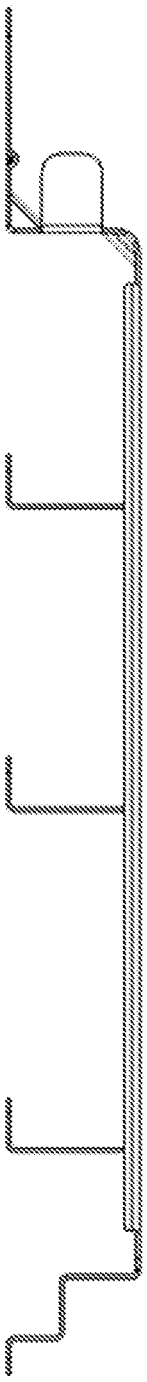
FIG. 38 is a left side view of the frame of FIG. 34.
Figure 39:
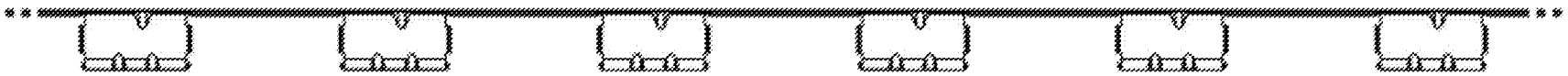
FIG. 39 is a top view of the frame of FIG. 34.
Figure 40:
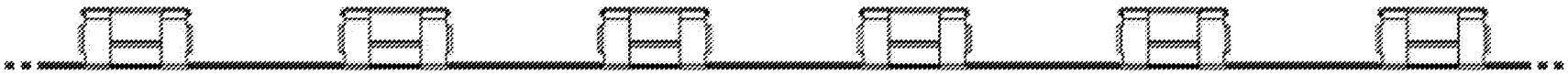
FIG. 40 is a bottom view of the frame of FIG. 34.
Figure 41:
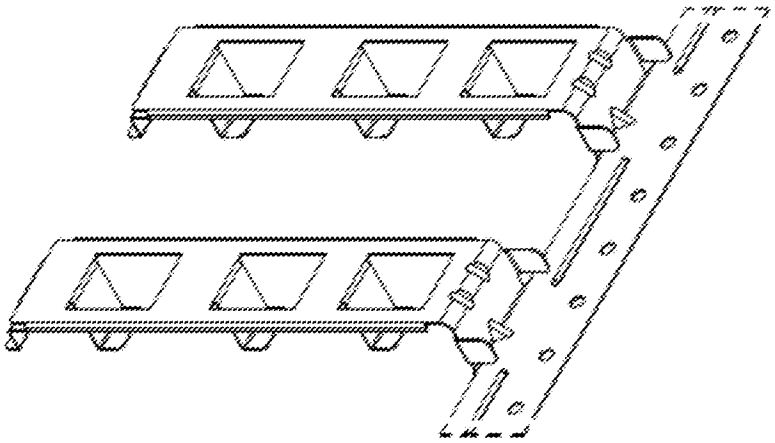
FIG. 41 is a perspective view of sections of a frame according to another embodiment of the disclosure.
Figure 42:
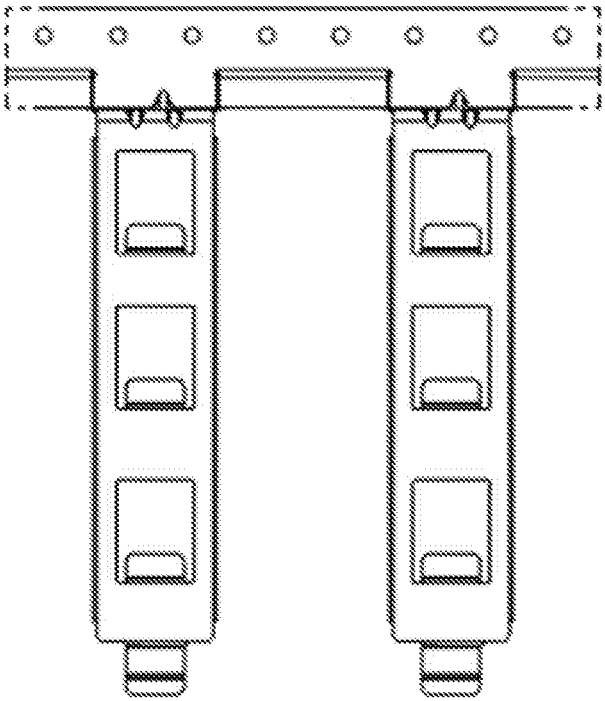
FIG. 42 is a front view of the frame sections of FIG. 41.
Figure 43:
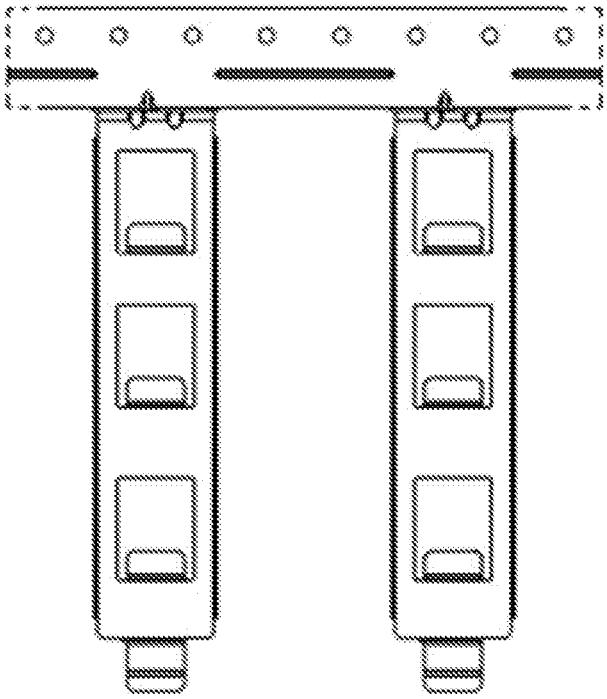
FIG. 43 is a back view of the frame sections of FIG. 41.
Figure 44:
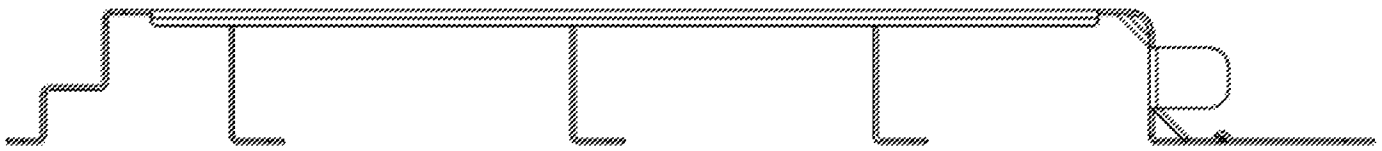
FIG. 44 is a right side view of the frame sections of FIG. 41.
Figure 45:
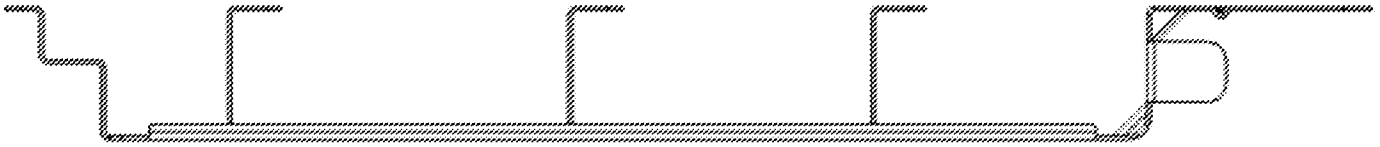
FIG. 45 is a left side view of the frame sections of FIG. 41.
Figure 46:
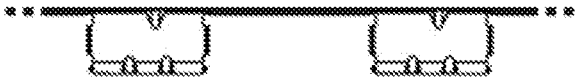
FIG. 46 is a top view of the frame sections of FIG. 41.
Figure 47:
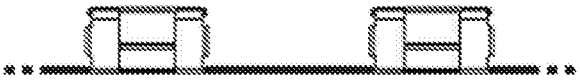
FIG. 47 is a bottom view of the frame sections of FIG. 41.
Figure 48:
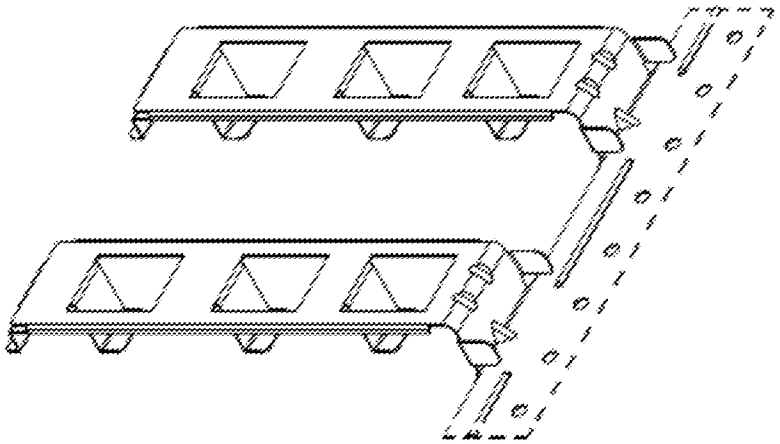
FIG. 48 is a perspective view of sections of a frame according to an embodiment of the disclosure.
Figure 49:
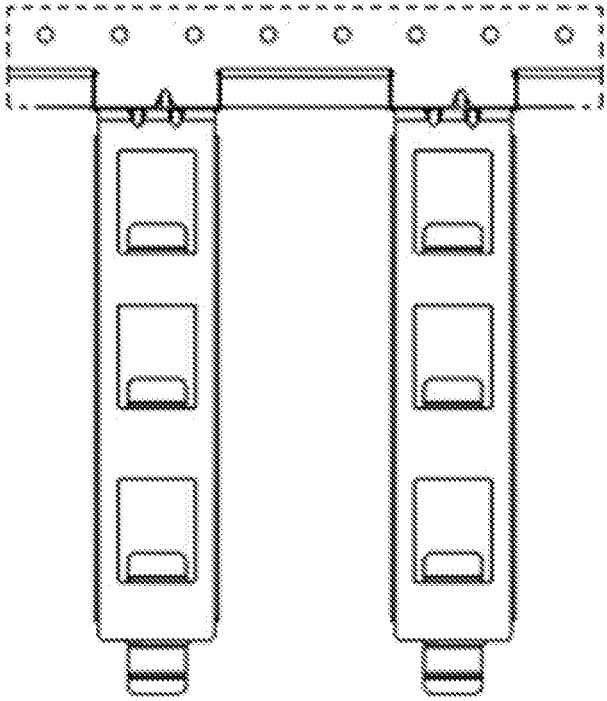
FIG. 49 is a front view of the frame sections of FIG. 48.
Figure 50:
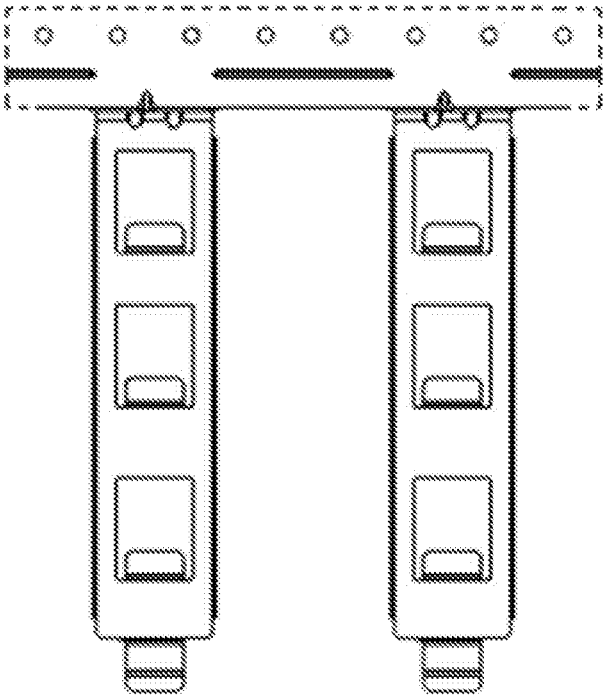
FIG. 50 is a back view of the frame sections of FIG. 48.
Figure 51:
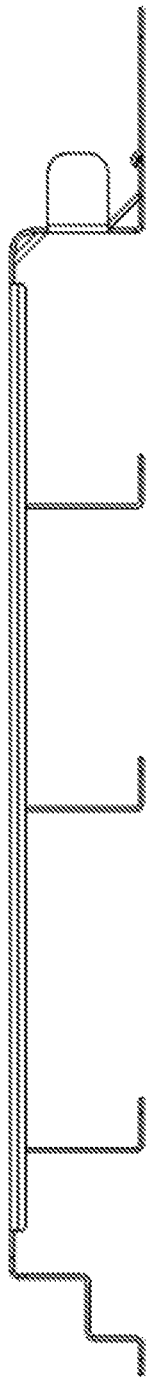
FIG. 51 is a right side view of the frame sections of FIG. 48.
Figure 52:
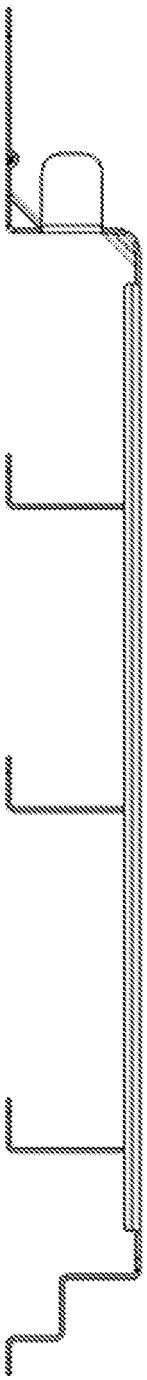
FIG. 52 is a left side view of the frame sections of FIG. 48.
Figure 53:
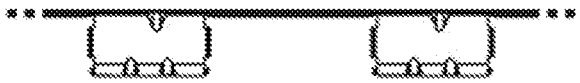
FIG. 53 is a top view of the frame sections of FIG. 48.
Figure 54:
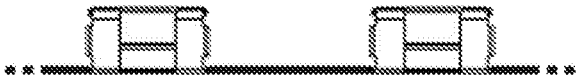
FIG. 54 is a bottom view of the frame sections of FIG. 48.
Figure 55:
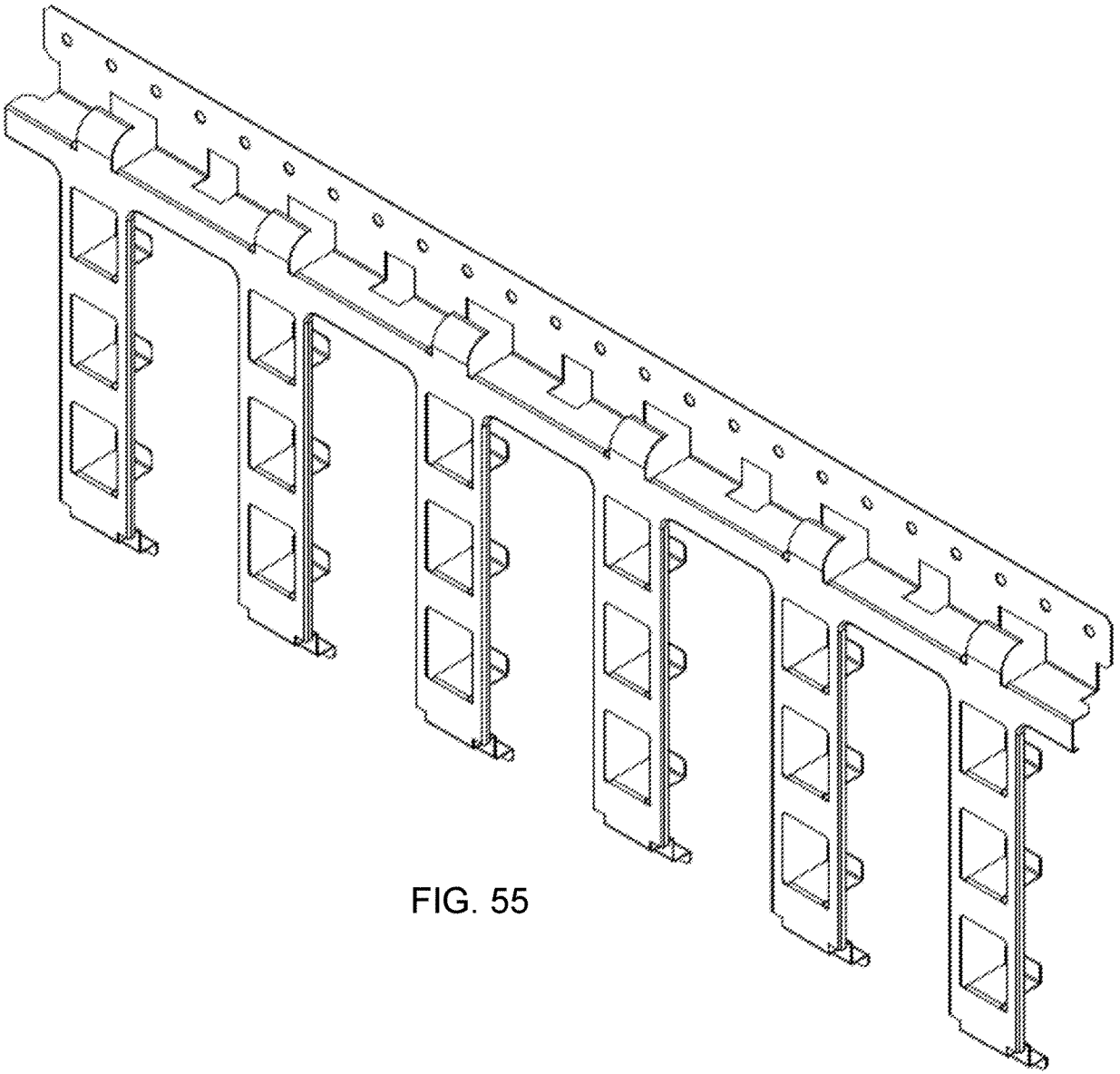
FIG. 55 is a perspective view of a frame according to another embodiment of the disclosure.
Figure 56:
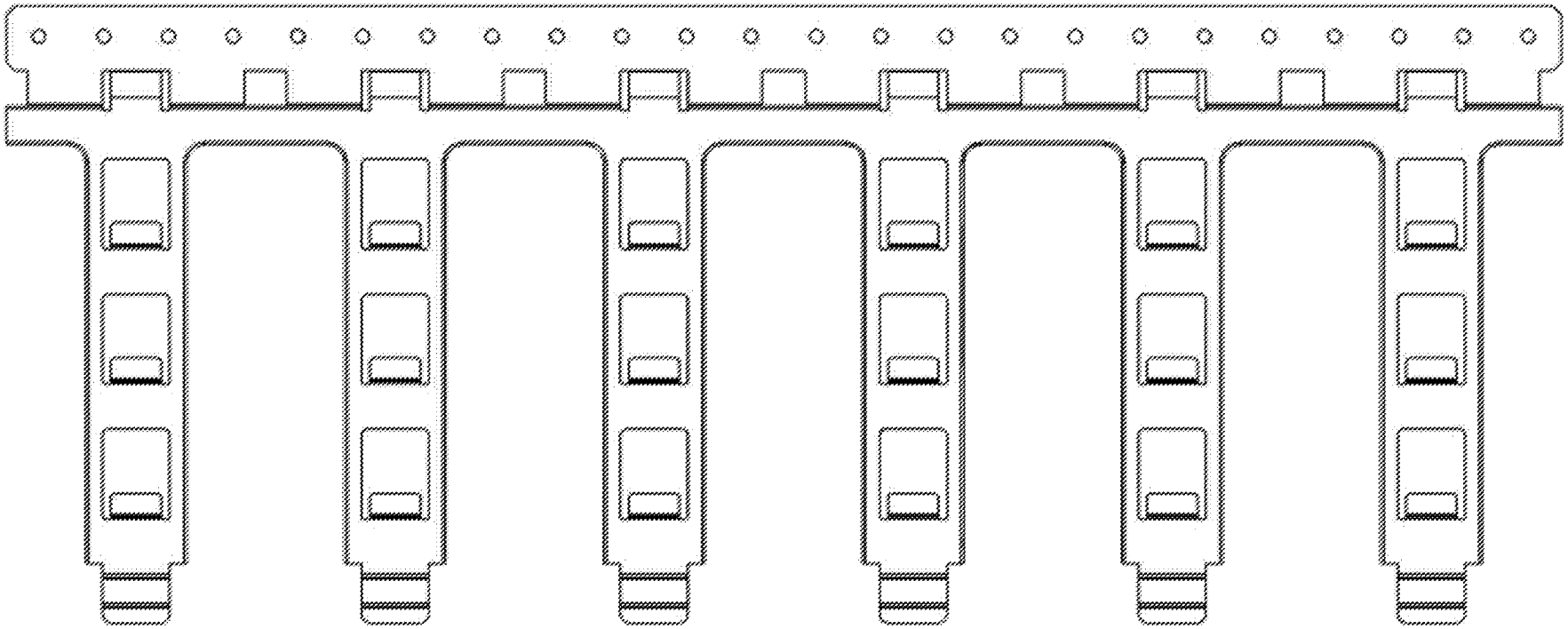
FIG. 56 is a front view of the frame of FIG. 55.
Figure 57:
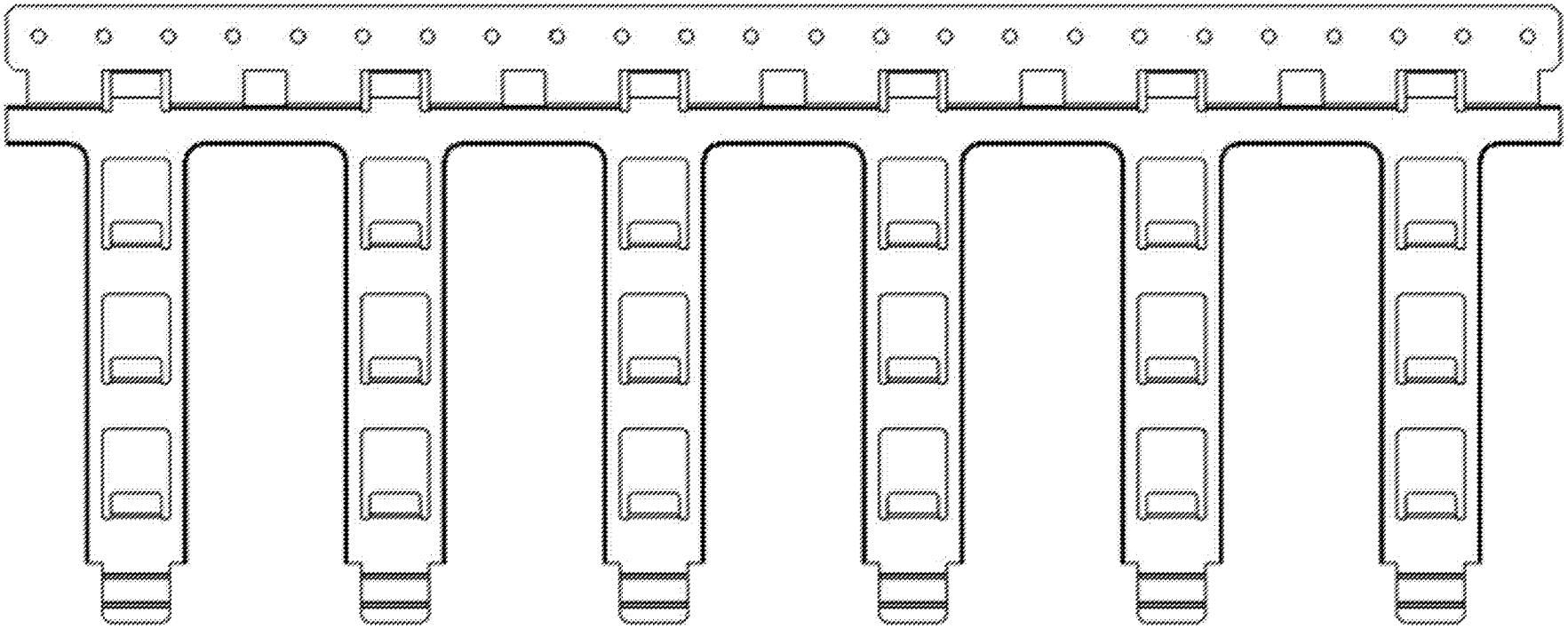
FIG. 57 is a back view of the frame of FIG. 55.
Figure 58:
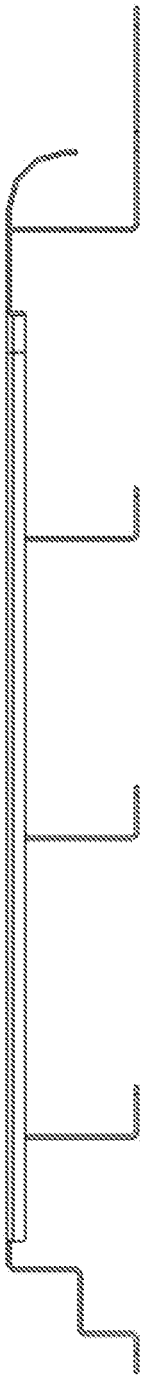
FIG. 58 is a right side view of the frame of FIG. 55.
Figure 59:
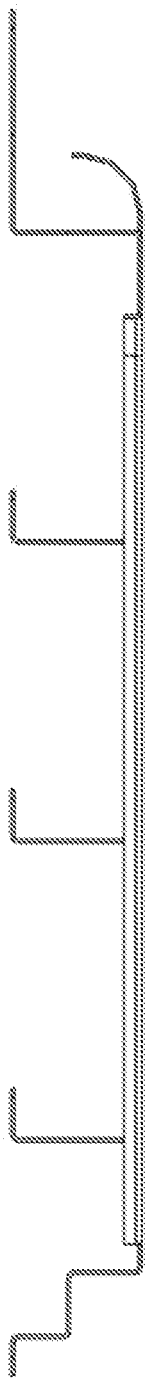
FIG. 59 is a left side view of the frame of FIG. 55.
Figure 60:
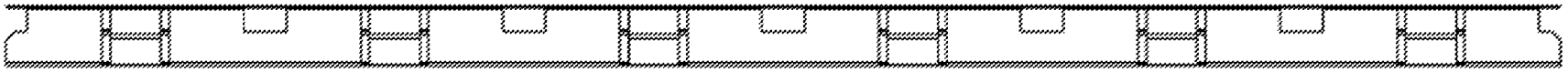
FIG. 60 is a top view of the frame of FIG. 55.
Figure 61:
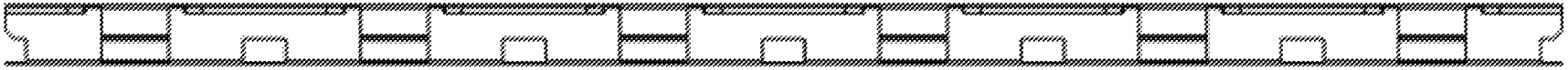
FIG. 61 is a bottom view of the frame of FIG. 55.
Figure 62:
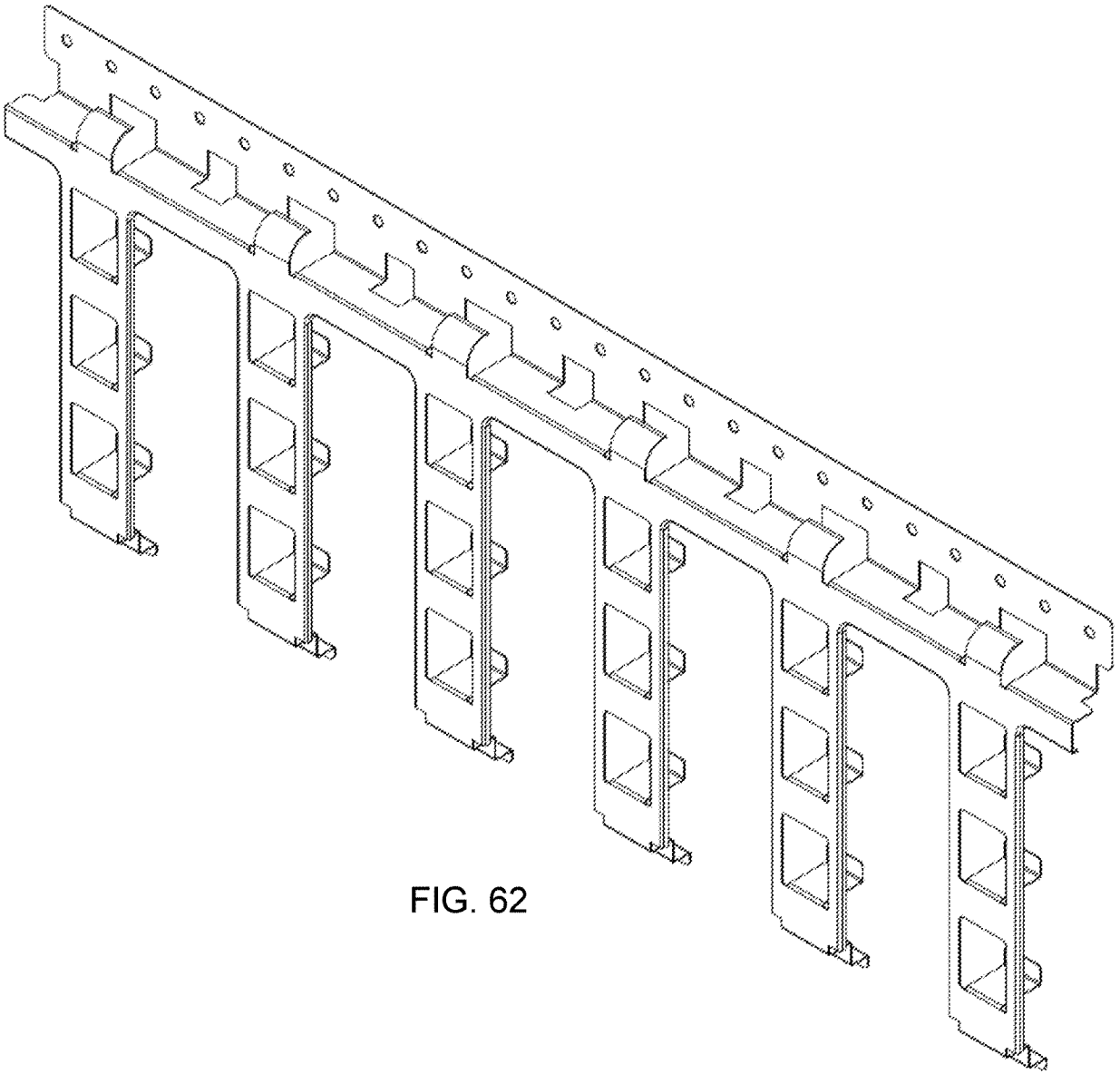
FIG. 62 is a perspective view of a frame according to another embodiment of the disclosure.
Figure 63:
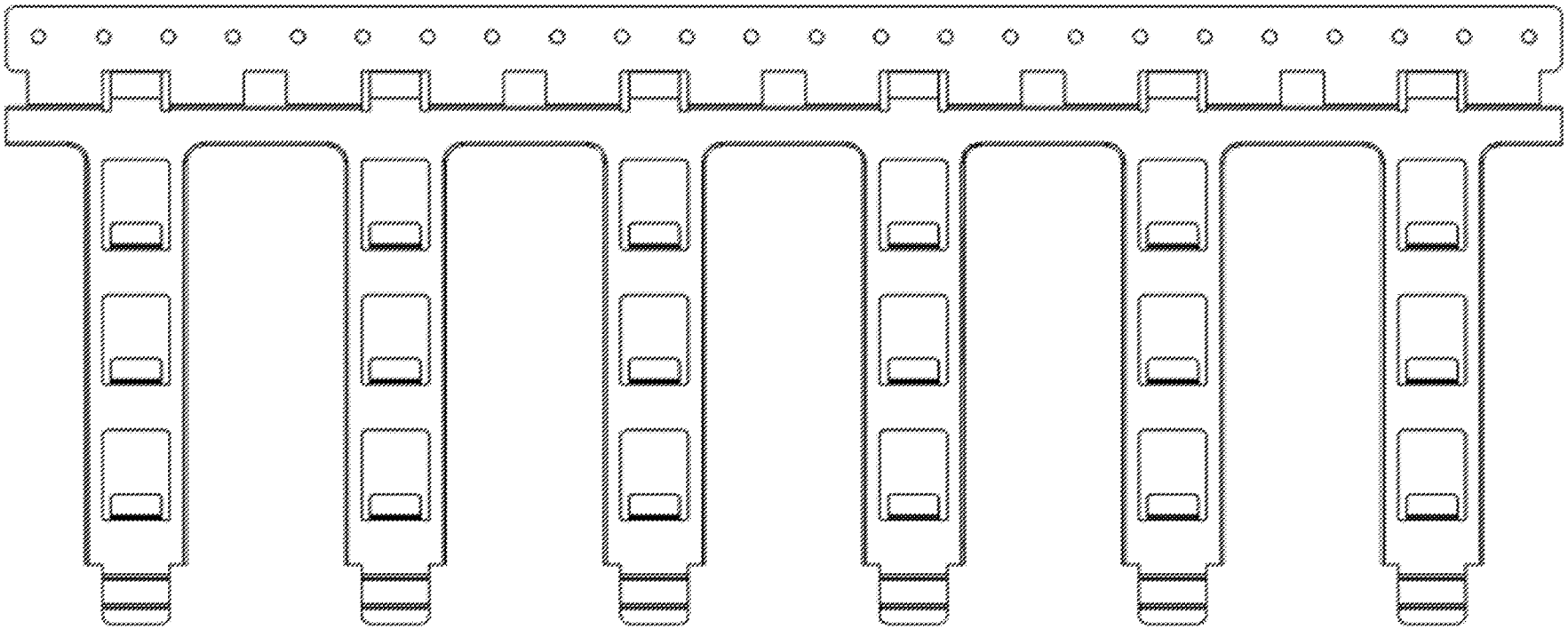
FIG. 63 is a front view of the frame of FIG. 62.
Figure 64:
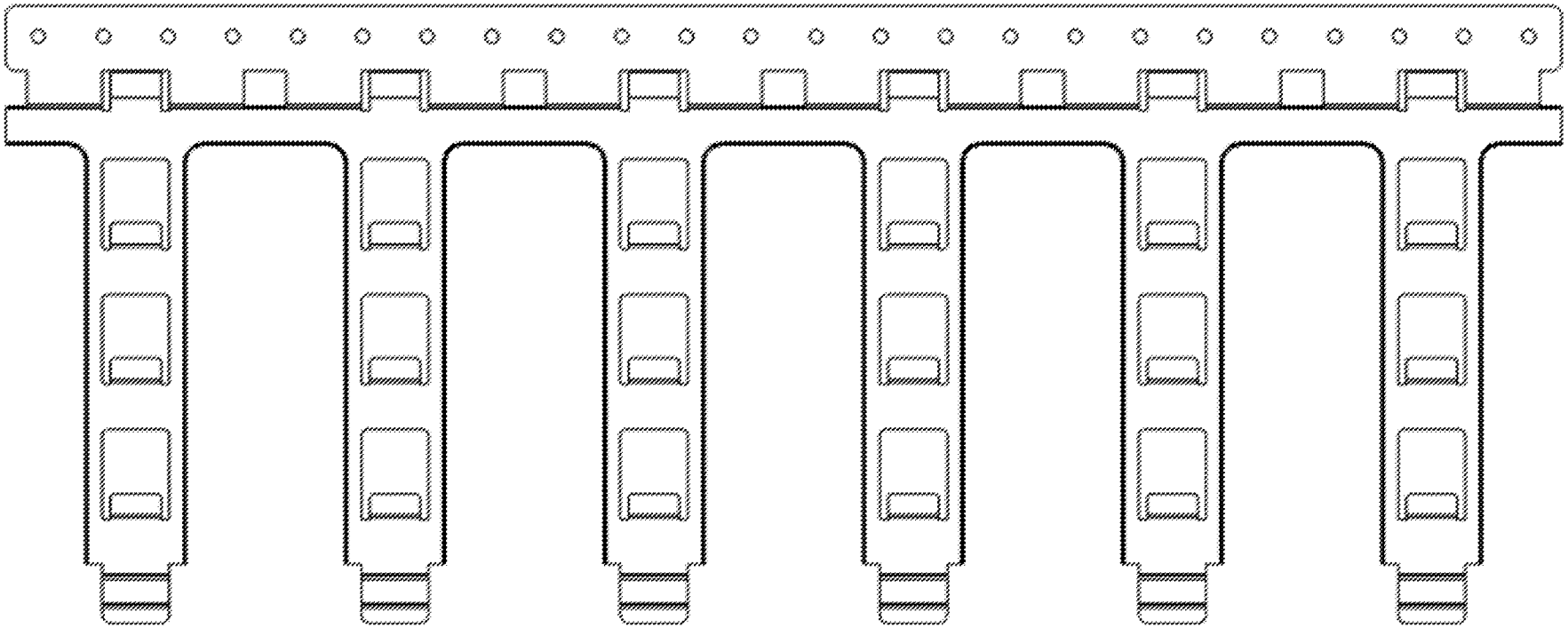
FIG. 64 is a back view of the frame of FIG. 62.
Figure 65:
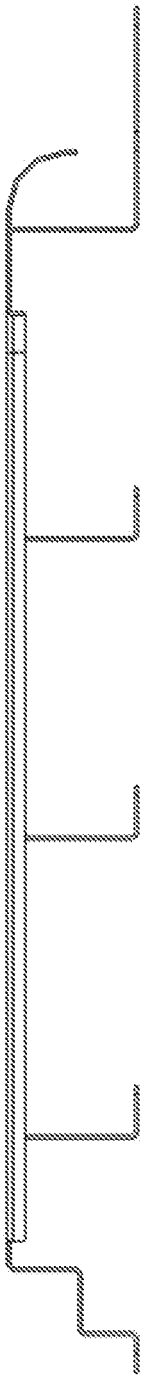
FIG. 65 is a right side view of the frame of FIG. 62.
Figure 66:
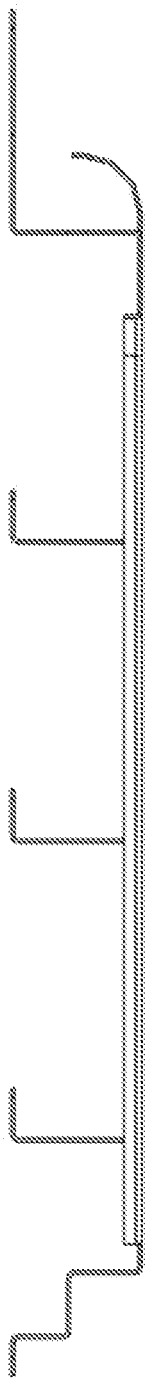
FIG. 66 is a left side view of the frame of FIG. 62.
Figure 67:
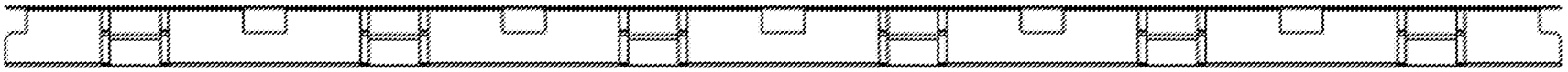
FIG. 67 is a top view of the frame of FIG. 62.
Figure 68:
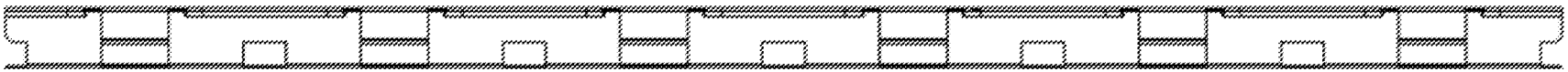
FIG. 68 is a bottom view of the frame of FIG. 62.
Figure 69:
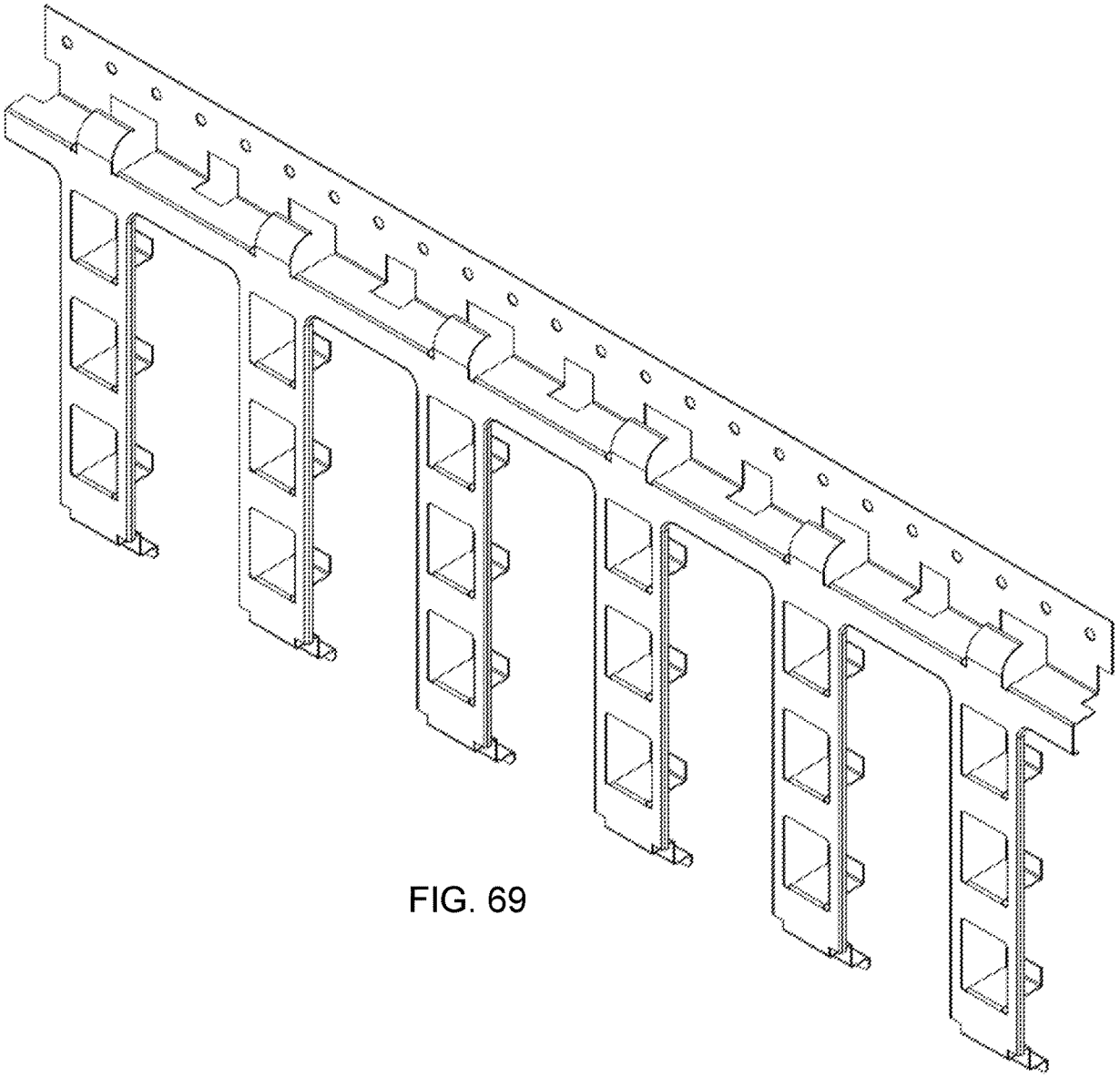
FIG. 69 is a perspective view of a frame according to another embodiment of the disclosure.
Figure 70:
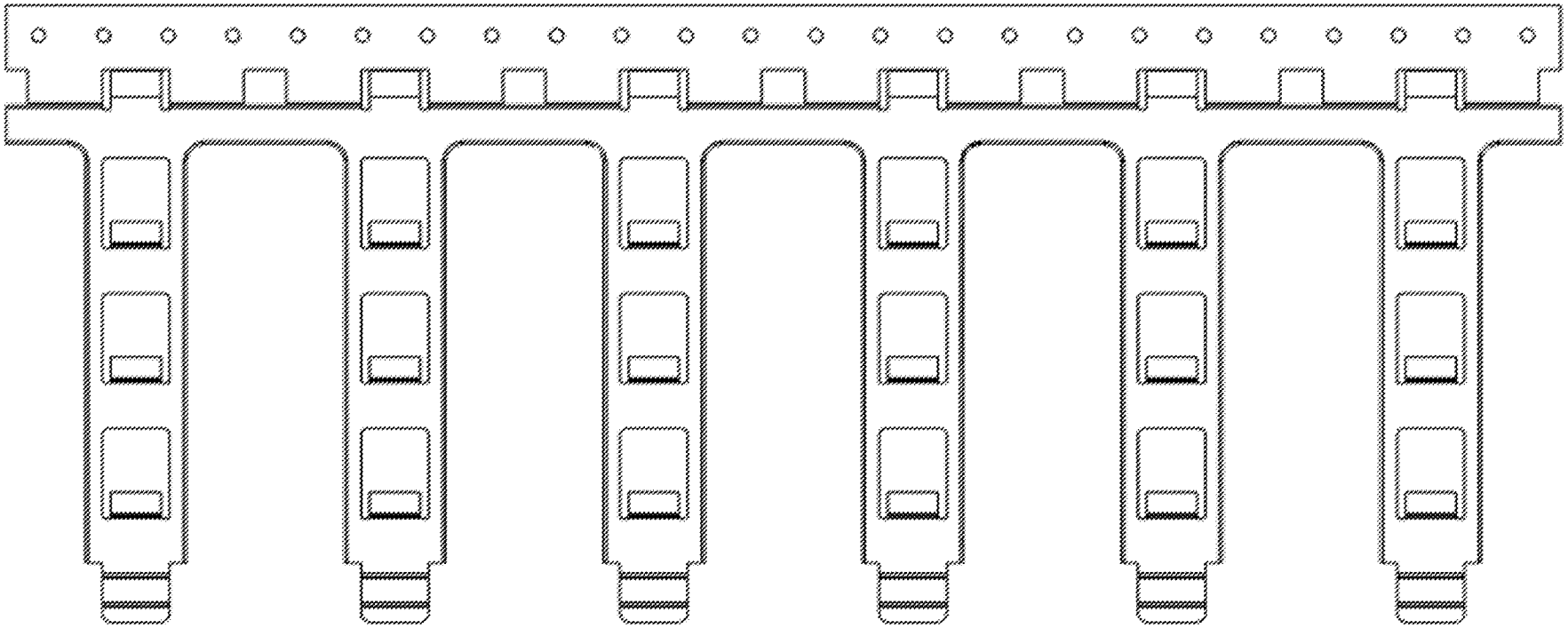
FIG. 70 is a front view of the frame of FIG. 69.
Figure 71:
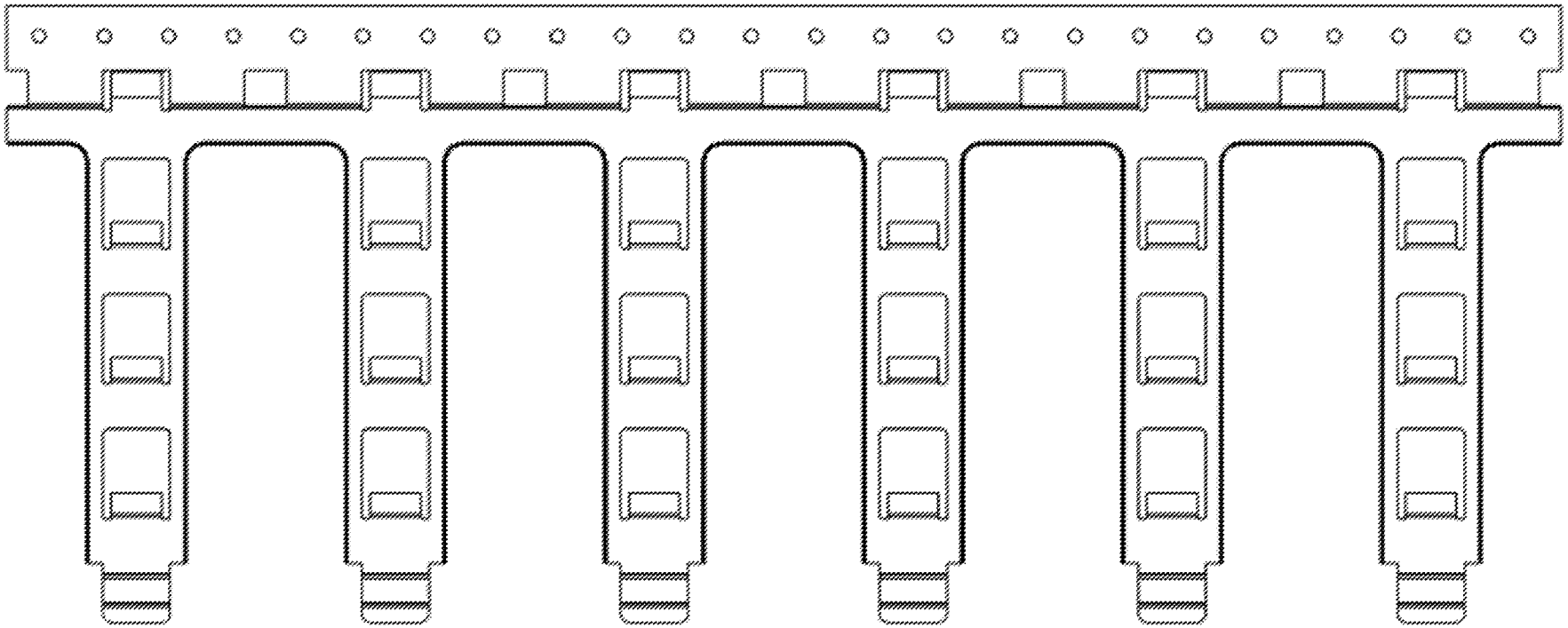
FIG. 71 is a back view of the frame of FIG. 69.
Figure 72:
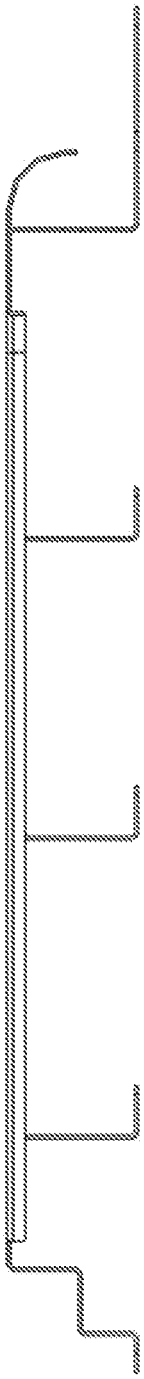
FIG. 72 is a right side view of the frame of FIG. 69.
Figure 73:
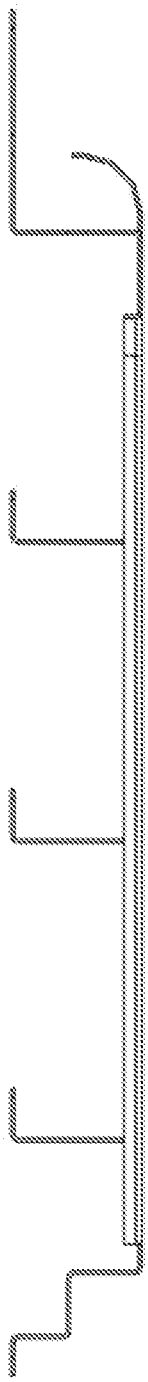
FIG. 73 is a left side view of the frame of FIG. 69.
Figure 74:
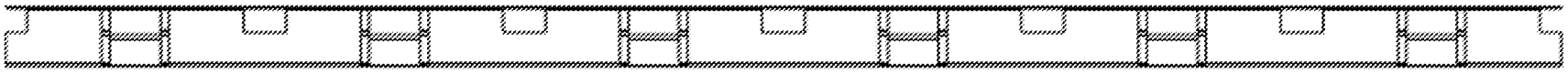
FIG. 74 is a top view of the frame of FIG. 69.
Figure 75:
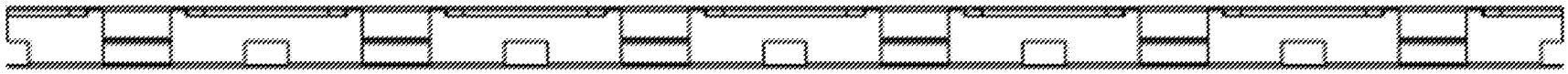
FIG. 75 is a bottom view of the frame of FIG. 69.
Figure 76:
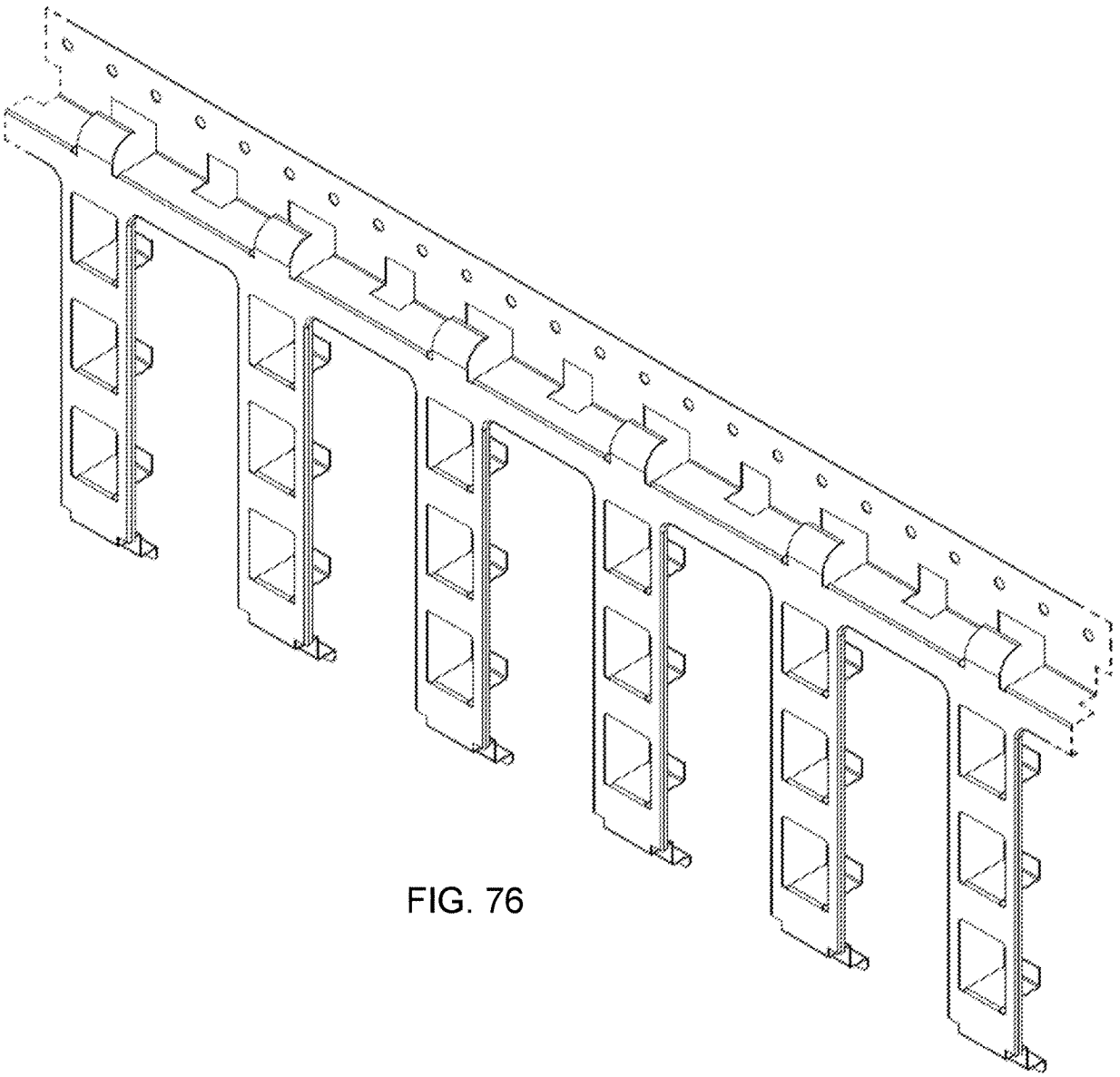
FIG. 76 is a perspective view of a frame according to another embodiment of the disclosure.
Figure 77:
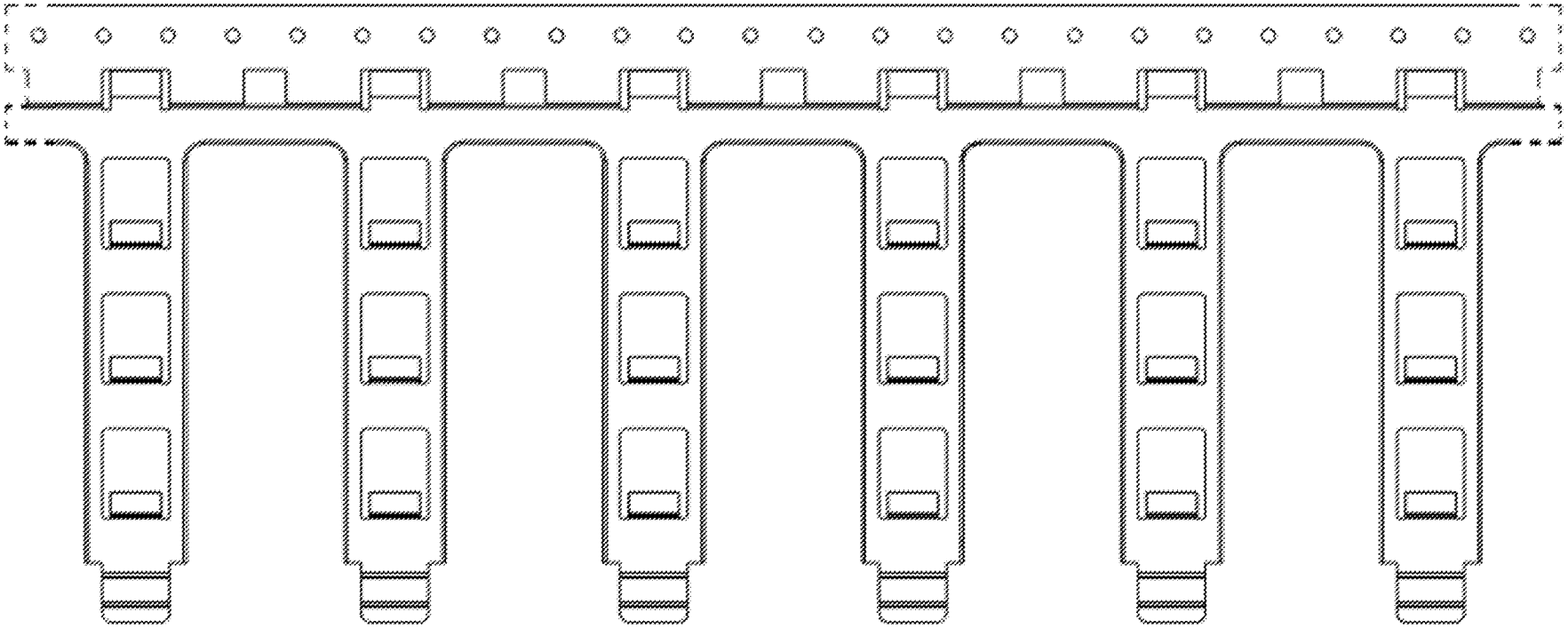
FIG. 77 is a front view of the frame of FIG. 76.
Figure 78:
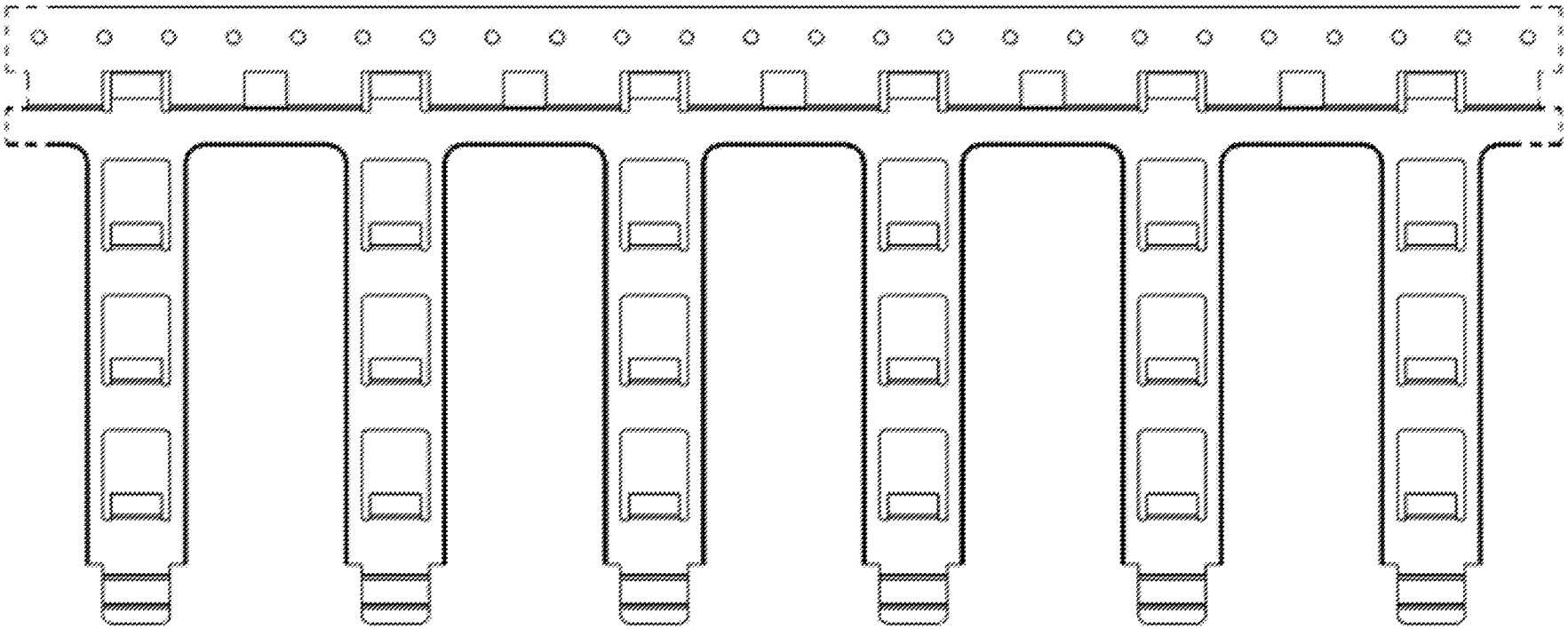
FIG. 78 is a back view of the frame of FIG. 76.
Figure 79:
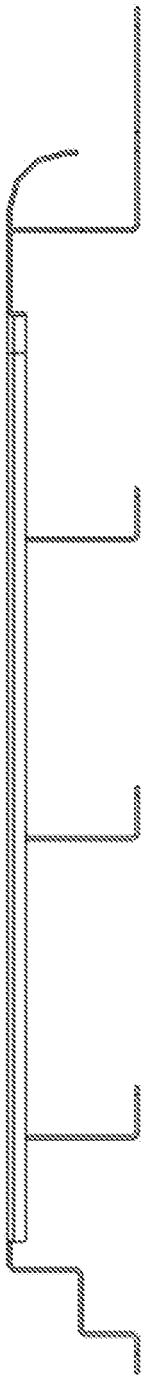
FIG. 79 is a right side view of the frame of FIG. 76.
Figure 80:
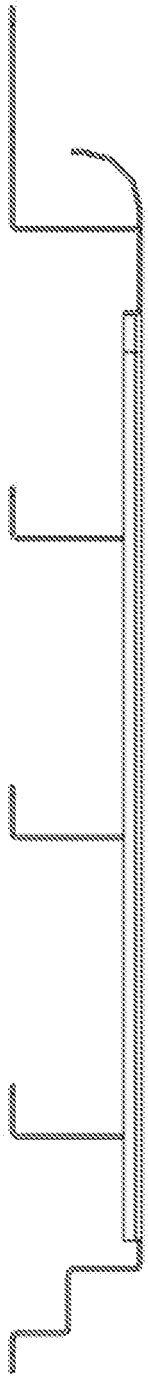
FIG. 80 is a left side view of the frame of FIG. 76.
Figure 81:
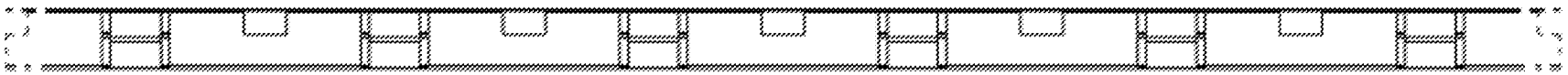
FIG. 81 is a top view of the frame of FIG. 76.
Figure 82:
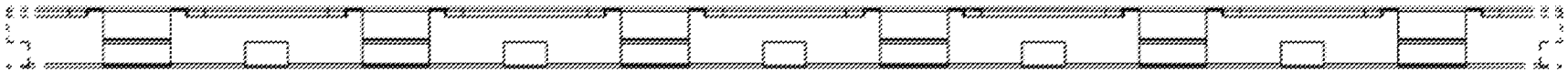
FIG. 82 is a bottom view of the frame of FIG. 76.
Figure 83:
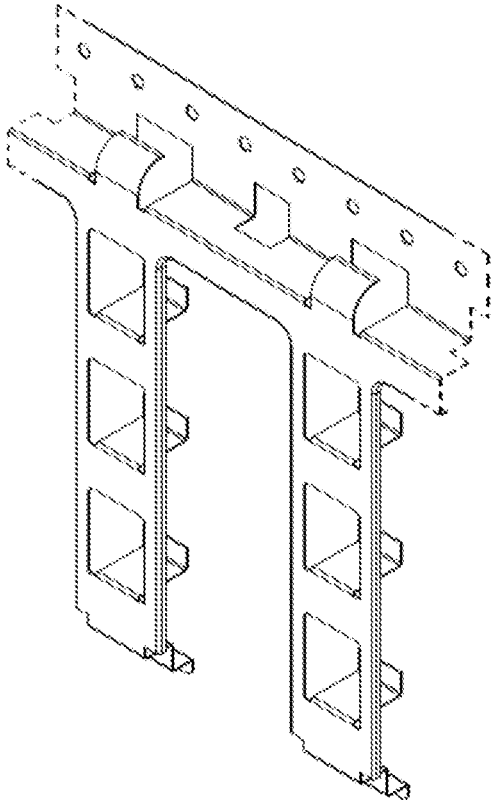
FIG. 83 is a perspective view of sections of a frame according to another embodiment of the disclosure.
Figure 84:
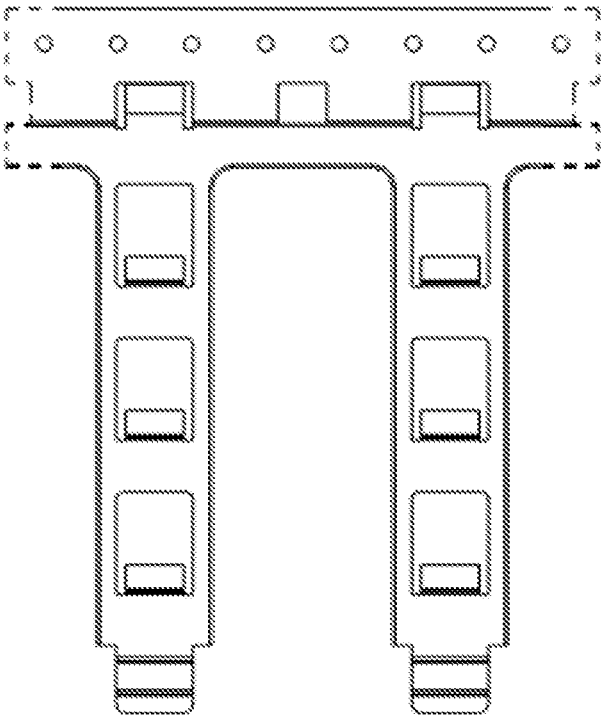
FIG. 84 is a front view of the frame sections of FIG. 83.
Figure 85:
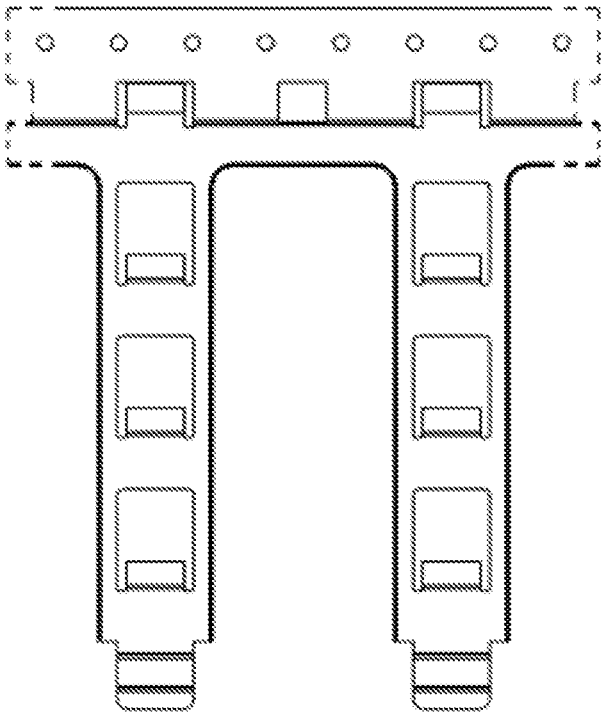
FIG. 85 is a back view of the frame sections of FIG. 83.
Figure 86:
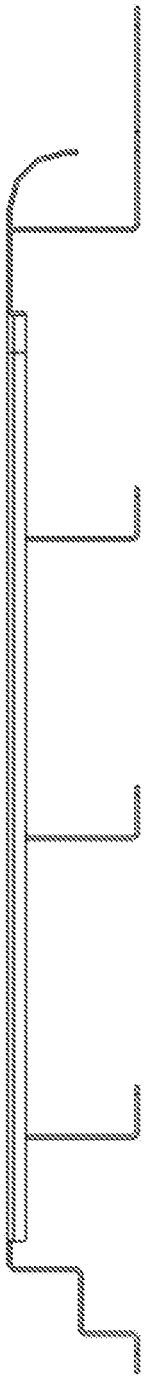
FIG. 86 is a right side view of the frame sections of FIG. 83.
Figure 87:
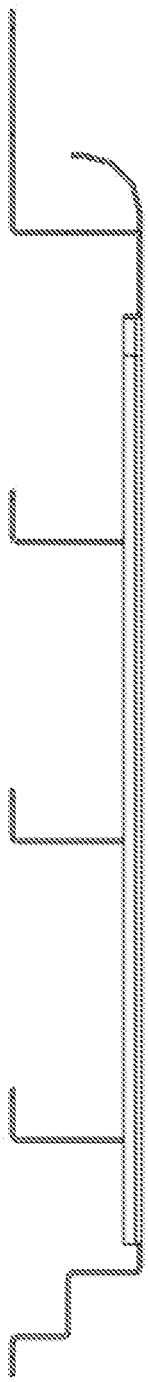
FIG. 87 is a left side view of the frame sections of FIG. 83.
Figure 88:
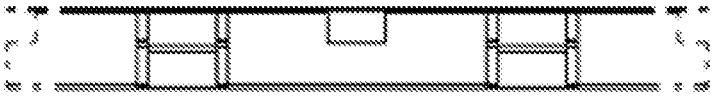
FIG. 88 is a top view of the frame sections of FIG. 83.
Figure 89:
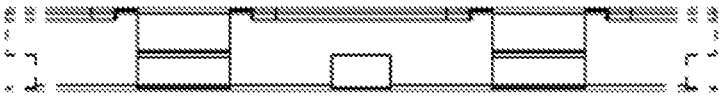
FIG. 89 is a bottom view of the frame sections of FIG. 83.
Figure 90:
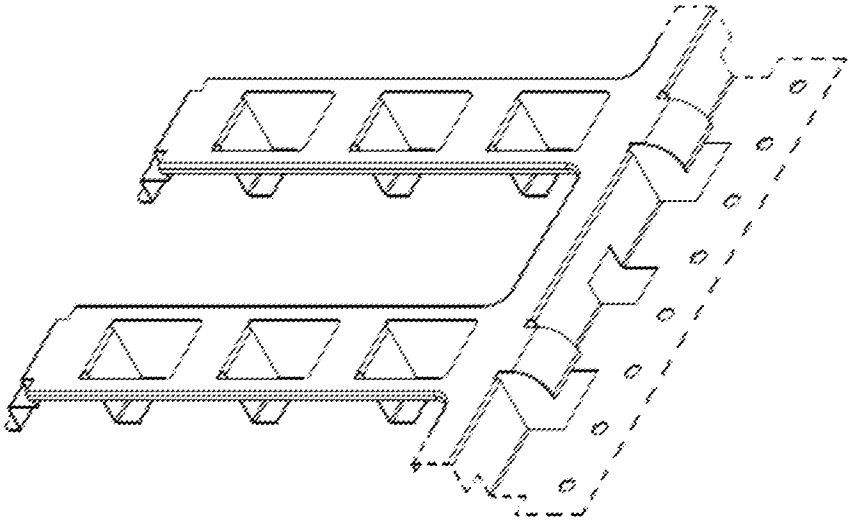
FIG. 90 is a perspective view of sections of a frame according to another embodiment of the disclosure.
Figure 91:
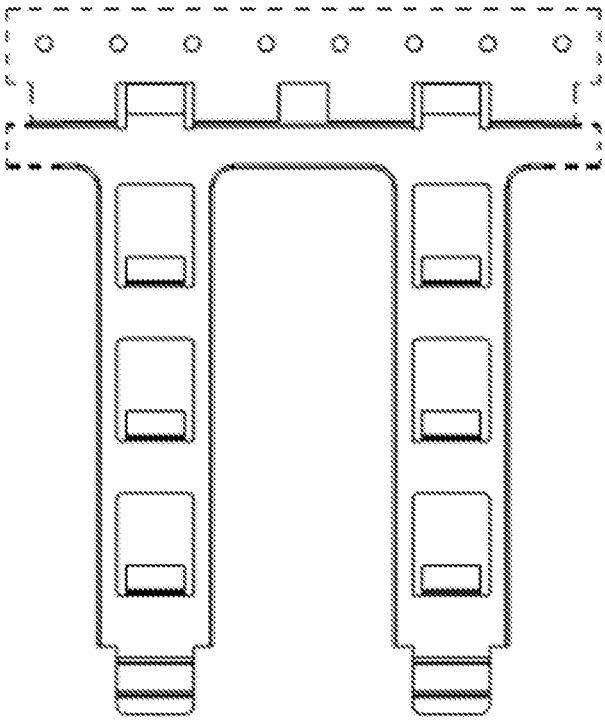
FIG. 91 is a front view of the frame sections of FIG. 90.
Figure 92:
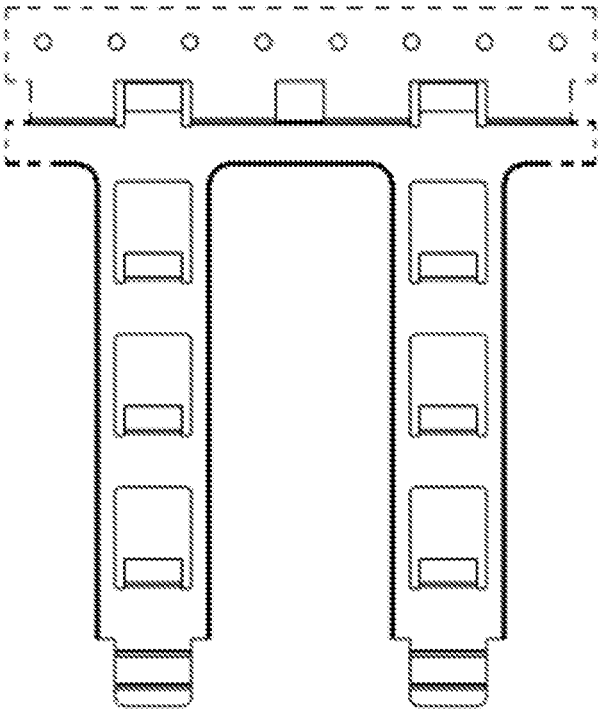
FIG. 92 is a back view of the frame sections of FIG. 90.
Figure 93:
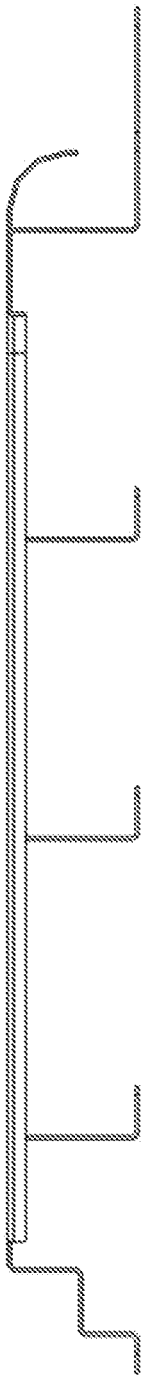
FIG. 93 is a right side view of the frame sections of FIG. 90.
Figure 94:
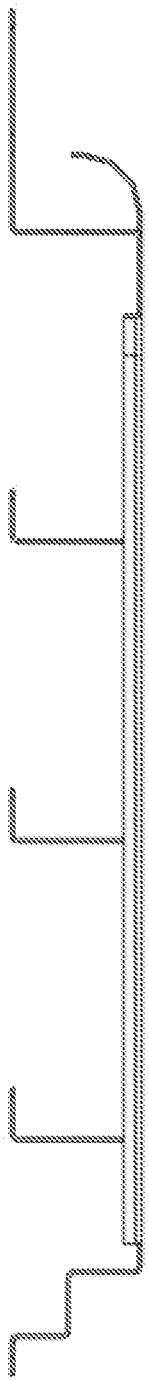
FIG. 94 is a left side view of the frame sections of FIG. 90.
Figure 95:
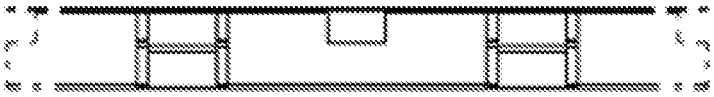
FIG. 95 is a top view of the frame sections of FIG. 90.
Figure 96:
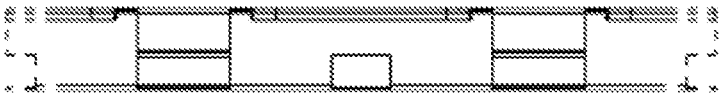
FIG. 96 is a bottom view of the frame sections of FIG. 90.

In certain embodiments, the entire frame is stamped from a metal sheet in a single stamping operation. For example, FIG. 12 shows such a method. A metal sheet 1290 is fed into a stamping press 1292 so that a section of the metal sheet is positioned inside the stamping press. Stamping press 1292 then performs a stamping operation to form the frame in the metal sheet. In some embodiments, the stamping press forms more than one frame at a time. For example, stamping press 1292 forms two frames 1210 that are interlaced. In other embodiments, the stamping press forms one frame in each stamping operation.

Additional aspects of the disclosure are provided by the following numbered embodiments, which can be combined and permuted in any number and in any fashion that is not logically or technically inconsistent.

Embodiment 1

A frame for a wall panel, the frame comprising:

- a support strip extending in a lateral direction, the support strip including a first end and a second end; and
- a row of columns extending in a first direction from the support strip, each column including a proximal end attached to the support strip and a free distal end, the row of columns including:
  - a first column disposed at a first end of the row of columns and laterally offset from the first end of the support strip, and
  - a second column disposed at a second end of the row of columns and laterally offset from the second end of the support strip.

Embodiment 2

The frame according to embodiment 1, wherein a width of the frame is in a range of 6 to 55 inches, e.g., 8 to 48 inches, e.g., about 10 inches, e.g., about 13 inches, e.g., about 23 inches, e.g., about 46 inches.

Embodiment 3

The frame according to embodiment 1 or embodiment 2, wherein a height of each column is in a range from 4 to 14 inches, e.g., from 5 to 12 inches, e.g., from 6 to 9 inches.

Embodiment 4

The frame according to any of embodiments 1 to 3, wherein the frame is formed of a cut and shaped metal sheet.

Embodiment 5

The frame according to any of embodiments 1 to 4, wherein the frame consists of a plurality of identical segments in a line, each of the segments including one of the columns and a portion of the support strip.

Embodiment 6

The frame according to embodiment 5, wherein each of the segments includes a single column.

Embodiment 7

The frame according to embodiment 6, wherein each column is disposed at the lateral center of the respective segment.

Embodiment 8

The frame according to any of embodiments 5 to 7, wherein the width of each segment s in a range from 3 to 6 inches, e.g., from 3.5 to 5 inches.

Embodiment 9

The frame according to any of embodiments 1 to 8, wherein the support strip includes a contact surface that defines a first plane.

Embodiment 10

The frame according to any of embodiments 1 to 9, wherein each column includes a column body extending away from the support strip.

Embodiment 11

The frame according to embodiment 10, wherein each column body lies in a second plane that is parallel to the first plane.

Embodiment 12

The frame according to embodiment 10 or embodiment 11, wherein the lateral sides of each column body include stiffening side bends.

Embodiment 13

The frame according to any of embodiments 10 to 12, wherein each column includes a connecting flange that couples the column body to the support strip, and wherein the connecting flange extends in a direction that is at an angle to the first plane.

Embodiment 14

The frame according to embodiment 13, wherein the connecting flange includes a proximal bend adjacent to the support strip, and wherein a stiffening gusset is disposed in the proximal bend.

Embodiment 15

The frame according to embodiment 13 or embodiment 14, wherein the connecting flange includes a distal bend adjacent to the respective column body, and wherein a stiffening gusset is disposed in the distal bend.

Embodiment 16

The frame according to any of embodiments 13 to 15, wherein the connecting flange includes at least one locating tab that extends toward the support strip.

Embodiment 17

The frame according to embodiment 16, wherein the locating tab is attached to a side of the connecting flange by a bend.

Embodiment 18

The frame according to any of embodiments 8 to 12, wherein the support strip includes a cross bar disposed in a second plane, and wherein each column is connected to the cross bar.

Embodiment 19

The frame according to any of embodiments 1 to 18, wherein each column includes a positioning brace disposed at a distal end thereof.

Embodiment 20

The frame according to embodiment 19, wherein the support strip includes a contact surface that defines a first plane, and wherein each positioning brace includes a foot that lies on the first plane.

Embodiment 21

The frame according to embodiment 20, wherein each column includes a column body that lies in a second plane that is parallel to the first plane, and wherein each positioning brace extends from a corresponding column body to the first plane.

Embodiment 22

The frame according to any of embodiments 19 to 21, wherein the positioning brace includes a locating shelf.

Embodiment 23

The frame according to any of embodiments 1 to 22, wherein each column includes at least one stand-off leg disposed between the proximal and distal end thereof.

Embodiment 24

The frame according to embodiment 23, wherein each column includes an aperture corresponding to each respective stand-off leg.

Embodiment 25

The frame according to embodiment 24, wherein each stand-off leg extends from a lower or upper edge of the corresponding aperture.

Embodiment 26

The frame according to any of embodiments 23 to 25, wherein the support strip includes a contact surface that defines a first plane, and wherein each stand-off leg includes a foot that lies in the first plane.

Embodiment 27

The frame according to embodiment 26, wherein each column includes a column body that lies in a second plane that is parallel to the first plane, and wherein each stand-off leg extends from a corresponding column body to the first plane.

Embodiment 28

The frame according to any of embodiments 1 to 27, wherein the support strip includes a fastening band configured to attach the frame to a substrate.

Embodiment 29

The frame according to any of embodiments 1 to 28, wherein the support strip includes at least one stiffening rib.

Embodiment 30

The frame according to any of embodiments 1 to 29, wherein the frame includes at least two columns, e.g., at least 3 columns, e.g., 6 columns, e.g., 12 columns.

Embodiment 31

A wall panel comprising:

a panel body; and a frame according to any of embodiments 1 to 30 partially embedded in the panel body.

Embodiment 32

The wall panel according to embodiment 31, wherein portions of the frame protrude from a rear face of the panel body, and wherein a front face of the panel body has a textured surface.

Embodiment 33

The wall panel according to embodiment 32, wherein the textured surface replicates a masonry wall.

Embodiment 34

The wall panel according to any of embodiments 31 to 33, wherein each column includes an embedded portion disposed in the panel body.

Embodiment 35

The wall panel according to any of embodiments 31 to 34, wherein each column includes a column body extending away from the support strip and embedded in the panel body.

Embodiment 36

The wall panel according to embodiment 35, wherein each column includes a connecting flange that couples the column body to the support strip, wherein the connecting flange protrudes out of the panel body.

Embodiment 37

The wall panel according to embodiment 36, wherein the connecting flange includes at least one locating tab that defines an upper edge of the panel body.

Embodiment 38

The wall panel according to any of embodiments 31 to 37, wherein each column includes a positioning brace disposed at a distal end thereof, and wherein each positioning brace protrudes from the panel body.

Embodiment 39

The wall panel according to embodiment 38, wherein each positioning brace includes a locating shelf that defines a lower edge of the panel body.

Embodiment 40

The wall panel according to any of embodiments 31 to 39, wherein each column includes at least one stand-off leg disposed between the proximal and distal end thereof, and wherein each stand-off leg protrudes from the panel body.

Embodiment 41

The wall panel according to any of embodiments 31 to 40, wherein the support strip is external to the panel body.

Embodiment 42

A method of manufacturing a frame for a wall panel, the method comprising:

positioning a first section of a metal sheet in a stamping press;

conducting a first stamping operation using the stamping press to form a first frame segment in the first section of the metal sheet, the first frame segment including a portion of a support strip and a column extending from the support strip;

pitching the metal sheet forward so as to position a second section of the metal sheet in the stamping press;

conducting a second stamping operation using the stamping press to form a second frame segment in the second section of the metal sheet, the second frame segment including another portion of the support strip and another column extending from the support strip; wherein the second frame segment is adjacent to the first frame segment so as to form a line of columns extending from the support strip; and cutting the frame segments from the metal sheet so as to form a frame according to any of embodiments 1 to 30.

Embodiment 43

The method according to embodiment 42, wherein the stamped first frame segment is identical to the stamped second frame segment.

Embodiment 44

The method according to embodiment 42 or embodiment 43, further comprising conducting at least one additional stamping operation to form another frame segment in the metal sheet before cutting the frame segments from the metal sheet.

Embodiment 45

The method according to any of embodiments 42 to 44, wherein conducting the first stamping operation includes forming an opposing first frame segment in the first section of the metal sheet and conducting the second stamping operation includes forming an opposing second frame segment in the second section of the metal sheet, and wherein the opposing frame segments include opposing columns extending from an opposing support strip.

Embodiment 46

The method according to embodiment 45, wherein at least one of the opposing columns is interposed between a pair of the columns in the line of columns.

Embodiment 47

The method according to embodiment 45 or embodiment 46, further comprising cutting the opposing frame segments from the metal sheet so as to form an opposing frame according to any of embodiments 1 to 30.

Embodiment 48

The method according to embodiment 47, further comprising conducting at least one additional stamping operation between cutting the frame segments and cutting the opposing frame segments, such that the frame and the opposing frame include a different number of columns.

Embodiment 49

The method according to any of embodiments 42 to 48, wherein each of the frame segments includes a single column.

Embodiment 50

The method according to any of embodiments 42 to 49, wherein the first stamping operation occurs at a single station of the stamping press.

Embodiment 51

The method according to any of embodiments 42 to 49, wherein the first stamping operation includes a first stage performed at first station and a second stage performed at a second station.

Embodiment 52

The method according to embodiment 51, wherein the pitching the metal sheet forward is carried out between the first stage and the second stage of the first stamping operation.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A frame for a wall panel, the frame comprising:

a support strip extending in a lateral direction, the support strip including a first end, a second end, and a contact surface that defines a first plane; and a row of columns extending in a first direction from the support strip, each column including a proximal end attached to the support strip and a free distal end, the row of columns including:

a first column disposed at a first end of the row of columns and laterally offset from the first end of the support strip, and a second column disposed at a second end of the row of columns and laterally offset from the second end of the support strip, wherein each column includes a column body extending away from the support strip and a positioning brace disposed at the distal end of the column, wherein each column body lies in a second plane that is parallel to the first plane, and wherein each positioning brace extends from a corresponding column body to the first plane.

2. The frame according to claim 1, wherein a width of the frame is in a range of 6 to 55 inches.

3. The frame according to claim 1, wherein the frame is formed of a cut and shaped metal sheet.

4. The frame according to claim 1, wherein the frame consists of a plurality of identical segments in a line, each of the segments including one of the columns and a portion of the support strip.

5. The frame according to claim 4, wherein each of the segments includes a single column.

6. The frame according to claim 1, wherein the support strip includes a fastening band configured to attach the frame to a substrate.

7. A frame for a wall panel, the frame comprising:

a support strip extending in a lateral direction, the support strip including a first end, a second end, and a contact surface that defines a first plane; and a row of columns extending in a first direction from the support strip, each column including a proximal end attached to the support strip and a free distal end, the row of columns including:

a first column disposed at a first end of the row of columns and laterally offset from the first end of the support strip, and a second column disposed at a second end of the row of columns and laterally offset from the second end of the support strip, wherein each column includes a column body extending away from the support strip and at least one stand-off leg disposed between the proximal and distal end of the column, wherein each column body lies in a second plane that is parallel to the first plane, and wherein each stand-off leg extends from a corresponding column body to the first plane.

8. The frame according to claim 7, wherein each column includes an aperture corresponding to each respective stand-off leg.

9. The frame according to claim 8, wherein each stand-off leg extends from a lower or upper edge of the corresponding aperture.

10. The frame according to claim 9, wherein each stand-off leg includes a flange extending from the aperture to the first plane, and a foot extending from the flange and lying in the first plane.

11. The frame according to claim 10, wherein in each stand-off leg the foot extends from the flange in a direction toward the support strip.

12. The frame according to claim 7, wherein a width of the frame is in a range of 6 to 55 inches.

13. The frame according to claim 7, wherein the frame is formed of a cut and shaped metal sheet.

14. The frame according to claim 7, wherein the frame consists of a plurality of identical segments in a line, each of the segments including one of the columns and a portion of the support strip.

15. A wall panel comprising:

a panel body; and a frame partially embedded in the panel body, the frame comprising:

a support strip extending in a lateral direction, the support strip including a first end and a second end; and a row of columns extending in a first direction from the support strip, each column including a proximal end attached to the support strip and a free distal end, the row of columns including:

a first column disposed at a first end of the row of columns and laterally offset from the first end of the support strip, and a second column disposed at a second end of the row of columns and laterally offset from the second end of the support strip.

16. The wall panel according to claim 15, wherein portions of the frame protrude from a rear face of the panel body, and wherein a front face of the panel body has a textured surface.

17. The wall panel according to claim 15, wherein each column includes an embedded portion disposed in the panel body.

18. The wall panel according to claim 15, wherein each column includes a positioning brace disposed at a distal end thereof, and wherein each positioning brace protrudes from the panel body.

19. The wall panel according to claim 15, wherein each column includes at least one stand-off leg disposed between the proximal and distal end thereof, and wherein each stand-off leg protrudes from the panel body.

20. The wall panel according to claim 15, wherein the support strip is external to the panel body.

* * * * *